US005147447A

United States Patent [19]

Takeshita et al.

[11] Patent Number: 5,147,447

[45] Date of Patent: Sep. 15, 1992

[54] SINTERED RARE EARTH METAL-BORON-IRON ALLOY MAGNETS AND A METHOD FOR THEIR PRODUCTION

[75] Inventors: Takuo Takeshita, Kawagoe; Muneaki Watanabe, Urawa, both of Japan

[73] Assignee: Mitsubishi Materials Corporation, Tokyo, Japan

[21] Appl. No.: 460,079

[22] PCT Filed: May 15, 1989

[86] PCT No.: PCT/JP89/00491

§ 371 Date: Feb. 2, 1990

§ 102(e) Date: Feb. 2, 1990

[87] PCT Pub. No.: WO89/12113

PCT Pub. Date: Dec. 14, 1989

[30] Foreign Application Priority Data

Jun. 3, 1988 [JP] Japan ..... 63-136732
Jul. 15, 1988 [JP] Japan ..... 63-176786

[51] Int. Cl.[5] ..... G22F 9/00

[52] U.S. Cl. ..... 75/246; 75/244; 419/12; 419/29; 419/38

[58] Field of Search ..... 419/38, 12, 29; 75/246, 75/244

[56] References Cited

U.S. PATENT DOCUMENTS 4,770,702 9/1988 Ishigaki et al. ..... 75/244
4,836,868 6/1989 Yajima et al. ..... 75/244

*Primary Examiner*—Stephen J. Lechert, Jr.
*Attorney, Agent, or Firm*—Scully, Scott, Murphy & Presser

[57] ABSTRACT

The present invention provides sintered rare earth metal-boron-iron alloy magnets having superior anti-corrosion properties in which the magnetic properties do not deteriorate with time obtained by adding at least one oxide powder chosen from the group including Al, Ga, Ni, Co, Mn, Cr, Ti, V, Nb, Y, Ho, Er, Tm, Lu, as well as Eu, as well as at least one hydride powder chosen from the group including Zr, Ta, Ti, Nb, V. Hf, and Y in an amount totalling from 0.0005 to 3.0 weight % to a R-B-Fe alloy powder; molding; sintering; and then carrying out heat treatment as necessary.

25 Claims, 1 Drawing Sheet a: $R_2Fe_{14}B_1$ Phase
b: R Rich Phase
c: $R_1Fe_4B_4$ Phase (B Rich Phase)

a: $R_2Fe_{14}B_1$ Phase
b: R Rich Phase
c: $R_1Fe_4B_4$ Phase (B Rich Phase)

SINTERED RARE EARTH METAL-BORON-IRON ALLOY MAGNETS AND A METHOD FOR THEIR PRODUCTION

FIELD OF THE INVENTION

The present invention concerns sintered magnets and a method for their production, said sintered magnets having exceedingly good anti-corrosion properties, and at the same time, magnetic properties which do not deteriorate with time. The magnets of the present invention are necessarily composed of a rare earth metal (hereafter indicated by R) component including at least one element chosen from the rare earth element group including yttrium; boron; as well as iron.

PRIOR ART

In recent years, Nd-B-Fe permanent magnets have been discovered which, in comparison with the previously known Sm-Co magnets, have improved magnetic properties, and moreover, do not necessarily include Sm and Co which are more valuable from the standpoint of resources. The manufacturing method for these Nd-B-Fe permanent magnets involves first of all melting starting materials, casting, pulverizing the thus obtained alloy ingot, then as is needed, press forming in the a magnetic field, and finally sintering.

However, with these Nd-B-Fe permanent magnets, while having improved magnetic properties, they are very liable to corrosion and also have the additional defect of severe deterioration with time of their magnetic properties.

In an attempt to solve these problems, in Japanese Patent Application No. 61-185910, a method for diffusion forming a thin zinc coating over the surface of an R-B-Fe permanent magnet, and in Japanese Patent Application No. 61-270308, a method in which the surface layer of an R-B-Fe permanent magnet is removed after which an aluminum coating layer is applied have been described.

For both of the previously stated prior art anti-corrosion methods for Nd-B-Fe permanent magnets, however, because some protective coating of zinc, aluminum, or the like must be deposited on the permanent magnet surface, in addition to the manufacturing processes for the magnet, and thus additional processes are necessary. Accordingly, the above described manufacturing methods are not only complicated, but also high cost. Furthermore, because the above anti-corrosion methods do nothing more than protect the outer portion of the permanent magnet from corrosion and the like, when the above mentioned protective coating layers exfolliate or crack, corrosion may penetrate inwards from such areas. Thus, internal corrosion is not prevented and the additional problem of deterioration of magnetic properties with such magnets also occurs.

SUMMARY OF THE INVENTION

For these reasons, in order to develop an R-B-Fe permanent magnet having superior corrosion resistant properties, the present inventors carried out research, the results of which showed that a manufacturing method for a sintered R-B-Fe magnet was possible in which first an R-B-Fe alloy powder which included at least one oxide powder chosen from the group including Al, Ga, Ni, Co, Mn, Cr, Ti, V, Nb, Y, Ho, Er, Tm, LuZr, as well as Eu oxides, plus an additive comprising a total of from 0.0005 to 3.0 weight % of at least one hydride powder chosen from the group including Zr, Ta, Ti, Nb, V, Hf, and Y hydrides were processed; pressing, sintering and carrying out heat treatment as necessary; whereby a sintered R-B-Fe magnet having improved anti-corrosion properties and no time decay of magnetic properties could be formed.

The present invention is based on the knowledge thus obtained, and the manufacturing method for an R-B-Fe sintered magnet of the present invention will be explained in detail in the following.

(1) An R-B-Fe alloy powder having a fixed composition is prepared. This R-B-Fe alloy powder is prepared by, for example, a method in which a molten alloy is cast into an ingot, then pulverized; a liquid atomization method; or a reduction-diffusion method in which a rare earth oxide is used, and the like.

The above mentioned R-B-Fe alloy powder is a mixture composed of at least one oxide powder chosen from the group including Al, Ga, Ni, Co, Mn, Cr, Ti, V, Nb, Y, Ho, Er, Tm, LuZr, as well as Eu oxides, plus an additive comprising a total of from 0.0005 to 3.0 weight % of at least one hydride powder chosen from the group including Zr, Ta, Ti, Nb, V, Hf, and Y hydrides.

The reason for establishing these limits for the additive is that with less than a weight % of 0.0005, the effectiveness of the anti-corrosion properties is insufficient, and when the weight % exceeds 3.0%, the magnetic properties are insufficient. Concerning the above mentioned additive in greater detail, as the amount of additive is increased within the limits of 0.0005 to 3.0 weight %, the magnetic property of residual flux density has a tendency to decrease. Thus, it is even more desirable to limit the amount of additive to between 0.0005 and 2.5 weight %.

Concerning the above mentioned oxides and hydrides, ordinary grades may be used. Also, when the oxide is added, if a nitride compound powder is added at the same time, the anti-corrosion and magnetic properties are even more markedly improved.

(2) The mixed powder obtained in the above step is molded by compacting in a compression press or the like. For this process, a compression pressure of 0.5–10 t/cm$^2$ is suitable, and as required, a magnetic field (at least 5 KOe) may by applied to improve the magnetic properties. In molding, wet compaction or dry compaction are suitable, and a non-oxidizing atmosphere is desirable, for example, a vacuum, an inert gas atmosphere, or a reducing gas are all suitable. At the time of molding, a molding adjuvant (binding agent, lubricating agent, etc.) may be added as necessary. For these, paraffin, camphor, stearic amide, stearate, and the like can be used, a weight % of 0.001–2 being desirable. When the added amount of the above mentioned molding adjuvant is less than 0.001 weight %, lubrication properties required during molding are insufficient, and thus is undesirable. On the other hand, when the added amount of the above mentioned molding adjuvant is greater than 2 weight %, after sintering, degradation of a magnetic properties in the sintered body are considerable.

(3) The obtained molded body is sintered at a temperature of 900°–1200° C. When the sintering temperature is less than 900° C., residual magnetic flux (hereafter referred to as Br) becomes insufficient. When the sintering temperature is greater than 1200° C., the Br and the squareness of the demagnetization curve become low, and hence is undesirable. In order to prevent oxidization during sintering, a non-oxidizing atmosphere is desirable. That is to say, a vacuum, an inert gas, or a reducing gas atmosphere is suitable. For the rate of temperature increase during sintering, somewhere in the range of 1°-2000° C./min is suitable. When a molding adjuvant is used, keeping the heating rate low at 1°-1.5° C. /min and removing the molding adjuvant during heating will favorably effect the magnetic properties. For the sintering maintenance interval, a period of 0.5-20 hours is good. If the sintering maintenance interval is less than 0.5 hours, dispersion in the sintered density will occur. If the sintering maintenance interval is greater than 20 hours, the problem of coarseness in the crystallized grains develops. For the cooling rate after sintering, a rate of 1°-2000° C./min is suitable, however, if the cooling is too fast, the probability of developing cracks in the sintered body is high. Conversely, if the cooling rate is too slow, efficiency from the viewpoint of industrial productivity becomes a problem, thus the previously stated limits were decided upon.

(4) After the above sintering, to further improve magnetic characteristics, a heat treatment at a temperature of 400°-700° C. is carried out. Just as with sintering, this heat treatment should be carried out in an inert atmosphere. For this heat treatment, a heating rate of 10°-2000° C./min, a maintenance period at 400°-700° C. of 0.5-10 hours, and a cooling rate of 10°-2000° C./min is suitable. The above described heat treatment consists of heating, holding the temperature and cooling. The same results can be obtained, however, by repeating the pattern or changing the temperature in steps.

In the following, the component structure as well as the reasons for the obtained component structure will be described for a sintered rare earth metal-boron-iron alloy magnet to which the method of the present invention was applied.

For a magnet manufactured by the present invention, R, B, as well as Fe are indispensable elements, For R, Nd, Pr, as well as the mixture of these elements are suitable. Additionally, it is suitable to include rare earth elements such as Tb, Dy, La, Ce, Ho, Er, Eu, Sm, Gd, Pm, Tm, Yb, Lu, as well as Y in an total amount of 8-30 atomic %. If less than 8 atomic % is used, sufficient coercivity (hereafter referred to as iHc) cannot be obtained. If greater than 30 atomic % is added, the Br becomes low. Among the above mentioned R elements; Y, Ho, Er, Tm, Lu as well as Eu, have the fundamental property of easily imparting corrosion resistance, and for this reason, when incorporated into the R-rich phase, impart sufficient corrosion resistance in this R-rich phase. However, because when a large amount of these elements are incorporated in the main phase, there is an effect of degraded magnetic characteristics, it is desirable that these elements exist only in the inter-grain regions of R-rich phase. Accordingly, when the above specified rare earth element oxide is added, for the R-B-Fe alloy powder, it is desirable to use an alloy powder which does not include the above noted elements.

B amounts to 2-28 atomic %. When B is less than 2%, a sufficient iHc cannot be obtained, and when B is greater than 28%, the Br becomes low and superior magnetic properties cannot be obtained.

The sintered rare earth boron-iron alloy magnets are prepared using the above mentioned essential ingredients of R, B, and Fe, however, a portion of the Fe may be replaced with another element, or impurities may be present with no loss to the effect of the present invention.

That is to say, up to 50 atomic % of the Fe may be replaced by Co. If the amount of Co is greater than 50 atomic %, then a high iHc cannot be obtained. Fe may be replaced with at least one element other than the above mentioned element in amounts no greater than the below listed atomic %'s (however, when two or more elements are included, the total amount should be no greater than the value for the element having the largest permissible value) with no loss in the effect of the present invention. These elements are listed below (unit - atomic %).

| | | | | | |
|---|---|---|---|---|---|
| Ti: 4.7, | Ni: 8.0, | Bi: 5.0, | W: 8.8, | Zr: 5.5, | Ta: 10.5, |
| Mo 8.7, | Ca: 8.0, | Hf: 5.5, | Ge: 6.0, | Nb: 12.5, | Mg: 8.0, |
| Cr: 8.5, | Sn: 3.5, | Al: 9.5, | Sr: 7.5, | Mn: 8.0, | Sb: 2.5, |
| V: 10.5, | Be: 3.5, | Ba: 2.5, | Cu: 3.5, | S: 2.5, | P: 3.3, |
| C: 4.0, | O: 1.5, | Ga: 6.0 | | | |

In the present invention, the reason that adding these added components improves magnetic characteristics is that, when the R-rich liquid phase is formed during sintering, a portion of the oxidizing components are reduced and then deposited in the metal state in the inter-crystalline grain boundaries. Fundamentally, since these metals themselves have anti-corrosion properties, it is thought that they contribute to the anti-corrosion properties of the magnets thus formed.

In the following section, sintered rare earth boron-iron alloy magnets manufactured by the above described method will be discussed.

In general, the structure of rare earth boron-iron permanent magnets is, as shown in FIG. 1, composed mainly of a $R_2Fe_{14}B_1$ phase a; and existing in a part of the inter-granular boundaries of said $R_2Fe_{14}B_1$ phase a, an R-rich phase b (said to be composed of $R_{95}Fe_5$ phase, $R_{75}Fe_{25}$ phase, and the like); as well as a B-rich phase c made up of $R_1Fe_4B_4$ phase. The coercivities of these magnets is a result of the fact that the magnetic phase, chief phase a is wrapped in an R-rich phase b, and that magnetic nucleus formation is restricted in the inter-granular boundaries. On the other hand however, because this R-rich phase b is inferior in regard to anti-corrosion properties, through this R-rich phase b, corrosion occurring at the inter-granular boundaries advances into the interior. For the sintered rare earth boron-iron alloy magnets of the present invention, in the inter-granular boundary phase (R-rich phase) contains 20-90 atomic % of at least one component selected from the group including Ni, Co, Mn, Cr, Ti, V, Al, Ga, In, Zr, Hf, To, Nb, Mo, Si, Re, as well as W (hereafter referred to as M), or otherwise, in addition to or instead of M, an amount of R from 20-90 atomic %, and additionally, an oxide in the amount of 30-70 atomic %. In this way, for sintered magnets incorporating M in the inter-granular boundary phase, and additionally, magnets incorporating M and/or R in the inter-granular boundary phase along with an oxide, anti-corrosive properties of the inter-granular boundary phase can be improved, and thus overall superior anti-corrosive properties can be achieved. Similarly, because the inter-granular boundary phase with its included additive elements also has a controlling effect on growth of the magnetic phase, chief phase crystal grains, these crystal grains can highly densify in their minute state, and thus also have superior magnetic properties.

With the above, when the amount of the M component of the inter-granular boundary phase is less than 20 atomic %, sufficient anti-corrosive properties cannot be obtained. On the other hand, when the amount of the M component of the inter-granular boundary phase is greater than 90 atomic %, the above mentioned M components tends to diffuse into the chief phase during manufacture, and thus while the anti-corrosive properties are improved, magnetic properties decline greatly which is unsuitable. Furthermore, in the inter-granular boundary phase, together with M and/or R, when oxygen is incorporated in an amount of 30–70 atomic %, magnetic properties do not decline and anti-corrosive properties further improve. When the above mentioned oxygen in the inter-granular boundary phase is less than 30%, the anti-corrosive properties are not further improved. On the other hand, when the oxygen in the inter-granular boundary phase is greater than 70%, the oxygen tends to diffuse into the chief phase, and the magnetic properties decline greatly which is unsuitable.

Further, for the sintered rare earth boron-iron alloy magnets of the present patent application, the content cf the chief phase $R_2Fe_{14}B_1$ phase is limited to 50 to 95 volume %, the B-rich phase $R_1Fe_4B_4$ phase is limited to 0 to 20 volume % (however, 0% is excluded), the inter-granular boundary phase R-rich phase is limited to 2 to 30 volume %.

BEST MODE FOR CARRYING OUT THE INVENTION

Figure 1:
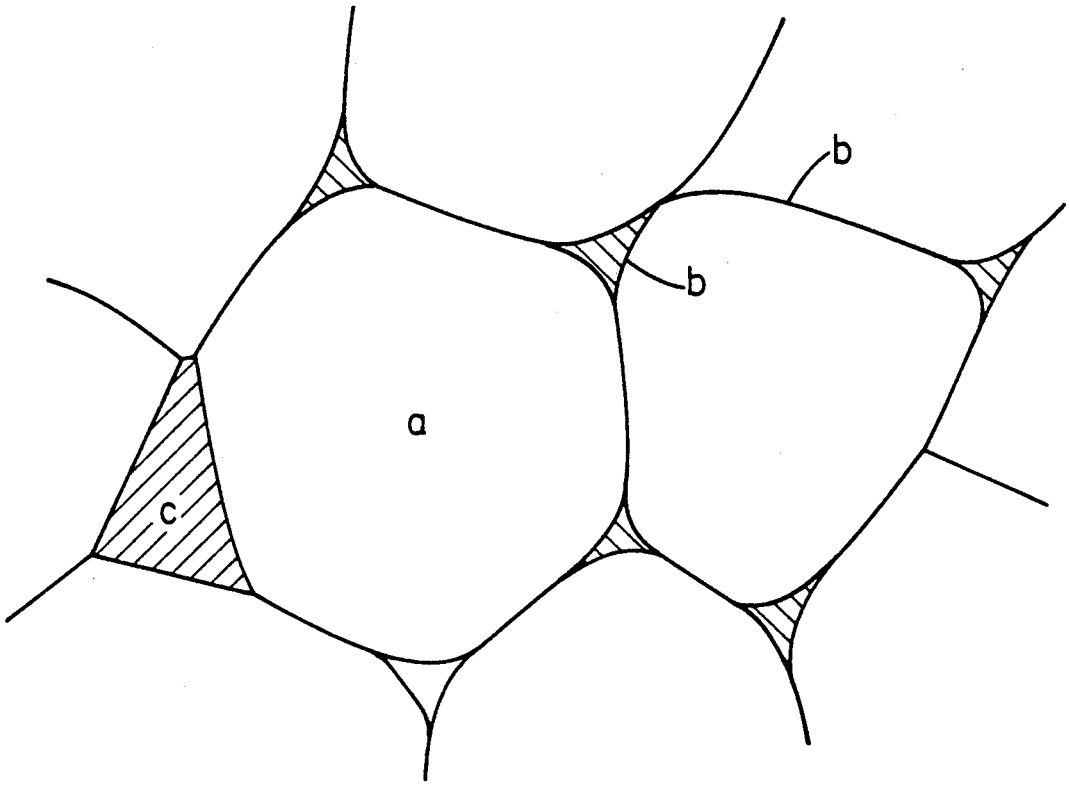
FIG. 1 is a schematic drawing of a prior art sintered rare earth boron-iron alloy magnet.

In the following, the present invention will be concretely explained based on a preferred embodiment, however, the present invention is in no way limited to this preferred embodiment. In the present preferred embodiment, the presence of surface rust on the sintered samples was assessed by first sectioning an anti-corrosion sintered compact, and the examining the periphery of the cut surface. If no rust could be observed at the periphery of the cut surface, the specimen was judged as "rust absent". If rust were observed at the periphery of the cut surface, the specimen was judged as "rust present". If rust were observed at the periphery of the cut surface, and furthermore, were observed to have penetrated within the specimen was judged as "rust heavy".

Examples 1–5 and Comparative Examples 1–3

A melt composed of 15% Nd, 8% B, and the remainder Fe (here % stands for atomic %) was cast into an alloy ingot. This alloy ingot was pulverized, yielding a fine powder having an average particle diameter of 3.5 μm. Starting material powder was then prepared by mixing the powder thus obtained with $Cr_2O_3$ powder of an average particle diameter of 1.2 μm in the proportions indicated in Table 1. The thus obtained starting material powder was then molded in an ambient atmosphere at a molding pressure of 2 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1100° C. and maintained under those conditions for 1 hr. to effect sintering, after which they were cooled at a cooling rate of 50° C./min Thereafter, the sintered compacts were heated in an argon atmosphere at a rate of 10° C./min to a temperature of 620° C. and maintained under those conditions for 2 hr., after which they were cooled at a rate of 100° C./min to thus effect heat treatment.

The magnetic properties of the obtained heat treated sintered compacts were measured, after which an anti-corrosion test was carried out. The anti-corrosion test was carried out by leaving the compacts in an ambient atmosphere at a temperature of 60° C. and humidity of 90% for 650 hr.. After carrying out the above described anti-corrosion test, the magnetic properties were again measured and examination for the formation of rust was performed, and these results are shown in Table 1.

Examples 6–10 and Comparative Examples 4–6

A melt composed of 13.5% Nd, 1.5% Dy, 8% B, and the remainder Fe (here % stands for atomic %) was cast into an alloy ingot. This alloy ingot was pulverized using a jaw crusher, disk mill, as well as a ball mill, yielding a fine powder having an average particle diameter of 3.2 μm. Starting material powder was then prepared by mixing the fine powder thus obtained with $TiO_2$ powder of an average particle diameter of 1.5 μm in the proportions indicated in Table 2. The thus obtained starting material powder was then molded at a molding pressure of 1.5 t/cm$^2$ in a magnetic field of 14 KOe to form 12 mm L×10 mm W×10 mm H compacts. The compacts thus obtained were then heated in an argon atmosphere of reduced pressure argon atmosphere (250 torr) at a heating rate of 10° C./min to 1080° C. and maintained under those conditions for 2 hr. to effect sintering, after which they were cooled at a cooling rate of 100° C./min. Thereafter, the sintered compacts were heated in an argon atmosphere at a rate of 20° C./min to a temperature of 650° C. and maintained under those conditions for 1.5 hr., after which they were cooled at a rate of 100° C./min to thus effect heat treatment.

The magnetic properties of the obtained heat treated $TiO_2$ containing sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results were shown in Table 2.

Examples 11–16 and Comparative Examples 7–8

The above described 13.5% Nd, 1.5% Dy, 8% B, and the remainder Fe (here % stands for atomic %) alloy powders from Examples 6–10 and Comparative Examples 4–6 were combined with $MnO_2$ powder of an average particle diameter of 1.0 μm in the proportions indicated in Table 3. The thus obtained starting material powders were then molded at a molding pressure of 5 t/cm$^2$ in a magnetic field of 12 KOe to form 12 mm L×10 mm W×10 mm H compacts. The compacts thus obtained were then heated in an argon atmosphere of reduced pressure (250 torr) at a heating rate of 15° C./min to 1200° C. and maintained under those conditions for 2 hr. to effect sintering, after which they were cooled at a cooling rate of 150° C./min.

Thereafter, the sintered compacts were heated at a rate of 30° C./min to a temperature of 650° C. and maintained under those conditions for 1.5 hr., after which they were cooled at a rate of 200° C./min to thus effect heat treatment. The magnetic properties of the obtained heat treated sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 3.

Examples 17-22 and Comparative Examples 9-10

The above described 13.5% Nd, 1.5% Dy, 8% B, and the remainder Fe (here % stands for atomic %) alloy powders from Examples 6-10 and Comparative Examples 4-6 were combined with $Co_2O_3$ powder of an average particle diameter of 1.2 μm in the proportions indicated in Table 4. The thus obtained starting material powders were then molded at a molding pressure of 10 t/cm$^2$ in a magnetic field of 20 KOe to form 20 mm L×20 mm W×15 mm H compacts. The compacts thus obtained were then heated in an argon atmosphere of reduced pressure (250 torr) at a heating rate of 20° C./min to 900° C. and maintained under those conditions for 20 hr. to effect sintering, after which they were cooled at a cooling rate of 500° C./min.

Thereafter, the sintered compacts were heated at a rate of 1000° C./min to a temperature of 500° C. and maintained under those conditions for 7 hr., after which they were cooled at a rate of 500° C./min..

The magnetic properties of the obtained heat treated sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 4.

Examples 23-29 and Comparative Examples 11-12

The above described 13.5% Nd, 1.5% Dy, 8% B, and the remainder Fe (here % stands for atomic %) alloy powders from Examples 6-10 and Comparative Examples 4-6 were combined with NiO powder of an average particle diameter of 1.0 μm in the proportions indicated in Table 5. The thus obtained starting material powders were then molded at a molding pressure of 1.5 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1080° C. and maintained under those conditions for 1 hr. to effect sintering, after which they were cooled at a cooling rate of 50° C./min.

Thereafter, the sintered compacts were heated at a rate of 20° C./min to a temperature of 800° C. and maintained for 1 hr., and maintained at a temperature of 620° C. for 1.5 hr., after which they were cooled at a rate of 100° C./min., thus effecting heat treatment.

The magnetic properties of the obtained heat treated sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 5.

Examples 30-35 and Comparative Examples 13-14

The above described 15% Nd, 8% B, and the remainder Fe (here % stands for atomic %) alloy powders from Examples 1-5 and Comparative Examples 1-3 were combined with $V_2O_5$ powder of an average particle diameter of 1.4 μm in the proportions indicated in Table 6. The thus obtained starting material powders were then molded at a molding pressure of 7 t/cm$^2$ in a magnetic field of 20 KOe to form 20 mm L×20 mm W ×15 mm H compacts. The compacts thus obtained were then heated in a vacuum ($10^{-5}$ torr) at a heating rate of 100° C./min to 1000° C. and maintained under those conditions for 10 hr. to effect sintering, after which they were cooled at a cooling rate of 300° C./min.

Thereafter, the sintered compacts were heated at a rate of 100° C./min to a temperature of 550° C. and maintained for 2 hr. under those conditions after which they were cooled at a rate of 300° C./min., thus effecting heat treatment.

The magnetic properties of the obtained heat treated sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 6.

Examples 36-41 and Comparative Examples 15-16

The above described 15% Nd, 8% B, and the remainder Fe (here % stands for atomic %) alloy powders from Examples 1-5 and Comparative Examples 1-3 were combined with $Nb_2O_3$ powder of an average particle diameter of 1.2 μm in the proportions indicated in Table 7. The thus obtained starting material powders were then molded at a molding pressure of 1 t/cm$^2$ in a magnetic field of 5 KOe to form 12 mm L×10 mm W ×10 mm H compacts. The compacts thus obtained were then heated in a vacuum ($10^{-5}$ torr) at a heating rate of 3° C./min to 1200° C. and maintained under those conditions for 1.5 hr. to effect sintering, after which they were cooled at a cooling rate of 5° C./min.

Thereafter, the sintered compacts were heated at a rate of 20° C./min to a temperature of 450° C. and maintained for 2 hr. under those conditions after which they were cooled at a rate of 900° C./min , thus effecting heat treatment.

The magnetic properties of the obtained heat treated sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 7.

Examples 42-54 and Comparative Examples 17-21

The above described 13.5% Nd, 1.5% Dy, 8% B, and the remainder Fe (here % stands for atomic %) alloy powders from Examples 6-10 and Comparative Examples 4-6 were combined with at least two kinds of oxide powders chosen from $Cr_2O_3$ (average particle diameter: 1.2 μm), NiO (average particle diameter: 1.0 μm), $Co_2O_3$ (average particle diameter: 1.2 μm), $MnO_2$ (average particle diameter: 1.0 μm), $TiO_2$ (average particle diameter: 1.5 μm), $V_2O_5$ (average particle diameter: 1.4 μm), as well as $Nb_2O_3$ (average particle diameter: 1.2 μm), in the proportions indicated in Table 8.

The thus obtained starting material powders were then molded at a molding pressure of 1.5 t/cm$^2$ in a magnetic field of 14 KOe to form 12 mm L×10 mm W×10 mm H compacts. The compacts thus obtained were then heated in an argon atmosphere of reduced pressure (250 torr) at a heating rate of 10° C./min to 1080° C. and maintained under those conditions for 2 hr. to effect sintering, after which they were cooled at a cooling rate of 100° C./min.

Thereafter, the sintered compacts were heated in an argon gas atmosphere at a rate of 20° C./min to a temperature of 650° C. and maintained under those conditions for 1.5 hr., after which they were cooled at a rate of 100° C./min to thus effect heat treatment. The magnetic properties of the obtained heat treated oxide containing sintered compacts were measured, after which an anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 8.

From the results in Tables 1–8 concerning the above described alloy powders from Examples 1–54 and Comparative Examples 1–21, it can be understood that for sintered magnets manufactured by molding R-B-Fe alloy powders and sintering, rust forms on the surface after the anti-corrosion test, and that rust diffuses within causing marked corrosion, and that after the anti-corrosion test, the deterioration of magnetic properties is remarkable. However, when a sintered magnet is manufactured using as a starting material powder one to which is added at least one kind of oxide chosen from the group including Ni, Co, Mn, Cr, Ti, V, and Nb, the total amount being 0.0005–3.0 weight %, a sintered magnet having superior anti-corrosion properties can be manufactured. And further, it can be understood that with such a magnet, that the deterioration of magnetic properties after the anti-corrosion test can be restrained.

With sintered magnets manufactured from an R-B-Fe alloy powder in which the total added amount of the above mentioned oxides exceeds 3.0 weight %, rust formation on the surface cannot be seen, however, the magnetic properties of the magnet itself decline. When using a starting material powder in which total added amount of the above mentioned oxides is less than 0.0005 weight %, rust forms on the surface of the sintered magnet, and after the anti-corrosion test, deterioration of magnetic properties is remarkable.

Examples 55–94 and Comparative Examples 22–38

First of all, a melt composed of 13.5% Nd, 1.5% Dy, 8% B, and the remainder Fe (here % stands for atomic %) was cast into an alloy ingot.

This alloy ingot was pulverized, yielding a fine powder having an average particle diameter of 3.5 μm. Starting material powders were then prepared by mixing the powder thus obtained with 1.2 μm average particle diameter $Al_2O_3$ powder, $ZrO_2$ powder, $Cr_2O_3$ powder, and $TiO_2$ powder in the proportions indicated in Table 9 for Examples 55–94 and Comparative Examples 22–38. The thus obtained starting material powders were then molded in room air at a molding pressure of 1.5 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1100° C. and maintained under those conditions for 1 hr. to effect sintering, after which they were cooled at a cooling rate of 50° C./min Thereafter, the sintered compacts were heated in an argon atmosphere at a rate of 10° C./min to a temperature of 620° C. and maintained under those conditions for 2 hr., after which they were cooled at a rate of 100° C./min to thus effect heat treatment.

The magnetic properties of the obtained heat treated sintered compacts were measured, after which an anti-corrosion test was carried out. The anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, and these results are shown in Table 9.

From the results in Table 9 concerning the above described alloy powders, it can be understood that for sintered magnets manufactured by molding R-B-Fe alloy powders and sintering, rust forms on the surface after the anti-corrosion test, and that rust diffuses within causing marked corrosion, and that after the anti-corrosion test, the deterioration of magnetic properties is remarkable. However, when a sintered magnet is manufactured using as a starting material powder one to which $Al_2O_3$ powder is added in an amount of 0.0005–3.0 weight %, or one to which $Al_2O_3$ powder is added plus at least one kind of oxide powder chosen from the group including Zr, Cr, and Ti, the total amount being 0.0005–3.0 weight %, a sintered magnet having superior anti-corrosion properties can be manufactured. And further, it can be understood that with such a magnet, that the deterioration of magnetic properties after the anti-corrosion test can be restrained.

With sintered magnets manufactured from an R-B-Fe alloy powder in which the total added amount of the above mentioned oxides exceeds 3.0 weight %, rust formation on the surface cannot be seen, however, the magnetic properties of the magnet itself decline. When using a starting material powder in which total added amount of the above mentioned oxides is less than 0.0005 weight %, rust forms on the surface of the sintered magnet, and after the anti-corrosion test, decline of magnetic properties is remarkable.

Examples 95–134 and Comparative Examples 39–55

First of all, a melt composed of 13.5% Nd, 1.5% Dy, 8% B, and the remainder Fe (here % stands for atomic %) was cast into an alloy ingot.

This alloy ingot was pulverized, yielding a fine powder having an average particle diameter of 3.5 μm. Starting material powders were then prepared by mixing the powder thus obtained with 1.2 μm average particle diameter $Ga_2O_3$ powder, $Al_2O_3$ powder, $Cr_2O_3$ powder, and $V_2O_5$ powder in the proportions indicated in Table 10 for Examples 95–134 and Comparative Examples 39–55. The thus obtained starting material powders were then molded in room air at a molding pressure of 1.5 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1100° C. and maintained under those conditions for 1 hr. to effect sintering, after which they were cooled at a cooling rate of 50° C./min.

Thereafter, the sintered compacts were heated in an argon atmosphere at a rate of 10° C./min to a temperature of 620° C. and maintained under those conditions for 2 hr., after which they were cooled at a rate of 100° C./min to thus effect heat treatment.

The magnetic properties of the obtained heat treated sintered compacts were measured, and those results are shown in Table 10 under "Magnetic Properties Prior to Anti-Corrosion Test".

After the above mentioned magnetic properties were measured, the anti-corrosion test was carried out by leaving the compacts in a room air atmosphere at a temperature of 60° C. and humidity of 90% for 650 hr.. After carrying out the above described anti-corrosion test, the magnetic properties were again measured and those results are shown in Table 10 under "Magnetic Properties After Anti-Corrosion Test", and examination for the formation of rust was performed, these results are also shown in Table 10.

From the results in Table 10 concerning the above described alloy powders, it can be understood that for sintered magnets manufactured by molding R-B-Fe alloy powders and sintering, rust forms on the surface after the anti-corrosion test, and that rust diffuses within causing marked corrosion, and that after the anti-corrosion test, the deterioration of magnetic properties is remarkable. However, when a sintered magnet is manufactured using as a starting material powder one to which $Ga_2O_3$ powder is added in an amount of 0.0005–3.0 weight %, or one to which $Ga_2O_3$ powder is added plus at least one kind of oxide powder chosen from the group including Al, Cr, and V, the total amount being 0.0005–3.0 weight %, a sintered magnet having superior anti-corrosion properties can be manufactured. And further, it can be understood that with such a magnet, that the deterioration of magnetic properties after the anti-corrosion test can be restrained.

With sintered magnets manufactured from an R-B-Fe alloy powder in which the total added amount of the above mentioned oxides exceeds 3.0 weight %, rust formation on the surface cannot be seen, however, the magnetic properties of the magnet itself decline. When using a starting material powder in which total added amount of the above mentioned oxides is less than 0.0005 weight %, rust forms on the surface of the sintered magnet, and after the anti-corrosion test, decline of magnetic properties is remarkable.

Examples 135–179 and Comparative Examples 56–73

First of all, a melt composed of 15% Nd, 8% B, and the remainder Fe (here % stands for atomic %) was cast into an alloy ingot. This alloy ingot was pulverized, yielding a fine powder having an average particle diameter of 3.5 μm.

Then, as hydride powders,

| | |
|---|---|
| $ZnH_2$ powder: | 1.3 mum average particle diameter, |
| $TaH_2$ powder: | 1.5 mum average particle diameter, |
| $TiH_2$ powder: | 1.3 mum average particle diameter, |
| $NbH_2$ powder: | 1.3 mum average particle diameter, |
| VH powder: | 1.5 mum average particle diameter, |
| $HfH_2$ powder: | 1.3 mum average particle diameter, |
| $YH_3$ powder: | 1.1 mum average particle diameter, |

were prepared, from which starting material powders were prepared by mixing the powder thus obtained in the proportions indicated in Table 11.

The thus obtained starting material powders were then molded in an argon gas atmosphere at a molding pressure of 1.5 t/cm$^2$ in a magnetic field of 12 KOe to form 12 mm L×10 mm W×10 mm H compacts.

The compacts thus obtained were then heated in an argon atmosphere at 1 atm. at a heating rate of 10° C./min to 1090° C. and maintained under those conditions for 1 hr., after which they were cooled at a cooling rate of 100° C./min to effect sintering. Thereafter, the sintered compacts were heated in the same atmosphere as the above heat treating atmosphere at a rate of 5° C./min to a temperature of 620° C. and maintained under those conditions for 2 hr., after which they were cooled at a rate of 50° C./min to effect heat treatment, thus manufacturing as shown in table 11, the sintered rare earth boron-iron alloy magnets 135–179 of the present invention and the comparative example sintered rare earth boron-iron alloy magnets 56–73.

The magnetic properties of the above prepared sintered rare earth metal-boron-iron alloy magnets 135–170 of the present invention and the comparative example sintered rare earth metal-boron-iron alloy magnets 56–73 were measured (residual magnetic flux: Br, coercivity: iHc, as well as maximum energy product: $BH_{max}$), after which the anti-corrosion test was carried out for the respective sintered magnets by leaving the compacts in a room air atmosphere at a temperature of 60° C. and humidity of 90% for 1000 hr.. After carrying out the above described anti-corrosion test, the magnetic properties of the sintered rare earth boron-iron alloy magnets 135–170 of the present invention and the comparative example sintered rare earth boron-iron alloy magnets 56–73 were measured (residual magnetic flux: Br, coercivity: iHc, as well as maximum energy product: $BH_{max}$), and the surface and interior of the sintered magnets was examined for the presence of rust. The respective results are shown in Table 11.

From the results in Table 11, it can be understood that for the comparative example sintered rare earth boron-iron alloy magnet 56 molded from R-B-Fe alloy powder alone, rust forms on the surface after the anti-corrosion test, and that the rust diffuses within causing marked corrosion, and that after the anti-corrosion test, the deterioration of magnetic properties is remarkable. However, when the sintered rare earth boron-iron alloy magnets of the present invention are manufactured using as a starting material powder one to which one or two or more kinds of hydride powders chosen from the group including Zr, Ta, Ti, Nb, V, Hf, as well as Y, the total amount being 0.0005–3 weight % are added, a sintered magnet having superior anti-corrosion properties can be manufactured. And further, it can be understood that with such a magnet, that there is no appearance of the deterioration of magnetic properties after the anti-corrosion test.

With the comparative example sintered rare earth boron-iron alloy magnets 58, 60, 62, 64, 66, 68, 70, 72, and 73 manufactured from an R-B-Fe alloy powder in which the total added amount of the above mentioned hydrides exceeds 3 weight %, rust formation on the surface cannot be seen, however, the magnetic properties decline. With the comparative example sintered rare earth boron-iron alloy magnets 57, 59, 61, 63, 65, 67, 69, and 71 manufactured from an R-B-Fe alloy powder in which the total added amount of the above mentioned hydrides is less than 0.0005 weight %, in all cases, rust forms on the surface of the sintered magnet, and after the anti-corrosion test, decline of magnetic properties is remarkable.

Examples 180–215 and Comparative Examples 74–89

First of all, a melt composed of 13.5% Nd, 1.5% Dy, 8% B, and the remainder Fe (here % stands for atomic %) was cast into an alloy ingot.

This alloy ingot was pulverized, yielding a fine powder having an average particle diameter of 3.5 μm.

Then, as oxide powders, $Y_2O_3$ powder: 1.2 mum average particle diameter, $Ho_2O_3$ powder: 1.1 mum average particle diameter, $Er_2O_3$ powder: 1.2 mum average particle diameter, $Tm_2O_3$ powder: 1.2 mum average particle diameter, $Lu_2O_3$ powder: 1.1 mum average particle diameter, $Eu_2O_3$ powder: 1.0 mum average particle diameter, were prepared. From the respective powders, starting material powders were prepared by mixing in the proportions indicated in Table 12 for Examples 180–215 and Comparative Examples 74–89. The thus obtained starting material powders were then molded in an argon gas atmosphere at a molding pressure of 1.5 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1100° C. and maintained under those conditions for 1 hr. to effect sintering, after which they were cooled at a cooling rate of 50° C./min.

Thereafter, the sintered compacts were heated in an argon gas atmosphere at a rate of 10° C./min to a temperature of 620° C. and maintained under those conditions for 2 hr., after which they were cooled at a rate of 10° C./min to effect heat treatment.

The magnetic properties of the above prepared sintered heat treated compacts were measured and are shown in Table 12 under "Prior to Anti-Corrosion Test".

After measuring the above magnetic properties, the anti-corrosion test was carried out for the respective sintered magnets by leaving the compacts in a room air atmosphere at a temperature of 80° C. and humidity of 90% for 1000 hr., after which the magnetic properties were again measured and are shown in Table 12 under "After Anti-Corrosion Test".

From the results in Table 12, it can be understood that for the comparative example sintered rare earth boron-iron alloy magnet 74 molded from R-B-Fe alloy powder alone, rust can be seen on the surface after the anti-corrosion test, and that the rust diffuses within, and that after the anti-corrosion test, the deterioration of magnetic properties is remarkable. However, when the sintered rare earth boron-iron alloy magnets 180–215 of the present invention are manufactured using as a starting material powder one to which one or two or more kinds of oxide powders chosen from the group including Y, Ho, Er, Tm, Lu, as well as Eu, the total amount being 0.0005–3.0 weight % are added, a sintered magnet having superior anti-corrosion properties can be manufactured. And further, it can be understood that with such a magnet, that rust cannot be seen and there is no appearance of the decline of magnetic properties after the anti-corrosion test.

With the comparative example sintered rare earth boron-iron alloy magnets 76, 78, 80, 82, 84, 86, 88, and 89 manufactured from an R-B-Fe alloy powder in which the total added amount of the above mentioned oxides exceeds 3.0 weight %, rust formation is absent and anti-corrosion properties are superior, however, the magnetic properties are exceedingly low. With the comparative example sintered rare earth metal-boron-iron alloy magnets 75, 77, 79, 81, 83, 85, and 87 manufactured from an R-B-Fe alloy powder in which the total added amount of the above mentioned oxides is less than 0.0005 weight %, in all cases, rust forms on the surface of the sintered magnet, and after the anti-corrosion test, decline of magnetic properties is remarkable.

Examples 216–300 and Comparative Examples 90–119 x xA melt composed of 15% Nd, 8% B, and the remainder Fe (here % stands for atomic %) was cast into an alloy ingot. This alloy ingot was pulverized, yielding a fine powder having an average particle diameter of 3.5 μm.

As additive powders, 1.2 μm average particle diameter $Cr_2O_3$ powder, as well as 1.5 μm average particle diameter CrN powder, $MnN_4$ powder, ZrN powder, HfN powder, TiN powder, NbN powder, $Ni_2N$ powder, $Si_3N_4$ powder, GeN powder, VN powder, GaN powder, AlN powder, and $Co_3N$ powder were prepared The above powders were blended according to the proportions indicated in Table 13, then molded in room air atmosphere at a molding pressure of 2 t/cm$^2$ in a magnetic field of 14 KOe to form 12 mm L×10 mm W×10 mm H compacts. The compacts thus obtained were then heated in a vacuum ($10^{-5}$ torr) at a heating rate of 5° C./min to 1100° C. and maintained under those conditions for 1 hr. to effect sintering, after which they were cooled at a cooling rate of 50° C./min.

Thereafter, the sintered compacts were heated in an argon gas atmosphere at a rate of 10° C./min to a temperature of 620° C. and maintained under those conditions for 2 hr., after which they were cooled at a rate of 100° C./min to thus effect heat treatment.

The magnetic properties of the obtained heat treated sintered compacts were measured, after which the anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed, these results are shown in Table 13.

From the results in Table 13, it can be understood that it is necessary to add 1 or 2 or more nitride powders chosen from the group including Cr, Mn, Zr, Hf, Ti, Nb, Ni, Si, Ge, V, Ga, Al, and Co in an amount of 0.0005–3.0 weight % together with $Cr_2O_3$ powder in an amount of 0.0005–3.0 weight % to a 15% Nd, 8% B, and the remainder Fe (here % stands for atomic %) powder in order to attain superior anti-corrosion and magnet properties.

That is to say, it can be understood that when the above mentioned nitride powders are added alone in the range of 0.0005–3.0 weight %, sufficient anti-corrosion properties are not obtained, and when $Cr_2O_3$ powder is added alone in the range of 0.0005–3.0 weight %, sufficient magnetic properties are not obtained.

Examples 301–381 and Comparative Examples 120–150

An alloy ingot prepared from a melt composed of 13.5% Nd, 1.5% Dy, 8% B, and the remainder Fe (here % stands for atomic %) was pulverized, yielding a rare earth boron-iron alloy powder having an average particle diameter of 3.0 μm.

As additive powders, 1.0 μm average particle diameter NiO powder, as well as 1.5 μm average particle diameter CrN powder, $MnN_4$ powder, ZrN powder, HfN powder, TiN powder, NbN powder, $Ni_2N$ powder, $Si_3N_4$ powder, GeN powder, VN powder, GaN powder, AlN powder, and $Co_3N$ powder were prepared.

The above powders were blended according to the proportions indicated in Table 14, then molded in room air at a molding pressure of 10 t/cm$^2$ in a magnetic field of 20 KOe to form 20 mm L×20 mm W×15 mm H compacts.

The compacts thus obtained were then heated in an argon atmosphere of reduced pressure at 250 Torr, at a heating rate of 20° C./min to 900° C. and maintained under those conditions for 20 hr. to effect sintering, after which they were cooled at a cooling rate of 500° C./min Thereafter, the sintered compacts were heated in an argon atmosphere at a rate of 1000° C./min to a temperature of 500° C. and maintained under those conditions for 7 hr., after which they were cooled at a rate of 500° C./min to thus effect heat treatment.

The magnetic properties of the obtained heat treated sintered compacts were measured, after which the anti-corrosion test was carried out by leaving the compacts in a room air atmosphere at a temperature of 60° C. and humidity of 90% for 650 hr.. After carrying out the above described anti-corrosion test, the magnetic properties were again measured and examination for the formation of rust was performed. These results are shown in Table 14.

From the results in Table 14, it can be understood that it is necessary to add 1 or 2 or more nitride powders chosen from the group including Cr, Mn, Zr, Hf, Ti, Nb, Ni, Si, Ge, V, Ga, Al, and Co in an amount of 0.0005-3.0 weight % together with NiO powder in an amount of 0.0005-3.0 weight % to a 13.5% Nd, 1.5% Dy, 8% B, and the remainder Fe (here % stands for atomic %) powder in order to attain superior anti-corrosion and magnet properties, and furthermore, decline in magnetic properties due to corrosion is prevented.

Examples 382-394 and Comparative Example 151-156

The following powders were prepared,

| | |
|---|---|
| $Cr_2O_3$ powder: | 1.2 mum average particle diameter, |
| NiO powder: | 1.0 mum average particle diameter, |
| CrN powder: | 1.5 mum average particle diameter, |
| $MnN_4$ powder: | 1.8 mum average particle diameter, |
| ZrN powder: | 1.2 mum average particle diameter, |
| HfN powder: | 1.5 mum average particle diameter, |
| TiN powder: | 1.3 mum average particle diameter, |
| NbN powder: | 1.3 mum average particle diameter, |
| $Ni_2N$ powder: | 1.5 mum average particle diameter, |
| $Si_3N_4$ powder: | 1.5 mum average particle diameter, |
| GeN powder: | 1.5 mum average particle diameter, |
| VN powder: | 1.4 mum average particle diameter, |
| GaN powder: | 1.1 mum average particle diameter, |
| AlN powder: | 1.5 mum average particle diameter, |
| $Co_3N$ powder: | 1.5 mum average particle diameter, |

and according to the proportions shown in Table 15, the two above oxides and two or more of the above nitrides were mixed with an 3.0 μm average diameter 13.5% Nd, 1.5% Dy, 8% B, and the remainder Fe (here % stands for atomic %) alloy powder, and the resulting mixed powders were press molded at a molding pressure of 1.5 t/cm$^2$ in a magnetic field of 14 KOe to form 12 mm L×10 mm W×10 mm H compacts. The compacts thus obtained were then heated in an argon atmosphere of reduced pressure at 250 Torr, at a heating rate of 10° C./min to 1080° C. and maintained under those conditions for 2 hr. to effect sintering, after which they were cooled at a cooling rate of 100° C./min.

Thereafter, the sintered compacts were heated in an argon gas atmosphere at a rate of 20° C./min to a temperature of 620° C. and maintained under those conditions for 1.5 hr., after which they were cooled at a rate of 100° C./min to thus effect heat treatment. The magnetic properties of the obtained heat treated, oxide containing, sintered compacts were measured, after which the anti-corrosion test was carried out by leaving the compacts in a room air atmosphere at a temperature of 60° C. and humidity of 90% for 650 hr.. After carrying out the above described anti-corrosion test, the magnetic properties were again measured and examination of their surfaces for the formation of rust was performed. These results are shown in Table 16.

From the results in Table 16, it can be understood that for sintered magnets obtained by preparing a mixture of an amount of $Cr_2O_3$ and NiO totaling within the range of 0.0005 and 3.0 weight %, and an amount of two or more of the above nitride powders totaling within the range of 0.0005 and 3.0 weight %, and further adding this oxide and nitride mixture to a rare earth boron-iron alloy powder, that superior anti-corrosion and magnetic properties are obtained, and further, because there is no loss of magnetic properties after the anti-corrosion test, decline in magnetic properties due to corrosion is prevented.

From the results of the above mentioned Tables 13-16, as with Comparative Example 150, with sintered magnets obtained from rare earth boron-iron alloy powder, rust forms on the surface after the anti-corrosion test, and this corrosion penetrates within leading to extensive corrosion. However, with sintered magnets obtained from a starting material powder including a total of one or two Cr and Ni oxides ranging from 0.0005 and 3.0 weight %, and a total of one or two or more additives chosen from Cr, Mn, Zr, Hf, Ti, Nb, Ni, Si, Ge, V, Ga, Al, as well as Co ranging from 0.0005 and 3.0 weight %, sintered magnets having superior anti-corrosion and magnetic properties can be formed, and further, that decline in magnetic properties due to corrosion can be prevented, and the superior effect of producing sintered rare earth metal-boron-iron alloy magnets that require no surface treatment can be achieved with the manufacturing method of the present invention.

Examples 395-411 and Comparative Example 157

First of all, a melt composed of 15% Nd, 8% B, and the remainder Fe (here % stands for atomic %) was cast into an alloy ingot. Thereafter, the ingot was heated in an argon atmosphere at 1050° C. for 20 hr. to effect heat treatment, then pulverized to yield 3.5 μm average particle diameter rare earth metal-boron-iron alloy powder.

Then as additive powders, NiO (average particle diameter: 1.0 μm), $Co_2O_3$ (average particle diameter: 1.2 μm), $MnO_2$ (average particle diameter: 1.0 μm), $Cr_2O_3$ (average particle diameter: 1.2 μm), $TiO_2$ (average particle diameter: 1.5 μm), $V_2O_5$ (average particle diameter: 1.4 μm), $Al_2O_3$ (average particle diameter: 1.2 μm), $Ga_2O_3$ (average particle diameter: 1.2 μm), $In_2O_3$ (average particle diameter: 1.4 μm), $ZrO_2$ (average particle diameter: 1.2 μm), $HfO_2$ (average particle diameter: 1.2 μm), $Nb_2O_3$ (average particle diameter: 1.3

μm), $Dy_2O_3$ (average particle diameter: 1.2 μm), and $Y_2O_3$ (average particle diameter 1.0 μm) were prepared.

The above mentioned rare earth metal-boron-iron alloy powder and one or two or more of the above mentioned oxide additive powders in an amount within the range of 0.0005–2.5 weight % were combined and blended. This blended powder was then molded at a molding pressure of 2 t/cm$^2$ in a magnetic field of 14 KOe to form 20 mm L×20 mm W×15 mm H compacts. The compacts thus obtained were then heated in a vacuum ($10^{-5}$ torr) at a heating rate of 10° C./min to 1080° C. and maintained under those conditions for 2 hr. to effect sintering, after which they were cooled at a cooling rate of 100° C./min.

Thereafter, the sintered compacts were heated at a rate of 100° C./min to a temperature of 620° C. and maintained under those conditions for 2 hr., after which they were cooled at a rate of 100° C./min to thus effect heat treatment.

The structure of these sintered heat treated compacts was investigated, and it was found that it was formed from $R_2Fe_{14}B$ phase as well as inter-granular boundary phase, having a structure generally the same as that of FIG. 1. The results of STEM measurement are shown in Table 17. Further, the magnetic properties of the above mentioned sintered heat treated compacts were measured, and then a anti-corrosion test was carried out by keeping the compacts at 60° C. and 90% humidity for 1000 hours after which the magnetic properties were again measured, while at the same time, examination for the presence of rust was carried out. These results are shown in Table 17.

Examples 412–422

As additive powders, $ZrH_2$ powder (average particle diameter: 1.3 μm), $TaH_2$ powder (average particle diameter: 1.5 μm), $TiH_2$ powder (average particle diameter: 1.3 μm), $NbH_2$ powder (average particle diameter: 1.3 μm), VH powder (average particle diameter: 1.5 μm), $HfH_2$ powder (average particle diameter: 1.3 μm), as well as $YH_3$ powder (average particle diameter: 1.1 μm) were prepared. These powders were combined in fixed proportions in an amount within the range of 0.0005–3.0 weight % with the above mentioned 15% Nd, 8% B, and the remainder Fe (here % stands for atomic %) rare earth metal-boron-iron alloy powder prepared in Examples 395–411, then blended, after which these blended powders were processed in a manner entirely identical to that of the above mentioned Examples 395–411, and in the same way, the metal elements making up the inter-granular boundary phase were measured using STEM. After the magnetic properties were measured, the anti-corrosion test was carried out. After carrying out the above described anti-corrosion test, the magnetic properties were again measured and examination for the formation of rust was performed, and these results are shown in Table 18.

From the results in Tables 17 and 18, it can be understood that compared with the prior art examples in which metal elements and oxygen are not incorporated in the inter-granular boundary phase, the sintered rare earth metal-boron-iron alloy magnets of the present invention in which metal elements, or both metal elements and oxygen are incorporated in the inter-granular boundary phase are superior in respect to both magnetic properties and anti-corrosion properties.

TABLE 1

| Sample | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 1 | 0.0006 | rust absent | 12.4 | 12.7 | 37.0 | 12.2 | 12.0 | 35.0 |
| Example 2 | 0.5 | rust absent | 12.3 | 12.5 | 35.8 | 12.2 | 12.0 | 35.0 |
| Example 3 | 1.1 | rust absent | 12.3 | 12.4 | 35.5 | 12.2 | 12.2 | 35.0 |
| Example 4 | 1.5 | rust absent | 12.2 | 12.4 | 35.0 | 12.2 | 12.2 | 34.3 |
| Example 5 | 2.2 | rust absent | 12.1 | 12.5 | 34.0 | 12.1 | 12.4 | 34.0 |
| Comparative Example 1 | none added | rust heavy | 12.4 | 12.5 | 37.0 | 12.0 | 5.0 | 22.5 |
| Comparative Example 2 | 0.0001 | rust present | 12.4 | 12.5 | 37.0 | 12.1 | 5.6 | 22.7 |
| Comparative Example 3 | 3.1 | rust absent | 11.2 | 5.0 | 19.2 | 12.1 | 5.0 | 19.0 |

TABLE 2

| Sample | $TiO_2$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 6 | 0.0005 | rust absent | 11.8 | 20 | 34.0 | 11.7 | 16.1 | 32.0 |
| Example 7 | 0.1 | rust absent | 11.8 | 20 | 33 | 11.7 | 17.5 | 31.6 |
| Example 8 | 0.5 | rust absent | 11.8 | 19.0 | 32.8 | 11.7 | 17.5 | 31.8 |
| Example 9 | 1.5 | rust absent | 11.7 | 18.5 | 32.0 | 11.7 | 18.0 | 31.5 |

TABLE 2-continued

| Sample | $TiO_2$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 10 | 2.5 | rust absent | 11.6 | 18.0 | 31.5 | 11.6 | 18.0 | 31.5 |
| Comparative Example 4 | none added | rust heavy | 12.0 | 20 | 34.8 | 10.5 | 8.1 | 22.1 |
| Comparative Example 5 | 0.0002 | rust present | 11.8 | 20 | 34.0 | 10.6 | 10.5 | 23.0 |
| Comparative Example 6 | 3.1 | rust absent | 10.2 | 12.1 | 22.6 | 10.2 | 12.0 | 22.2 |

TABLE 3

| Sample | $MnO_2$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 11 | 0.0007 | rust absent | 11.8 | 19.6 | 33.6 | 11.7 | 18.2 | 33.0 |
| Example 12 | 0.2 | rust absent | 11.7 | 18.7 | 33.0 | 11.7 | 18.0 | 32.8 |
| Example 13 | 0.7 | rust absent | 11.7 | 17.5 | 32.5 | 11.7 | 17.0 | 32.5 |
| Example 14 | 1.4 | rust absent | 11.5 | 17.3 | 32.0 | 11.5 | 17.0 | 32.0 |
| Example 15 | 2.0 | rust absent | 11.5 | 17.0 | 31.7 | 11.5 | 17.0 | 31.7 |
| Example 16 | 2.5 | rust absent | 11.5 | 16.5 | 31.1 | 11.5 | 16.5 | 31.1 |
| Comparative Example 7 | 0.0003 | rust present | 11.8 | 19.5 | 33.6 | 10.7 | 10.4 | 23.5 |
| Comparative Example 8 | 3.1 | rust absent | 10.6 | 12.1 | 23.5 | 10.6 | 12.0 | 23.5 |

TABLE 4

| Sample | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 17 | 0.0006 | rust absent | 11.8 | 20 | 34.0 | 11.7 | 18.6 | 33.5 |
| Example 18 | 0.001 | rust absent | 11.8 | 19.5 | 34.0 | 11.7 | 19.0 | 33.8 |
| Example 19 | 0.01 | rust absent | 11.8 | 19.1 | 34.0 | 11.8 | 18.5 | 33.2 |
| Example 20 | 0.4 | rust absent | 11.8 | 18.5 | 33.2 | 11.8 | 17.8 | 32.5 |
| Example 21 | 1.1 | rust absent | 11.7 | 18.0 | 32.5 | 11.7 | 17.7 | 32.5 |
| Example 22 | 2.3 | rust absent | 11.6 | 17.5 | 32.1 | 11.6 | 17.5 | 32.1 |
| Comparative Example 9 | 0.0001 | rust present | 11.8 | 20 | 34.0 | 10.7 | 11.4 | 22.0 |
| Comparative Example 10 | 3.1 | rust absent | 10.2 | 10.5 | 18.1 | 10.2 | 10.4 | 18.0 |

TABLE 5

| Sample | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|
| Example 23 | 0.0006 | rust absent | 11.8 | 19.5 | 34.0 | 11.7 | 19.4 | 32.8 |
| Example 24 | 0.001 | rust absent | 11.8 | 19.0 | 34.0 | 11.7 | 18.5 | 32.7 |
| Example 25 | 0.1 | rust absent | 11.7 | 18.7 | 33.0 | 11.7 | 18.0 | 32.5 |
| Example 26 | 1.0 | rust | 11.7 | 18.0 | 32.8 | 11.7 | 17.1 | 32.5 |

TABLE 5-continued

| Sample | | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|---|
| | | | absent | | | | | | |
| Example | 27 | 1.5 | rust absent | 11.7 | 18.0 | 32.5 | 11.7 | 17.0 | 32.5 |
| Example | 28 | 2.3 | rust absent | 11.7 | 17.8 | 32.5 | 11.7 | 17.0 | 32.5 |
| Comparative Example | 11 | 0.0002 | rust present | 11.9 | 20 | 34.1 | 10.5 | 10.2 | 22.1 |
| Comparative Example | 12 | 3.1 | rust absent | 10.2 | 12.0 | 23.0 | 10.1 | 11.8 | 22.8 |

TABLE 6

| Sample | | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|---|
| Example | 30 | 0.0007 | rust absent | 12.4 | 12.4 | 35.9 | 12.2 | 11.9 | 35.5 |
| Example | 31 | 0.01 | rust absent | 12.3 | 12.5 | 35.8 | 12.1 | 11.8 | 35.1 |
| Example | 32 | 0.5 | rust absent | 12.3 | 12.3 | 35.0 | 12.3 | 12.1 | 35.0 |
| Example | 33 | 1.0 | rust absent | 12.2 | 12.2 | 34.5 | 12.2 | 12.2 | 34.4 |
| Example | 34 | 1.7 | rust absent | 12.2 | 12.3 | 34.5 | 12.2 | 12.2 | 34.5 |
| Example | 35 | 2.4 | rust absent | 12.1 | 12.0 | 34.0 | 12.1 | 12.0 | 34.0 |
| Comparative Example | 13 | 0.0002 | rust present | 12.4 | 12.5 | 37.0 | 12.0 | 5.1 | 22.5 |
| Comparative Example | 14 | 3.1 | rust absent | 11.2 | 5.1 | 19.2 | 11.0 | 5.0 | 18.6 |

TABLE 7

| Sample | | $Cr_2O_3$ Added Amount (Weight %) | Observed Rust Condition | Magnetic Properties Prior to the Anti-Corrosion Test Br (Kg) | iHc (KOe) | $BH_{max}$ (MGOe) | Magnetic Properties After the Anti-Corrosion Test Br (Kg) | iHc (KOe) | $BH_{max}$ (MGOe) |
|---|---|---|---|---|---|---|---|---|---|
| Example | 36 | 0.0005 | rust absent | 12.4 | 12.6 | 37.0 | 12.2 | 12.2 | 35.5 |
| Example | 37 | 0.01 | rust absent | 12.3 | 12.5 | 35.7 | 12.2 | 12.3 | 35.5 |
| Example | 38 | 0.5 | rust absent | 12.2 | 12.5 | 35.1 | 12.2 | 12.4 | 35.1 |
| Example | 39 | 1.2 | rust absent | 12.1 | 12.3 | 35.0 | 12.1 | 12.2 | 35.0 |
| Example | 40 | 1.8 | rust absent | 12.1 | 12.3 | 35.0 | 12.1 | 12.3 | 35.0 |
| Example | 41 | 2.4 | rust absent | 12.0 | 12.0 | 34.0 | 12.0 | 12.0 | 34.0 |
| Comparative Example | 15 | 0.0001 | rust present | 12.4 | 12.6 | 37.0 | 12.0 | 5.1 | 20.1 |
| Comparative Example | 16 | 3.1 | rust absent | 11.0 | 4.5 | 19.0 | 11.0 | 4.5 | 19.0 |

TABLE 8

| Sample | Amount of Oxide Powder Added to R—B—Fe Alloy Powder (Weight %) $Cr_2O_3$ | NiO | $CO_2O_3$ | $MnO_2$ | $TiO_2$ | $V_2O_5$ | $Nb_2O_3$ | Total | Rust State | Prior to the Corrosion Test Br KG | iHc KOe | $BH_{max}$ MGOe | After the Corrosion Test Br KG | iHc KOe | $BH_{max}$ MGOe |
|---|---|---|---|---|---|---|---|---|---|---|---|---|---|---|---|
| EXAMPLES | | | | | | | | | | | | | | | |
| 42 | 0.2 | — | 0.5 | — | — | — | — | 0.7 | absent | 11.7 | 18.5 | 32.5 | 11.6 | 18.0 | 32.1 |
| 43 | 0.5 | — | — | 0.3 | — | 0.1 | — | 0.9 | absent | 11.8 | 18.4 | 32.7 | 11.7 | 18.0 | 32.5 |
| 44 | — | 0.5 | — | — | 0.5 | — | 0.5 | 1.5 | absent | 11.7 | 17.8 | 32.2 | 11.7 | 17.0 | 31.8 |
| 45 | 0.8 | — | — | 1.0 | — | 0.2 | — | 2.0 | absent | 11.7 | 17.6 | 32.0 | 11.7 | 17.5 | 32.0 |
| 46 | 1.0 | 0.1 | 0.1 | 0.1 | 0.1 | 0.1 | 0.1 | 1.6 | absent | 11.7 | 17.8 | 32.0 | 11.7 | 17.8 | 31.8 |
| 47 | 1.5 | 0.3 | — | — | 0.3 | — | — | 2.1 | absent | 11.7 | 17.6 | 32.0 | 11.7 | 17.5 | 32.0 |

TABLE 8-continued

| Sample | Amount of Oxide Powder Added to R—B—Fe Alloy Powder (Weight %) | | | | | | | | Rust | Prior to the Corrosion Test | | | After the Corrosion Test | | |
|---|---|---|---|---|---|---|---|---|---|---|---|---|---|---|---|
| | $Cr_2O_3$ | NiO | $CO_2O_3$ | $MnO_2$ | $TiO_2$ | $V_2O_5$ | $Nb_2O_3$ | Total | State | Br KG | iHc KOe | $BH_{max}$ MGOe | Br KG | iHc KOe | $BH_{max}$ MGOe |
| 48 | 0.1 | 0.3 | 0.3 | 0.2 | 0.5 | — | — | 1.4 | absent | 11.7 | 18.1 | 32.2 | 11.7 | 17.7 | 31.8 |
| 49 | 1.7 | 0.01 | 0.01 | — | — | 0.02 | 0.02 | 1.76 | absent | 11.7 | 18.1 | 32.1 | 11.7 | 17.7 | 32.0 |
| 50 | 0.0001 | 0.0001 | 0.0001 | 0.0001 | 0.0001 | 0.0001 | 0.0001 | 0.0007 | absent | 11.8 | 19.5 | 34.0 | 11.7 | 16.5 | 32.1 |
| 51 | 2.3 | — | — | 0.05 | 0.05 | — | — | 2.4 | absent | 11.7 | 17.6 | 32.0 | 11.7 | 17.4 | 33.6 |
| 52 | — | — | — | — | 0.7 | — | 0.7 | 1.4 | absent | 11.8 | 18.1 | 33.8 | 11.8 | 17.8 | 32.0 |
| 53 | — | — | — | — | 0.1 | 0.9 | 1.0 | 2.0 | absent | 11.7 | 17.7 | 32.0 | 11.7 | 17.7 | 33.5 |
| 54 | — | 0.2 | — | 0.8 | 0.1 | 0.3 | — | 1.4 | absent | 11.8 | 17.8 | 33.7 | 11.8 | 17.6 | 23.1 |
| COMPARATIVE EXAMPLES | | | | | | | | | | | | | | | |
| 17 | 0.0001 | 0.0001 | — | — | — | — | — | 0.0002* | present | 11.8 | 20.0 | 34.0 | 11.0 | 9.0 | 22.0 |
| 18 | 1.5 | — | 1.6 | — | — | — | — | 3.1* | absent | 10.1 | 11.1 | 22.1 | 10.1 | 11.0 | 23.2 |
| 19 | 2.0 | 0.009 | 0.1 | 0.1 | 0.8 | 0.09 | 0.001 | 3.1* | absent | 10.5 | 12.0 | 23.2 | 10.5 | 12.0 | 23.2 |
| 20 | 0.2 | 0.5 | 1.0 | 0.8 | 0.7 | — | — | 3.2* | absent | 10.6 | 11.0 | 23.5 | 10.6 | 10.9 | 23.3 |
| 21 | 0.0001 | — | 0.0001 | — | 0.0001 | — | 0.0001 | 0.0004* | present | 11.8 | 19.8 | 33.8 | 11.0 | 9.2 | 23.2 |

*indicates values outside of the conditions of the present invention

TABLE 9-1

| Sample | Starting Material Powder Composition (Weight %) Oxides Added to R—B—Fe Alloy Powder | | | | | R—B—Fe Alloy Powder | Rust State | Prior to the Corrosion Test | | | After the Corrosion Test | | |
|---|---|---|---|---|---|---|---|---|---|---|---|---|---|
| | $Al_2O_3$ | $ZrO_2$ | $Cr_2O_3$ | $TiO_2$ | Total | | | Br KG | iHc KOe | $BH_{max}$ MGOe | Br KG | iHc KOe | $BH_{max}$ MGOe |
| EXAMPLES | | | | | | | | | | | | | |
| 55 | 0.0007 | — | — | — | 0.0007 | remainder | absent | 12.0 | 20.1 | 34.7 | 11.8 | 18.0 | 33.6 |
| 56 | 0.06 | — | — | — | 0.06 | remainder | absent | 11.9 | 20.3 | 34.1 | 11.9 | 19.2 | 34.0 |
| 57 | 0.6 | — | — | — | 0.6 | remainder | absent | 11.9 | 21.0 | 34.2 | 11.9 | 20.5 | 34.1 |
| 58 | 1.0 | — | — | — | 1.0 | remainder | absent | 11.8 | 21.5 | 34.0 | 11.8 | 21.0 | 33.8 |
| 59 | 2.2 | — | — | — | 2.2 | remainder | absent | 11.7 | 21.8 | 33.4 | 11.7 | 21.2 | 33.3 |
| 60 | 0.0002 | 0.04 | — | — | 0.0402 | remainder | absent | 12.0 | 20.1 | 34.9 | 11.9 | 20.0 | 34.0 |
| 61 | 0.04 | 2.0 | — | — | 2.04 | remainder | absent | 11.9 | 20.3 | 34.1 | 11.9 | 20.2 | 34.0 |
| 62 | 0.3 | 1.4 | — | — | 1.7 | remainder | absent | 11.9 | 21.3 | 34.2 | 11.9 | 21.3 | 34.2 |
| 63 | 1.1 | 0.05 | — | — | 1.15 | remainder | absent | 11.8 | 21.7 | 34.0 | 11.8 | 21.7 | 34.0 |
| 64 | 2.0 | 0.0003 | — | — | 2.0003 | remainder | absent | 11.7 | 21.9 | 33.4 | 11.7 | 21.9 | 33.4 |
| 65 | 0.0002 | — | 0.007 | — | 0.0072 | remainder | absent | 12.0 | 20.3 | 35.0 | 11.9 | 20.0 | 34.3 |
| 66 | 0.05 | — | 2.3 | — | 2.35 | remainder | absent | 11.9 | 20.8 | 34.4 | 11.9 | 20.8 | 34.4 |
| 67 | 0.5 | — | 1.2 | — | 1.7 | remainder | absent | 11.9 | 21.5 | 34.5 | 11.9 | 21.5 | 34.5 |
| 68 | 1.0 | — | 0.3 | — | 1.3 | remainder | absent | 11.8 | 22.0 | 34.0 | 11.8 | 21.8 | 33.8 |
| 69 | 2.3 | — | 0.0004 | — | 2.3004 | remainder | absent | 11.7 | 22.2 | 33.6 | 10.7 | 22.0 | 33.5 |
| 70 | 0.0002 | — | — | 0.05 | 0.0502 | remainder | absent | 11.9 | 20.1 | 34.3 | 10.9 | 19.5 | 34.0 |
| 71 | 0.06 | — | — | 2.1 | 2.16 | remainder | absent | 11.7 | 22.0 | 33.5 | 10.7 | 21.9 | 33.5 |

*the composition of the rare earth metal-boron-iron alloy powder is Nd-13.5%, Dy-1.5%, B-8%, Fe-remainder (here % is atomic %)

TABLE 9-2

| Sample | Starting Material Powder Composition (Weight %) Oxides Added to R—B—Fe Alloy Powder | | | | | R—B—Fe Alloy Powder | Rust State | Prior to the Corrosion Test | | | After the Corrosion Test | | |
|---|---|---|---|---|---|---|---|---|---|---|---|---|---|
| | $Al_2O_3$ | $ZrO_2$ | $Cr_2O_3$ | $TiO_2$ | Total | | | Br KG | iHc KOe | $BH_{max}$ MGOe | Br KG | iHc KOe | $BH_{max}$ MGOe |
| EXAMPLES | | | | | | | | | | | | | |
| 72 | 0.4 | — | — | 1.0 | 1.4 | remainder | absent | 11.8 | 22.1 | 34.0 | 11.8 | 22.0 | 33.9 |
| 73 | 1.0 | — | — | 0.2 | 1.2 | remainder | absent | 11.8 | 22.0 | 34.0 | 11.8 | 21.7 | 33.8 |
| 74 | 2.4 | — | — | 0.0005 | 2.4005 | remainder | absent | 11.7 | 22.6 | 33.5 | 11.7 | 22.5 | 33.5 |
| 75 | 0.4 | 0.1 | 0.2 | — | 0.7 | remainder | absent | 11.8 | 21.5 | 33.9 | 11.8 | 21.5 | 33.9 |
| 76 | 0.4 | 0.5 | 0.4 | — | 1.3 | remainder | absent | 11.8 | 22.1 | 34.1 | 11.8 | 22.1 | 34.1 |
| 77 | 1.0 | 0.3 | 0.5 | — | 1.8 | remainder | absent | 11.8 | 22.5 | 34.2 | 11.8 | 22.3 | 34.2 |
| 78 | 1.5 | 0.7 | 0.2 | — | 2.4 | remainder | absent | 11.7 | 22.5 | 33.3 | 11.7 | 22.3 | 33.3 |
| 79 | 0.2 | — | 0.05 | 0.1 | 0.35 | remainder | absent | 11.9 | 20.5 | 34.3 | 11.9 | 20.3 | 34.2 |
| 80 | 0.001 | — | 0.01 | 0.01 | 0.021 | remainder | absent | 11.9 | 19.7 | 34.1 | 11.9 | 19.4 | 33.9 |
| 81 | 0.3 | — | 0.6 | 0.5 | 1.4 | remainder | absent | 11.8 | 22.0 | 34.1 | 11.8 | 22.0 | 34.1 |
| 82 | 0.1 | — | 0.1 | 1.7 | 1.9 | remainder | absent | 11.8 | 22.5 | 34.3 | 11.8 | 22.5 | 34.3 |
| 83 | 0.2 | — | 1.6 | 0.5 | 2.3 | remainder | absent | 11.7 | 22.6 | 33.5 | 11.7 | 22.6 | 33.5 |
| 84 | 1.0 | 0.5 | — | 0.6 | 2.1 | remainder | absent | 11.7 | 22.1 | 33.2 | 11.7 | 22.1 | 33.1 |
| 85 | 0.3 | 0.2 | — | 0.1 | 0.6 | remainder | absent | 11.8 | 21.4 | 34.0 | 11.8 | 21.3 | 34.0 |
| 86 | 0.1 | 1.3 | — | 0.1 | 1.5 | remainder | absent | 11.8 | 22.0 | 34.2 | 11.8 | 22.0 | 34.2 |
| 87 | 0.001 | 0.01 | — | 0.1 | 0.111 | remainder | absent | 11.9 | 20.2 | 34.2 | 11.8 | 19.5 | 34.0 |
| 88 | 0.3 | 0.3 | — | 0.3 | 0.9 | remainder | absent | 11.8 | 21.8 | 34.0 | 11.8 | 21.7 | 33.9 |

*the composition of the rare earth metal-boron-iron alloy powder is Nd-13.5%, Dy-1.5%, B-8%, Fe-remainder (here % is atomic %)

TABLE 9-3

| | Starting Material Powder Composition (Weight %) | | | | | | | Prior to the Corrosion Test | | | After the Corrosion Test | | |
|---|---|---|---|---|---|---|---|---|---|---|---|---|---|
| | Oxides Added to R—B—Fe Alloy Powder | | | | | | Rust | Br | iHc | $BH_{max}$ | Br | iHc | $BH_{max}$ |
| Sample | $Al_2O_3$ | $ZrO_2$ | $Cr_2O_3$ | $TiO_2$ | Total | R—B—Fe Alloy Powder | State | KG | KOe | MGOe | KG | KOe | MGOe |
| EXAMPLES | | | | | | | | | | | | | |
| 89 | 0.0005 | 0.0001 | 0.0001 | 0.0001 | 0.0008 | remainder | absent | 11.9 | 20.2 | 34.0 | 11.8 | 19.7 | 33.6 |
| 90 | 0.01 | 0.01 | 0.01 | 0.01 | 0.04 | remainder | absent | 11.9 | 20.5 | 34.3 | 11.8 | 20.0 | 34.0 |
| 91 | 0.2 | 0.1 | 0.1 | 0.1 | 0.5 | remainder | absent | 11.8 | 20.8 | 33.7 | 11.8 | 20.6 | 33.6 |
| 92 | 0.4 | 0.2 | 0.1 | 0.4 | 1.1 | remainder | absent | 11.8 | 21.8 | 34.0 | 11.8 | 21.7 | 34.0 |
| 93 | 0.5 | 0.5 | 0.4 | 0.4 | 1.8 | remainder | absent | 11.8 | 22.0 | 34.1 | 11.8 | 22.0 | 34.1 |
| 94 | 0.6 | 0.6 | 0.6 | 0.5 | 2.3 | remainder | absent | 11.7 | 22.5 | 33.3 | 11.7 | 22.5 | 33.3 |
| COMPARATIVE EXAMPLES | | | | | | | | | | | | | |
| 22 | — | — | — | — | none# | remainder | heavy | 12.0 | 20.0 | 34.8 | 10.5 | 8.1 | 22.1 |
| 23 | 0.0002 | — | — | — | 0.0002# | remainder | present | 12.0 | 20.1 | 34.8 | 10.6 | 9.2 | 23.0 |
| 24 | 3.3# | — | — | — | 3.3# | remainder | absent | 10.3 | 12.0 | 22.3 | 10.3 | 12.0 | 22.3 |
| 25 | 0.0002 | 0.0001 | — | — | 0.0003# | remainder | present | 12.0 | 20.0 | 34.8 | 10.7 | 10.1 | 21.5 |
| 26 | 2.3 | 0.8 | — | — | 3.1# | remainder | absent | 10.2 | 11.5 | 22.1 | 10.2 | 11.5 | 22.1 |
| 27 | 0.0003 | — | 0.0001 | — | 0.0004# | remainder | present | 11.9 | 20.4 | 34.2 | 10.6 | 9.8 | 21.3 |
| 28 | 2.2 | — | 1.0 | — | 3.2# | remainder | absent | 10.3 | 12.1 | 23.2 | 10.3 | 12.1 | 23.1 |
| 29 | 0.0002 | — | — | 0.0002 | 0.0004# | remainder | present | 12.0 | 20.1 | 34.8 | 10.6 | 9.4 | 23.0 |
| 30 | 2.0 | — | — | 1.1 | 3.1# | remainder | absent | 10.4 | 12.3 | 22.5 | 10.4 | 12.3 | 22.5 |
| 31 | 0.0001 | 0.0001 | 0.0001 | — | 0.0003# | remainder | present | 12.0 | 20.2 | 34.8 | 10.7 | 10.0 | 21.4 |
| 32 | 2.0 | 0.3 | 0.8 | — | 3.1# | remainder | absent | 10.4 | 12.0 | 23.1 | 10.4 | 12.0 | 23.1 |

*the composition of the rare earth metal-boron-iron alloy powder is Nd-13.5%, Dy-1.5%, B-8%, Fe-remainder (here % is atomic %)
#indicates values outside of the conditions of the present invention

TABLE 9-4

| | Starting Material Powder Composition (Weight %) | | | | | | | Prior to the Corrosion Test | | | After the Corrosion Test | | |
|---|---|---|---|---|---|---|---|---|---|---|---|---|---|
| | Oxides Added to R—B—Fe Alloy Powder | | | | | | Rust | Br | iHc | $BH_{max}$ | Br | iHc | $BH_{max}$ |
| Sample | $Al_2O_3$ | $ZrO_2$ | $Cr_2O_3$ | $TiO_2$ | Total | R—B—Fe Alloy Powder | State | KG | KOe | MGOe | KG | KOe | MGOe |
| COMPARATIVE EXAMPLES | | | | | | | | | | | | | |
| 33 | 0.0001 | — | 0.0001 | 0.0001 | 0.0003# | remainder | present | 12.0 | 19.5 | 34.7 | 10.5 | 9.9 | 22.7 |
| 34 | 1.1 | — | 0.1 | 2.0 | 3.2# | remainder | absent | 10.2 | 10.8 | 22.0 | 10.2 | 10.8 | 22.0 |
| 35 | 0.0001 | 0.0001 | — | 0.0001 | 0.0003# | remainder | present | 11.9 | 19.6 | 34.4 | 10.5 | 10.1 | 22.8 |
| 36 | 2.0 | 0.6 | — | 0.5 | 3.7# | remainder | absent | 10.8 | 11.2 | 24.3 | 10.8 | 11.2 | 24.3 |
| 37 | 0.0001 | 0.0001 | 0.0001 | 0.0001 | 0.0004# | remainder | present | 11.9 | 20.1 | 33.9 | 10.4 | 8.3 | 19.3 |
| 38 | 1.0 | 0.6 | 0.6 | 0.7 | 3.2# | remainder | absent | 10.8 | 11.0 | 24.0 | 10.8 | 11.4 | 24.0 |

*the composition of the rare earth metal-boron-iron alloy powder is Nd-13.5%, Dy-1.5%, B-8%, Fe-remainder (here % is atomic %)
#indicates values outside of the conditions of the present invention

TABLE 10-1

| | Starting Material Powder Composition (Weight %) | | | | | | Prior to the Corrosion Test | | | After the Corrosion Test | | | |
|---|---|---|---|---|---|---|---|---|---|---|---|---|---|
| | Oxides Added to R—B—Fe Alloy Powder | | | | | | Br | iHc | $BH_{max}$ | Br | iHc | $BH_{max}$ | Rust |
| Sample | $Ga_2O_3$ | $Al_2O_3$ | $Cr_2O_3$ | $V_2O_5$ | Total | R—B—Fe Alloy Powder* | KG | KOe | MGOe | KG | KOe | MGOe | State |
| EXAMPLES | | | | | | | | | | | | | |
| 95 | 0.0007 | — | — | — | 0.0007 | remainder | 11.9 | 20.2 | 34.1 | 11.8 | 20.0 | 33.7 | absent |
| 96 | 0.07 | — | — | — | 0.07 | remainder | 11.9 | 20.8 | 34.2 | 11.9 | 20.6 | 34.1 | absent |
| 97 | 0.5 | — | — | — | 0.5 | remainder | 11.9 | 21.1 | 34.2 | 11.9 | 21.0 | 34.2 | absent |
| 98 | 1.0 | — | — | — | 1.0 | remainder | 11.8 | 21.3 | 34.0 | 11.8 | 21.3 | 34.0 | absent |
| 99 | 2.4 | — | — | — | 2.4 | remainder | 11.7 | 21.5 | 33.5 | 11.7 | 21.5 | 33.5 | absent |
| 100 | 0.0002 | 0.05 | — | — | 0.0502 | remainder | 11.9 | 21.0 | 34.2 | 11.8 | 20.7 | 33.8 | absent |
| 101 | 0.06 | 1.5 | — | — | 1.56 | remainder | 11.8 | 21.3 | 34.0 | 11.8 | 21.1 | 33.9 | absent |
| 102 | 0.5 | 1.5 | — | — | 2.0 | remainder | 11.8 | 21.4 | 34.0 | 11.8 | 21.4 | 34.0 | absent |
| 103 | 1.1 | 0.03 | — | — | 1.13 | remainder | 11.8 | 21.1 | 34.0 | 11.8 | 20.9 | 33.9 | absent |
| 104 | 2.0 | 0.0002 | — | — | 2.0002 | remainder | 11.8 | 20.9 | 33.9 | 11.8 | 20.9 | 33.9 | absent |
| 105 | 0.0002 | — | 0.005 | — | 0.0052 | remainder | 11.9 | 20.3 | 34.1 | 11.8 | 19.9 | 33.7 | absent |
| 106 | 0.05 | — | 2.0 | — | 2.05 | remainder | 11.8 | 21.3 | 34.0 | 11.8 | 21.3 | 34.0 | absent |
| 107 | 0.5 | — | 1.0 | — | 1.5 | remainder | 11.8 | 20.8 | 33.9 | 11.8 | 20.7 | 33.8 | absent |
| 108 | 1.0 | — | 0.1 | — | 1.1 | remainder | 11.8 | 20.7 | 33.8 | 11.8 | 20.6 | 33.8 | absent |
| 109 | 2.2 | — | 0.0005 | — | 2.2005 | remainder | 11.7 | 21.0 | 33.4 | 11.7 | 21.0 | 33.4 | absent |
| 110 | 0.0002 | — | — | 0.07 | 0.0702 | remainder | 11.9 | 20.0 | 34.0 | 11.9 | 19.8 | 33.7 | absent |
| 111 | 0.06 | — | — | 2.2 | 2.26 | remainder | 11.7 | 21.4 | 33.5 | 11.7 | 21.4 | 33.5 | absent |
| 112 | 0.3 | — | — | 1.0 | 1.3 | remainder | 11.8 | 20.8 | 33.9 | 11.8 | 20.7 | 33.8 | absent |
| 113 | 1.0 | — | — | 0.1 | 1.1 | remainder | 11.8 | 20.6 | 33.8 | 11.8 | 20.4 | 33.7 | absent |
| 114 | 2.3 | — | — | 0.0005 | 2.3005 | remainder | 11.7 | 21.0 | 33.4 | 11.7 | 21.0 | 33.4 | absent |

*the composition of the rare earth metal-boron-iron alloy powder is Nd-13.5%, Dy-1.5%, B-8%, Fe-remainder (here % is atomic %)

TABLE 10-2

| Sample | Starting Material Powder Composition (Weight %) | | | | | | Prior to the Corrosion Test | | | After the Corrosion Test | | | Rust State |
|---|---|---|---|---|---|---|---|---|---|---|---|---|---|
| | Oxides Added to R—B—Fe Alloy Powder | | | | | | Br | iHc | $BH_{max}$ | Br | iHc | $BH_{max}$ | |
| | $Ga_2O_3$ | $Al_2O_3$ | $Cr_2O_3$ | $V_2O_5$ | Total | R—B—Fe Alloy Powder | KG | KOe | MGOe | KG | KOe | MGOe | |
| EXAMPLES | | | | | | | | | | | | | |
| 115 | 0.1 | 0.3 | 0.2 | — | 0.6 | remainder | 11.9 | 20.5 | 34.2 | 11.8 | 20.1 | 33.7 | absent |
| 116 | 0.2 | 0.5 | 0.5 | — | 1.2 | remainder | 11.8 | 21.0 | 33.9 | 11.8 | 20.9 | 33.9 | absent |
| 117 | 0.7 | 0.5 | 0.5 | — | 1.7 | remainder | 11.8 | 21.2 | 34.0 | 11.8 | 21.1 | 33.9 | absent |
| 118 | 0.6 | 1.0 | 0.6 | — | 2.2 | remainder | 11.7 | 22.0 | 33.6 | 11.7 | 22.0 | 33.6 | absent |
| 119 | 0.2 | — | 1.4 | 0.4 | 2.0 | remainder | 11.7 | 21.3 | 33.5 | 11.7 | 21.2 | 33.5 | absent |
| 120 | 0.001 | — | 0.01 | 0.02 | 0.031 | remainder | 11.9 | 20.6 | 34.2 | 11.9 | 20.4 | 34.2 | absent |
| 121 | 0.4 | — | 0.7 | 0.5 | 1.6 | remainder | 11.8 | 20.7 | 33.8 | 11.8 | 20.6 | 33.8 | absent |
| 122 | 0.1 | — | 0.2 | 1.5 | 1.8 | remainder | 11.8 | 21.0 | 33.9 | 11.8 | 20.9 | 33.9 | absent |
| 123 | 0.3 | — | 1.7 | 0.1 | 2.1 | remainder | 11.8 | 21.3 | 34.0 | 11.8 | 21.3 | 34.0 | absent |
| 124 | 1.0 | 0.5 | — | 0.4 | 1.9 | remainder | 11.8 | 21.4 | 34.1 | 11.8 | 21.3 | 34.0 | absent |
| 125 | 0.2 | 0.2 | — | 0.2 | 0.6 | remainder | 11.9 | 20.6 | 34.2 | 11.8 | 20.4 | 33.7 | absent |
| 126 | 0.1 | 1.3 | — | 0.3 | 1.7 | remainder | 11.8 | 21.5 | 34.2 | 11.8 | 21.4 | 34.1 | absent |
| 127 | 0.001 | 0.01 | — | 0.01 | 0.111 | remainder | 11.8 | 21.0 | 33.9 | 11.8 | 20.7 | 33.8 | absent |
| 128 | 0.3 | 0.3 | — | 0.3 | 0.9 | remainder | 11.8 | 21.5 | 34.1 | 11.8 | 21.1 | 33.9 | absent |
| 129 | 0.0004 | 0.0001 | 0.0001 | 0.0001 | 0.0007 | remainder | 11.9 | 20.1 | 34.0 | 11.8 | 19.8 | 33.6 | absent |
| 130 | 0.01 | 0.01 | 0.01 | 0.01 | 0.04 | remainder | 11.9 | 20.7 | 34.2 | 11.8 | 20.5 | 33.7 | absent |
| 131 | 0.2 | 0.1 | 0.1 | 0.1 | 0.5 | remainder | 11.8 | 20.6 | 33.8 | 11.8 | 20.5 | 33.7 | absent |
| 132 | 0.3 | 0.4 | 0.1 | 0.2 | 1.0 | reaminder | 11.8 | 21.0 | 34.0 | 11.8 | 21.0 | 34.0 | absent |
| 133 | 0.4 | 0.4 | 0.4 | 0.4 | 1.6 | remainder | 11.8 | 21.4 | 34.2 | 11.8 | 21.4 | 34.2 | absent |
| 134 | 0.5 | 0.6 | 0.5 | 0.7 | 2.3 | remainder | 11.7 | 22.0 | 33.6 | 11.7 | 22.0 | 33.6 | absent |

*the composition of the rare earth metal-boron-iron alloy powder is Nd-13.5%, Dy-1.5%, B-8%, Fe-remainder (here % is atomic %)

TABLE 10-3

| Sample | Starting Material Powder Composition (Weight %) | | | | | | Prior to the Corrosion Test | | | After the Corrosion Test | | | Rust State |
|---|---|---|---|---|---|---|---|---|---|---|---|---|---|
| | Oxides Added to R—B—Fe Alloy Powder | | | | | | Br | iHc | $BH_{max}$ | Br | iHc | $BH_{max}$ | |
| | $Ga_2O_3$ | $Al_2O_3$ | $Cr_2O_3$ | $V_2O_5$ | Total | R—B—Fe Alloy Powder | KG | KOe | MGOe | KG | KOe | MGOe | |
| COMPARATIVE EXAMPLES | | | | | | | | | | | | | |
| 39 | — | — | — | — | none# | remainder | 12.0 | 20.0 | 34.8 | 10.5 | 8.1 | 22.1 | heavy |
| 40 | 0.0002 | — | — | — | 0.0002# | remainder | 12.0 | 20.1 | 34.8 | 10.6 | 8.8 | 22.9 | present |
| 41 | 3.2 | — | — | — | 3.2# | remainder | 10.4 | 12.2 | 22.7 | 10.4 | 12.1 | 22.7 | absent |
| 42 | 0.0002 | 0.0001 | — | — | 0.0003# | remainder | 12.0 | 20.3 | 34.9 | 10.6 | 9.8 | 21.3 | present |
| 43 | 2.2 | 0.8 | — | — | 3.0# | remainder | 10.2 | 11.8 | 22.5 | 10.2 | 11.7 | 22.5 | absent |
| 44 | 0.0003 | — | 0.0001 | — | 0.0004# | remainder | 11.9 | 20.1 | 34.1 | 10.7 | 10.8 | 23.0 | present |
| 45 | 2.3 | — | 0.8 | — | 3.1# | remainder | 10.4 | 10.5 | 20.9 | 10.4 | 10.5 | 20.9 | absent |
| 46 | 0.0002 | — | — | 0.0002 | 0.0004# | remainder | 11.9 | 20.2 | 34.1 | 10.6 | 9.7 | 21.2 | present |
| 47 | 2.2 | — | — | 1.1 | 3.3# | remainder | 10.3 | 11.8 | 22.8 | 10.3 | 11.8 | 22.8 | absent |
| 48 | 0.0001 | 0.0001 | 0.0001 | — | 0.0003# | remainder | 11.9 | 20.2 | 34.1 | 10.7 | 10.1 | 22.0 | present |
| 49 | 2.0 | 0.4 | 0.7 | — | 3.1# | remainder | 10.4 | 12.1 | 23.2 | 10.4 | 12.1 | 23.2 | absent |
| 50 | 0.0001 | — | 0.0001 | 0.0001 | 0.0003# | remainder | 12.0 | 20.0 | 34.8 | 10.7 | 10.2 | 22.1 | present |
| 51 | 1.0 | — | 0.5 | 2.0 | 3.5# | remainder | 10.2 | 12.2 | 22.2 | 10.2 | 12.2 | 22.2 | absent |
| 52 | 0.0001 | 00001 | — | 0.0001 | 0.0003# | remainder | 11.9 | 20.1 | 34.1 | 10.6 | 12.3 | 23.3 | present |
| 53 | 2.0 | 0.6 | — | 0.5 | 3.1# | remainder | 10.5 | 11.5 | 23.3 | 10.5 | 11.4 | 23.2 | absent |
| 54 | 0.0001 | 0.0001 | 0.0001 | 0.0001 | 0.0004# | remainder | 11.9 | 20.2 | 34.1 | 11.7 | 12.0 | 23.4 | present |
| 55 | 1.0 | 0.6 | 0.9 | 0.6 | 3.1# | remainder | 10.5 | 11.6 | 23.4 | 10.5 | 11.6 | 23.4 | absent |

*the composition of the rare earth metal-boron-iron alloy powder is Nd-13.5%, Dy-1.5%, B-8%, Fe-remainder (here % is atomic %)

TABLE 11-1

| SAMPLE | STARTING MATERIAL COMPOSITION (WEIGHT %) HYDRIDE POWDERS $ZrH_2$ | $TaH_2$ | $TiH_2$ | $NbH_2$ | VH | $HfH_2$ | $YH_3$ | TOTAL | R—B—Fe ALLOY POWDER | RUST STATE | MAGNETIC CHARACTERISTICS PRIOR TO CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|---|
| SINTERED R—B—Fe MAGNETS OF THE PRESENT INVENTION | | | | | | | | | | | | | | | | |
| 135 | 0.0006 | — | — | — | — | — | — | 0.0006 | BALANCE | ABSENT | 12.6 | 13.5 | 38.0 | 12.4 | 13.3 | 37.5 |
| 136 | 0.1 | — | — | — | — | — | — | 0.1 | BALANCE | ABSENT | 12.5 | 13.8 | 38.0 | 12.5 | 13.7 | 38.0 |
| 137 | 2.5 | — | — | — | — | — | — | 2.5 | BALANCE | ABSENT | 12.5 | 13.9 | 38.0 | 12.5 | 13.9 | 38.0 |
| 138 | — | 0.0006 | — | — | — | — | — | 0.0006 | BALANCE | ABSENT | 12.6 | 13.4 | 38.0 | 12.4 | 13.0 | 37.2 |
| 139 | — | 0.09 | — | — | — | — | — | 0.09 | BALANCE | ABSENT | 12.5 | 13.5 | 37.8 | 12.5 | 13.4 | 37.7 |
| 140 | — | 2.4 | — | — | — | — | — | 2.4 | BALANCE | ABSENT | 12.5 | 13.6 | 37.8 | 12.5 | 13.5 | 37.8 |
| 141 | — | — | 0.0007 | — | — | — | — | 0.0007 | BALANCE | ABSENT | 12.6 | 13.8 | 38.2 | 12.5 | 13.4 | 37.7 |
| 142 | — | — | 1.0 | — | — | — | — | 1.0 | BALANCE | ABSENT | 12.5 | 14.5 | 38.3 | 12.5 | 14.4 | 38.3 |
| 143 | — | — | 2.0 | — | — | — | — | 2.0 | BALANCE | ABSENT | 12.5 | 14.6 | 38.3 | 12.5 | 14.5 | 38.3 |
| 144 | — | — | — | 0.0006 | — | — | — | 0.0006 | BALANCE | ABSENT | 12.6 | 13.6 | 38.0 | 12.4 | 13.1 | 37.3 |
| 145 | — | — | — | 1.1 | — | — | — | 1.1 | BALANCE | ABSENT | 12.5 | 13.9 | 38.1 | 12.5 | 13.8 | 38.0 |
| 146 | — | — | — | 2.2 | — | — | — | 2.2 | BALANCE | ABSENT | 12.5 | 14.0 | 38.0 | 12.5 | 14.0 | 38.0 |
| 147 | — | — | — | — | 0.0007 | — | — | 0.0007 | BALANCE | ABSENT | 12.6 | 13.8 | 38.2 | 12.5 | 13.3 | 37.6 |
| 148 | — | — | — | — | 0.9 | — | — | 0.9 | BALANCE | ABSENT | 12.5 | 14.1 | 38.1 | 12.5 | 14.0 | 38.0 |
| 149 | — | — | — | — | 2.3 | — | — | 2.3 | BALANCE | ABSENT | 12.5 | 14.2 | 38.2 | 12.5 | 14.2 | 38.2 |
| 150 | — | — | — | — | — | 0.0007 | — | 0.0007 | BALANCE | ABSENT | 12.6 | 13.4 | 38.0 | 12.4 | 12.9 | 37.1 |
| 151 | — | — | — | — | — | 1.0 | — | 1.0 | BALANCE | ABSENT | 12.5 | 13.7 | 37.9 | 12.5 | 13.5 | 37.8 |
| 152 | — | — | — | — | — | 2.4 | — | 2.4 | BALANCE | ABSENT | 12.5 | 13.8 | 38.1 | 12.5 | 13.7 | 38.0 |

TABLE 11-2

| SAMPLE | STARTING MATERIAL COMPOSITION (WEIGHT %) HYDRIDE POWDERS $ZrH_2$ | $TaH_2$ | $TiH_2$ | $NbH_2$ | VH | $HfH_2$ | $YH_3$ | TOTAL | R—B—Fe ALLOY POWDER | RUST STATE | MAGNETIC CHARACTERISTICS PRIOR TO CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|---|
| SINTERED R—B—Fe MAGNETS OF THE PRESENT INVENTION | | | | | | | | | | | | | | | | |
| 153 | — | — | — | — | — | — | 0.0007 | 0.0007 | BALANCE | ABSENT | 12.6 | 13.7 | 38.1 | 12.5 | 13.3 | 37.6 |
| 154 | — | — | — | — | — | — | 0.1 | 0.1 | BALANCE | ABSENT | 12.5 | 14.1 | 38.1 | 12.5 | 13.9 | 37.9 |
| 155 | — | — | — | — | — | — | 2.8 | 2.8 | BALANCE | ABSENT | 12.5 | 14.2 | 38.1 | 12.5 | 14.0 | 38.0 |
| 156 | 0.0002 | — | 0.0002 | 0.0002 | — | — | 0.0001 | 0.0007 | BALANCE | ABSENT | 12.6 | 13.7 | 38.1 | 12.5 | 13.5 | 37.8 |
| 157 | — | 0.1 | — | — | 0.1 | — | — | 0.2 | BALANCE | ABSENT | 12.5 | 14.1 | 38.1 | 12.5 | 13.8 | 37.8 |
| 158 | 0.3 | 0.3 | — | — | — | — | — | 0.6 | BALANCE | ABSENT | 12.5 | 14.1 | 38.1 | 12.5 | 13.9 | 38.0 |
| 159 | 0.5 | — | 0.5 | — | — | — | — | 1.0 | BALANCE | ABSENT | 12.5 | 14.3 | 38.2 | 12.5 | 14.0 | 38.0 |
| 160 | 0.3 | — | — | 0.3 | — | 0.3 | — | 0.9 | BALANCE | ABSENT | 12.5 | 14.2 | 38.1 | 12.5 | 13.9 | 38.0 |
| 161 | 1.0 | — | — | — | 0.5 | — | — | 1.5 | BALANCE | ABSENT | 12.5 | 14.2 | 38.1 | 12.5 | 14.0 | 38.0 |
| 162 | 1.0 | — | — | — | — | — | 0.1 | 1.1 | BALANCE | ABSENT | 12.5 | 14.0 | 38.0 | 12.5 | 13.9 | 38.0 |
| 163 | 0.5 | 0.5 | — | 0.5 | — | 0.5 | — | 2.0 | BALANCE | ABSENT | 12.5 | 14.2 | 38.1 | 12.5 | 14.1 | 38.1 |
| 164 | — | 0.3 | 0.5 | — | — | — | — | 0.8 | BALANCE | ABSENT | 12.5 | 14.2 | 38.1 | 12.5 | 13.8 | 37.8 |
| 165 | — | — | — | 0.1 | 0.3 | — | — | 0.4 | BALANCE | ABSENT | 12.5 | 13.8 | 37.8 | 12.5 | 13.4 | 37.7 |
| 166 | — | — | — | — | — | 0.4 | 0.5 | 0.9 | BALANCE | ABSENT | 12.5 | 14.2 | 38.1 | 12.5 | 14.0 | 38.0 |
| 167 | — | 1.3 | — | 1.5 | — | — | — | 2.8 | BALANCE | ABSENT | 12.5 | 14.3 | 38.2 | 12.5 | 14.2 | 38.1 |
| 168 | — | — | 0.01 | — | 0.1 | — | — | 0.11 | BALANCE | ABSENT | 12.5 | 14.1 | 38.1 | 12.5 | 13.8 | 37.8 |
| 169 | — | — | — | 0.3 | — | 0.3 | — | 0.6 | BALANCE | ABSENT | 12.5 | 13.8 | 37.8 | 12.5 | 13.5 | 37.7 |
| 170 | — | — | — | — | 0.8 | — | 0.2 | 1.0 | BALANCE | ABSENT | 12.5 | 14.1 | 38.1 | 12.5 | 13.9 | 37.9 |

TABLE 11-3

| SAMPLE | STARTING MATERIAL COMPOSITION (WEIGHT %) HYDRIDE POWDERS $ZrH_2$ | $TaH_2$ | $TiH_2$ | $NbH_2$ | VH | $HfH_2$ | $YH_3$ | TOTAL | R—B—Fe ALLOY POWDER | RUST STATE | MAGNETIC CHARACTERISTICS BEFORE CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|---|
| SINTERED R—B—Fe MAGNETS OF THE PRESENT INVENTION | | | | | | | | | | | | | | | | |
| 171 | 0.02 | — | 0.02 | — | 0.02 | — | 0.02 | 0.08 | BALANCE | ABSENT | 12.6 | 13.8 | 38.5 | 12.5 | 13.5 | 37.8 |
| 172 | — | 0.03 | — | 0.3 | — | 0.3 | — | 0.63 | BALANCE | ABSENT | 12.5 | 14.0 | 38.0 | 12.5 | 13.8 | 38.0 |
| 173 | 0.001 | — | 0.002 | — | — | 0.1 | — | 0.103 | BALANCE | ABSENT | 12.5 | 13.9 | 38.0 | 12.5 | 13.5 | 37.8 |
| 174 | 0.01 | 0.02 | — | 0.02 | — | 0.03 | 0.01 | 0.09 | BALANCE | ABSENT | 12.5 | 13.8 | 38.0 | 12.5 | 13.3 | 37.6 |
| 175 | — | 0.03 | — | 0.02 | 0.02 | 0.02 | 0.01 | 0.10 | BALANCE | ABSENT | 12.5 | 13.8 | 38.0 | 12.5 | 13.5 | 37.8 |
| 176 | — | — | 0.01 | 0.01 | 0.01 | 0.01 | 0.01 | 0.05 | BALANCE | ABSENT | 12.5 | 13.7 | 37.9 | 12.5 | 13.4 | 37.7 |
| 177 | 0.001 | 0.001 | 0.001 | 0.001 | 0.001 | 0.001 | 0.001 | 0.007 | BALANCE | ABSENT | 12.6 | 13.6 | 37.8 | 12.5 | 13.3 | 37.6 |
| 178 | — | — | 0.2 | 0.2 | 0.2 | — | — | 0.6 | BALANCE | ABSENT | 12.5 | 14.1 | 38.1 | 12.5 | 14.0 | 38.0 |
| 179 | 0.4 | 0.4 | 0.4 | 0.4 | 0.4 | 0.4 | 0.4 | 2.8 | BALANCE | ABSENT | 12.5 | 14.3 | 38.2 | 12.5 | 14.2 | 38.2 |
| COMPARATIVE SINTERED R—B—Fe MAGNETS | | | | | | | | | | | | | | | | |
| 56 | — | — | — | — | — | — | — | 0 | BALANCE | MARKED | 12.5 | 12.5 | 36.8 | 11.2 | 7.5 | 22.0 |
| 57 | 0.0003 | — | — | — | — | — | — | 0.0003 | BALANCE | PRESENT | 12.6 | 13.3 | 37.8 | 11.8 | 10.3 | 26.5 |
| 58 | 3.5 | — | — | — | — | — | — | 3.5 | BALANCE | ABSENT | 11.5 | 7.5 | 24.1 | 11.5 | 7.5 | 24.1 |
| 59 | — | 0.0002 | — | — | — | — | — | 0.0002 | BALANCE | PRESENT | 12.5 | 13.2 | 37.8 | 11.7 | 10.1 | 25.7 |
| 60 | — | 3.3 | — | — | — | — | — | 3.3 | BALANCE | ABSENT | 11.4 | 7.6 | 24.0 | 11.4 | 7.6 | 24.0 |
| 61 | — | — | 0.0003 | — | — | — | — | 0.0003 | BALANCE | PRESENT | 12.6 | 13.3 | 37.9 | 11.7 | 10.2 | 25.8 |
| 62 | — | — | 3.6 | — | — | — | — | 3.6 | BALANCE | ABSENT | 11.5 | 7.9 | 24.2 | 11.5 | 7.9 | 24.2 |
| 63 | — | — | — | 0.0003 | — | — | — | 0.0003 | BALANCE | PRESENT | 12.6 | 13.2 | 37.8 | 11.6 | 9.9 | 24.8 |
| 64 | — | — | — | 3.4 | — | — | — | 3.4 | BALANCE | ABSENT | 11.5 | 7.7 | 24.1 | 11.5 | 7.7 | 24.1 |

indicates values outside of the conditions of the present invention

TABLE 11-4

| SAMPLE | STARTING MATERIAL COMPOSITION (WEIGHT %) | | | | | | | | |
|---|---|---|---|---|---|---|---|---|---|
| | HYDRIDE POWDERS | | | | | | | | R—B—Fe ALLOY POWDER |
| | $ZrH_2$ | $TaH_2$ | $TiH_2$ | $NbH_2$ | VH | $HfH_2$ | $YH_3$ | TOTAL | |
| COMPARATIVE SINTERED R—B—Fe MAGNETS | | | | | | | | | |
| 65 | — | — | — | — | 0.0003 | — | — | 0.0003 | BALANCE |
| 66 | — | — | — | — | 3.5 | — | — | 3.5 | BALANCE |
| 67 | — | — | — | — | — | 0.0003 | — | 0.0003 | BALANCE |
| 68 | — | — | — | — | — | 3.4 | — | 3.4 | BALANCE |
| 69 | — | — | — | — | — | — | 0.0003 | 0.0003 | BALANCE |
| 70 | — | — | — | — | — | — | 3.5 | 3.5 | BALANCE |
| 71 | 0.0001 | 0.0001 | 0.0001 | — | — | — | — | 0.0003 | BALANCE |
| 72 | 0.5 | 0.5 | 0.5 | 0.5 | 0.5 | 0.5 | 0.5 | 3.5 | BALANCE |
| 73 | 1.8 | — | 1.8 | — | — | — | — | 3.6 | BALANCE |

| SAMPLE | RUST STATE | MAGNETIC CHARACTERISTICS | | | | | |
|---|---|---|---|---|---|---|---|
| | | PRIOR TO CORROSION TEST | | | AFTER CORROSION TEST | | |
| | | Br (KG) | iHc (KOe) | BH max (MGOe) | Br (KG) | iHc (KOe) | BH max (MGOe) |
| COMPARATIVE SINTERED R—B—Fe MAGNETS | | | | | | | |
| 65 | PRESENT | 12.6 | 13.1 | 37.6 | 11.5 | 8.0 | 24.2 |
| 66 | ABSENT | 11.4 | 8.0 | 24.0 | 11.4 | 8.0 | 24.0 |
| 67 | PRESENT | 12.6 | 13.0 | 37.5 | 11.5 | 7.7 | 24.0 |
| 68 | ABSENT | 11.5 | 7.8 | 24.2 | 11.5 | 7.8 | 24.2 |
| 69 | PRESENT | 12.6 | 13.1 | 37.6 | 11.6 | 8.5 | 24.7 |
| 70 | ABSENT | 11.5 | 7.7 | 24.0 | 11.5 | 7.7 | 24.0 |
| 71 | PRESENT | 12.6 | 13.2 | 37.5 | 11.6 | 8.8 | 24.9 |
| 72 | ABSENT | 11.4 | 7.7 | 24.0 | 11.4 | 7.7 | 24.0 |
| 73 | ABSENT | 11.5 | 7.8 | 24.1 | 11.5 | 7.8 | 24.1 |

indicates values outside of the conditions of the present invention

TABLE 12-1

| SAMPLE | STARTING MATERIAL COMPOSITION (WEIGHT %) OXIDE POWDERS $Y_2O_3$ | $Ho_2O_3$ | $Er_2O_3$ | $Tm_2O_3$ | $Lu_2O_3$ | $Eu_2O_3$ | TOTAL | R—B—Fe ALLOY POWDER | RUST STATE | MAGNETIC CHARACTERISTICS PRIOR TO CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|
| EXAMPLES | | | | | | | | | | | | | | | |
| 180 | 0.0006 | — | — | — | — | — | 0.0006 | BALANCE | ABSENT | 12.6 | 13.8 | 38.2 | 12.4 | 13.5 | 37.2 |
| 181 | 0.09 | — | — | — | — | — | 0.09 | BALANCE | ABSENT | 12.5 | 14.2 | 38.2 | 12.5 | 14.0 | 38.0 |
| 182 | 2.4 | — | — | — | — | — | 2.4 | BALANCE | ABSENT | 12.4 | 14.0 | 37.6 | 12.4 | 14.0 | 37.6 |
| 183 | — | 0.0006 | — | — | — | — | 0.0006 | BALANCE | ABSENT | 12.5 | 13.5 | 37.8 | 12.3 | 13.1 | 35.9 |
| 184 | — | 0.1 | — | — | — | — | 0.1 | BALANCE | ABSENT | 12.4 | 13.9 | 37.5 | 12.4 | 13.7 | 37.3 |
| 185 | — | 2.3 | — | — | — | — | 2.3 | BALANCE | ABSENT | 12.3 | 13.7 | 36.2 | 12.3 | 13.7 | 36.2 |
| 186 | — | — | 0.0006 | — | — | — | 0.0006 | BALANCE | ABSENT | 12.6 | 13.6 | 38.0 | 12.4 | 13.4 | 37.0 |
| 187 | — | — | 0.8 | — | — | — | 0.08 | BALANCE | ABSENT | 12.5 | 13.8 | 37.9 | 12.4 | 13.7 | 37.6 |
| 188 | — | — | 2.4 | — | — | — | 2.4 | BALANCE | ABSENT | 12.3 | 13.7 | 36.5 | 12.3 | 13.7 | 36.5 |
| 189 | — | — | — | 0.0007 | — | — | 0.0007 | BALANCE | ABSENT | 12.6 | 13.9 | 38.2 | 12.4 | 13.7 | 37.3 |
| 190 | — | — | — | 0.1 | — | — | 0.1 | BALANCE | ABSENT | 12.5 | 14.3 | 38.3 | 12.5 | 14.1 | 38.1 |
| 191 | — | — | — | 2.3 | — | — | 2.3 | BALANCE | ABSENT | 12.3 | 14.1 | 36.6 | 12.3 | 14.1 | 36.6 |
| 192 | — | — | — | — | 0.0006 | — | 0.0006 | BALANCE | ABSENT | 12.6 | 13.8 | 38.1 | 12.4 | 13.5 | 37.1 |
| 193 | — | — | — | — | 0.09 | — | 0.09 | BALANCE | ABSENT | 12.5 | 14.0 | 38.1 | 12.5 | 13.9 | 38.0 |
| 194 | — | — | — | — | 2.4 | — | 2.4 | BALANCE | ABSENT | 12.3 | 13.9 | 36.5 | 12.3 | 13.9 | 36.5 |
| 195 | — | — | — | — | — | 0.0006 | 0.0006 | BALANCE | ABSENT | 12.6 | 13.7 | 38.0 | 12.4 | 13.5 | 37.2 |
| 196 | — | — | — | — | — | 0.11 | 0.11 | BALANCE | ABSENT | 12.5 | 13.5 | 38.0 | 12.5 | 13.7 | 37.9 |
| 197 | — | — | — | — | — | 2.4 | 2.4 | BALANCE | ABSENT | 12.3 | 13.9 | 36.4 | 12.3 | 13.9 | 36.4 |

TABLE 12-2

| SAMPLE | STARTING MATERIAL COMPOSITION (WEIGHT %) OXID POWDERS $Y_2O_3$ | $Ho_2O_3$ | $Er_2O_3$ | $Tm_2O_3$ | $Lu_2O_3$ | $Eu_2O_3$ | TOTAL | R—B—Fe ALLOY POWDER | RUST STATE | MAGNETIC CHARACTERISTICS PRIOR TO CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|
| EXAMPLES | | | | | | | | | | | | | | | |
| 198 | 0.0002 | 0.0002 | — | — | 0.0002 | 0.0001 | 0.0007 | remainder | ABSENT | 12.6 | 13.9 | 38.2 | 12.4 | 13.7 | 37.5 |
| 199 | — | 0.1 | 0.1 | — | — | — | 0.2 | ↑ | ↑ | 12.4 | 14.0 | 37.7 | 12.4 | 13.9 | 37.6 |
| 200 | — | — | 0.5 | 0.2 | — | — | 0.7 | ↑ | ↑ | 12.4 | 14.1 | 37.7 | 12.4 | 14.0 | 37.7 |
| 201 | 0.4 | — | — | 0.5 | — | 0.2 | 1.1 | ↑ | ↑ | 12.4 | 14.2 | 37.8 | 12.4 | 14.1 | 37.7 |
| 202 | 1.0 | — | 1.0 | — | — | 0.2 | 2.2 | ↑ | ↑ | 12.3 | 14.1 | 36.6 | 12.3 | 14.1 | 36.6 |
| 203 | 0.5 | 0.5 | — | 0.5 | — | 0.5 | 2.0 | ↑ | ↑ | 12.3 | 14.2 | 36.7 | 12.3 | 14.2 | 36.7 |
| 204 | — | 0.2 | — | 0.5 | — | — | 0.7 | ↑ | ↑ | 12.4 | 14.0 | 37.6 | 12.4 | 13.8 | 37.5 |
| 205 | — | — | 0.1 | 0.2 | — | — | 0.3 | ↑ | ↑ | 12.4 | 14.3 | 37.9 | 12.4 | 14.0 | 37.7 |
| 206 | — | — | — | — | 0.3 | 0.7 | 1.0 | ↑ | ↑ | 12.4 | 14.1 | 37.7 | 12.4 | 14.0 | 37.7 |
| 207 | — | 0.01 | — | 0.01 | — | — | 0.02 | ↑ | ↑ | 12.4 | 13.8 | 37.5 | 12.4 | 13.5 | 37.4 |
| 208 | — | 0.2 | 0.05 | — | — | — | 0.205 | ↑ | ↑ | 12.4 | 14.1 | 37.7 | 12.4 | 13.7 | 37.5 |
| 209 | — | — | 0.8 | — | — | 0.2 | 1.0 | ↑ | ↑ | 12.4 | 14.0 | 37.6 | 12.4 | 13.9 | 37.6 |
| 210 | — | 0.02 | — | 0.02 | 0.02 | 0.02 | 0.08 | ↑ | ↑ | 12.4 | 13.9 | 37.6 | 12.4 | 13.7 | 37.5 |
| 211 | 0.01 | — | 0.1 | — | — | 0.1 | 0.21 | ↑ | ↑ | 12.4 | 14.1 | 37.7 | 12.4 | 13.8 | 37.5 |
| 212 | — | — | 0.01 | 0.01 | 0.01 | 0.01 | 0.04 | ↑ | ↑ | 12.4 | 13.9 | 37.6 | 12.4 | 13.7 | 37.5 |
| 213 | — | — | 0.2 | 0.2 | 0.2 | — | 0.6 | ↑ | ↑ | 12.4 | 14.1 | 37.7 | 12.4 | 14.0 | 37.7 |
| 214 | 0.0001 | 0.0001 | 0.0001 | 0.0001 | 0.0001 | 0.0001 | 0.0006 | ↑ | ↑ | 12.6 | 13.8 | 38.1 | 12.4 | 13.4 | 37.3 |
| 215 | 0.4 | 0.4 | 0.4 | 0.4 | 0.4 | 0.4 | 2.4 | ↑ | ↑ | 12.3 | 14.1 | 36.6 | 12.3 | 14.1 | 36.6 |

TABLE 12-3

| SAMPLE | STARTING MATERIAL COMPOSITION (WEIGHT %) OXID POWDERS $Y_2O_3$ | $Ho_2O_3$ | $Er_2O_3$ | $Tm_2O_3$ | $Lu_2O_3$ | $Eu_2O_3$ | TOTAL | R—B—Fe ALLOY POWDER | RUST STATE | MAGNETIC CHARACTERISTICS PRIOR TO CORROSION TEST Br (KG) | iHc (KOe) | BH max (MGOe) | AFTER CORROSION TEST Br (KG) | iHc (KOe) | BH max (MGOe) |
|---|---|---|---|---|---|---|---|---|---|---|---|---|---|---|---|
| COMPARATIVE EXAMPLES | | | | | | | | | | | | | | | |
| 74 | — | — | — | — | — | — | — | 100 | heavy | 12.5 | 12.5 | 36.8 | 11.2 | 7.5 | 22.0 |
| 75 | 0.0003 | — | — | — | — | — | 0.0003 | remainder | present | 12.6 | 13.3 | 37.9 | 11.7 | 10.0 | 25.3 |
| 76 | 3.1 | — | — | — | — | — | 3.1 | ↑ | absent | 11.4 | 7.6 | 24.0 | 11.4 | 7.6 | 24.0 |
| 77 | — | 0.0002 | — | — | — | — | 0.0002 | ↑ | present | 12.5 | 13.2 | 37.8 | 11.4 | 9.4 | 25.0 |
| 78 | — | 3.2 | — | — | — | — | 3.2 | ↑ | absent | 11.4 | 7.3 | 23.7 | 11.4 | 7.3 | 23.7 |
| 79 | — | — | 0.0003 | — | — | — | 0.0003 | ↑ | present | 12.5 | 13.0 | 37.5 | 11.4 | 9.5 | 25.1 |
| 80 | — | — | 3.1 | — | — | — | 3.1 | ↑ | absent | 11.3 | 7.5 | 22.3 | 11.3 | 7.5 | 22.9 |
| 81 | — | — | — | 0.0003 | — | — | 0.0003 | ↑ | present | 12.6 | 13.3 | 37.8 | 11.5 | 8.7 | 25.0 |
| 82 | — | — | — | 3.1 | — | — | 3.1 | ↑ | absent | 11.3 | 7.6 | 23.0 | 11.3 | 7.6 | 23.0 |
| 83 | — | — | — | — | 0.0003 | — | 0.0003 | ↑ | present | 12.6 | 13.1 | 37.6 | 11.4 | 8.8 | 24.7 |
| 84 | — | — | — | — | 3.2 | — | 3.2 | ↑ | absent | 11.4 | 7.5 | 24.3 | 11.4 | 7.5 | 24.3 |
| 85 | — | — | — | — | — | 0.0003 | 0.0003 | ↑ | present | 12.6 | 12.4 | 37.5 | 11.5 | 7.7 | 24.9 |
| 86 | — | — | — | — | — | 3.1 | 3.1 | ↑ | absent | 11.5 | 7.4 | 21.8 | 11.5 | 7.4 | 21.8 |
| 87 | 0.0001 | 0.0001 | 0.0001 | — | — | — | 0.0003 | ↑ | present | 12.6 | 13.0 | 37.7 | 11.5 | 7.9 | 24.6 |
| 88 | 0.5 | 0.5 | 0.5 | 0.5 | 0.5 | 0.6 | 3.1 | ↑ | absent | 11.4 | 7.2 | 23.3 | 11.4 | 7.2 | 23.3 |
| 89 | — | 1.5 | — | 1.7 | — | — | 3.2 | ↑ | absent | 11.4 | 7.7 | 24.1 | 11.4 | 7.7 | 24.1 |

TABLE 13-1

| SAMPLE | COMPOSITION OF THE POWDER (WEIGHT %) | | | | | | | | | | | | | | | | | MAGNETIC PROPERTIES | | | | | |
|---|---|---|---|---|---|---|---|---|---|---|---|---|---|---|---|---|---|---|---|---|---|---|---|
| | $Cr_2O_3$ POWDER | NITRIDE POWDERS | | | | | | | | | | | | | | R—B—Fe* ALLOY POWDER | RUST STATE | Before Corrosion Test | | | After Corrosion Test | | |
| | | CrN | $MnN_4$ | ZrN | HfN | TiN | NbN | $Ni_2N$ | $Si_3N_4$ | GeN | VN | GaN | AlN | $Co_3N$ | TOTAL | | | Br (KG) | iHc (KOe) | BH max (MGOe) | Br (KG) | iHc (KOe) | BH max (MGOe) |
| EXAMPLES | | | | | | | | | | | | | | | | | | | | | | | |
| 216 | 0.0005 | 3.0 | — | — | — | — | — | — | — | — | — | — | — | — | 3.0 | remainder | absent | 12.6 | 14.0 | 38.5 | 12.5 | 13.8 | 38.2 |
| 217 | 0.05 | 2.0 | — | — | — | — | — | — | — | — | — | — | — | — | 2.0 | ↑ | ↑ | 12.6 | 14.0 | 38.5 | 12.6 | 13.8 | 38.4 |
| 218 | 0.5 | 1.0 | — | — | — | — | — | — | — | — | — | — | — | — | 1.0 | ↑ | ↑ | 12.5 | 13.8 | 38.2 | 12.5 | 13.8 | 38.2 |
| 219 | 1.5 | 0.05 | — | — | — | — | — | — | — | — | — | — | — | — | 0.05 | ↑ | ↑ | 12.5 | 13.7 | 38.2 | 12.5 | 13.7 | 38.2 |
| 220 | 2.5 | 0.0006 | — | — | — | — | — | — | — | — | — | — | — | — | 0.006 | ↑ | ↑ | 12.4 | 13.0 | 36.2 | 12.4 | 13.0 | 36.2 |
| 221 | 0.0006 | — | 3.0 | — | — | — | — | — | — | — | — | — | — | — | 3.0 | ↑ | ↑ | 12.5 | 14.0 | 38.3 | 12.5 | 13.8 | 38.2 |
| 222 | 0.05 | — | 2.0 | — | — | — | — | — | — | — | — | — | — | — | 2.0 | ↑ | ↑ | 12.5 | 13.8 | 38.2 | 12.5 | 13.8 | 38.2 |
| 223 | 0.5 | — | 1.0 | — | — | — | — | — | — | — | — | — | — | — | 1.0 | ↑ | ↑ | 12.4 | 13.6 | 36.5 | 12.4 | 13.6 | 36.5 |
| 224 | 1.5 | — | 0.05 | — | — | — | — | — | — | — | — | — | — | — | 0.05 | ↑ | ↑ | 12.3 | 13.5 | 36.3 | 12.3 | 13.5 | 36.3 |
| 225 | 2.5 | — | 0.0005 | — | — | — | — | — | — | — | — | — | — | — | 0.0005 | ↑ | ↑ | 12.3 | 13.1 | 36.2 | 12.3 | 13.0 | 36.2 |
| 226 | 0.0005 | — | — | 3.0 | — | — | — | — | — | — | — | — | — | — | 3.0 | ↑ | ↑ | 12.6 | 14.1 | 38.5 | 12.5 | 13.8 | 38.2 |
| 227 | 0.05 | — | — | 2.1 | — | — | — | — | — | — | — | — | — | — | 2.1 | ↑ | ↑ | 12.6 | 14.0 | 38.5 | 12.6 | 13.9 | 38.5 |
| 228 | 0.5 | — | — | 1.5 | — | — | — | — | — | — | — | — | — | — | 1.5 | ↑ | ↑ | 12.5 | 14.0 | 38.3 | 12.5 | 14.0 | 38.3 |
| 229 | 1.5 | — | — | 0.03 | — | — | — | — | — | — | — | — | — | — | 0.03 | ↑ | ↑ | 12.5 | 13.7 | 38.2 | 12.5 | 13.7 | 38.2 |
| 230 | 2.5 | — | — | 0.0007 | — | — | — | — | — | — | — | — | — | — | 0.0007 | ↑ | ↑ | 12.4 | 13.2 | 36.3 | 12.4 | 13.2 | 36.3 |
| 231 | 0.0006 | — | — | — | 2.1 | — | — | — | — | — | — | — | — | — | 2.1 | ↑ | ↑ | 12.5 | 13.8 | 38.2 | 12.5 | 13.7 | 38.1 |
| 232 | 0.06 | — | — | — | 2.9 | — | — | — | — | — | — | — | — | — | 2.9 | ↑ | ↑ | 12.6 | 14.0 | 38.5 | 12.6 | 13.9 | 38.4 |
| 233 | 0.6 | — | — | — | 1.6 | — | — | — | — | — | — | — | — | — | 1.6 | ↑ | ↑ | 12.5 | 13.7 | 38.2 | 12.5 | 13.7 | 38.2 |
| 234 | 1.7 | — | — | — | 0.05 | — | — | — | — | — | — | — | — | — | 0.05 | ↑ | ↑ | 12.4 | 13.6 | 36.5 | 12.4 | 13.6 | 36.5 |

*Alloy Formed from Nd-15%, B-8%, Fe-remainder (here % is atomic %)

TABLE 13-2

| SAMPLE | $Cr_2O_3$ POWDER | CrN | $MnN_6$ | ZrN | HfN | TiN | NbN | $Ni_2N$ | $Si_3N_6$ | GeN | VN | GaN | AlN | $Co_3N$ | TOTAL | R—B—Fe* ALLOY POWDER | RUST STATE | Br (KG) | iHe (KOe) | BH max (MGOe) | Br (KG) | iHe (KOe) | BH max (MGOe) |
|---|---|---|---|---|---|---|---|---|---|---|---|---|---|---|---|---|---|---|---|---|---|---|---|
| | COMPOSITION OF THE POWDER (WEIGHT %) | | | | | | | | | | | | | | | | | MAGNETIC PROPERTIES | | | | | |
| | | NITRIDE POWDERS | | | | | | | | | | | | | | | | Before Corrosion Test | | | After Corrosion Test | | |
| EXAMPLES | | | | | | | | | | | | | | | | | | | | | | | |
| 235 | 2.4 | — | — | — | 0.0005 | — | — | — | — | — | — | — | — | — | 0.0005 | remainder | absent | 12.5 | 13.8 | 38.0 | 12.5 | 13.8 | 38.0 |
| 236 | 2.5 | — | — | — | — | 1.5 | — | — | — | — | — | — | — | — | 1.5 | ↑ | ↑ | 12.5 | 14.0 | 38.3 | 12.5 | 14.0 | 38.2 |
| 237 | 2.0 | — | — | — | — | 3.0 | — | — | — | — | — | — | — | — | 3.0 | ↑ | ↑ | 12.4 | 13.7 | 36.5 | 12.4 | 13.7 | 36.5 |
| 238 | 1.0 | — | — | — | — | 2.0 | — | — | — | — | — | — | — | — | 2.0 | ↑ | ↑ | 12.4 | 13.7 | 36.5 | 12.4 | 13.7 | 36.5 |
| 239 | 0.5 | — | — | — | — | 0.06 | — | — | — | — | — | — | — | — | 0.06 | ↑ | ↑ | 12.4 | 13.8 | 36.6 | 12.4 | 13.6 | 36.5 |
| 240 | 0.0005 | — | — | — | — | 0.0006 | — | — | — | — | — | — | — | — | 0.0006 | ↑ | ↑ | 12.5 | 14.0 | 38.3 | 12.4 | 13.7 | 37.8 |
| 241 | 0.0006 | — | — | — | — | — | 0.0006 | — | — | — | — | — | — | — | 0.0006 | ↑ | ↑ | 12.6 | 13.7 | 38.4 | 12.5 | 13.5 | 38.0 |
| 242 | 0.1 | — | — | — | — | — | 0.02 | — | — | — | — | — | — | — | 0.02 | ↑ | ↑ | 12.7 | 14.0 | 38.8 | 12.7 | 13.9 | 38.7 |
| 243 | 1.0 | — | — | — | — | — | 1.0 | — | — | — | — | — | — | — | 1.0 | ↑ | ↑ | 12.7 | 14.0 | 38.8 | 12.7 | 14.0 | 38.8 |
| 244 | 1.7 | — | — | — | — | — | 2.0 | — | — | — | — | — | — | — | 2.0 | ↑ | ↑ | 12.6 | 13.5 | 38.3 | 12.6 | 13.5 | 38.3 |
| 245 | 2.4 | — | — | — | — | — | 2.9 | — | — | — | — | — | — | — | 2.9 | ↑ | ↑ | 12.5 | 13.0 | 37.5 | 12.5 | 12.9 | 37.4 |
| 246 | 0.0006 | — | — | — | — | — | — | 0.0006 | — | — | — | — | — | — | 0.0006 | ↑ | ↑ | 12.5 | 14.1 | 38.3 | 12.4 | 13.8 | 38.0 |
| 247 | 0.08 | — | — | — | — | — | — | 1.5 | — | — | — | — | — | — | 1.5 | ↑ | ↑ | 12.5 | 14.2 | 38.4 | 12.4 | 14.0 | 38.2 |
| 248 | 0.5 | — | — | — | — | — | — | 0.03 | — | — | — | — | — | — | 0.03 | ↑ | ↑ | 12.5 | 14.0 | 38.3 | 12.5 | 14.0 | 38.3 |
| 249 | 1.3 | — | — | — | — | — | — | 0.4 | — | — | — | — | — | — | 0.4 | ↑ | ↑ | 12.4 | 14.0 | 36.7 | 12.4 | 14.0 | 36.8 |
| 250 | 2.3 | — | — | — | — | — | — | 2.8 | — | — | — | — | — | — | 2.5 | ↑ | ↑ | 12.3 | 13.8 | 35.8 | 12.3 | 13.7 | 35.6 |
| 251 | 0.0005 | — | — | — | — | — | — | — | 3.0 | — | — | — | — | — | 3.0 | ↑ | ↑ | 12.2 | 13.8 | 35.0 | 12.2 | 13.8 | 35.0 |
| 252 | 0.08 | — | — | — | — | — | — | — | 1.9 | — | — | — | — | — | 1.9 | ↑ | ↑ | 12.4 | 14.1 | 36.8 | 12.4 | 14.0 | 36.7 |
| 253 | 1.0 | — | — | — | — | — | — | — | 1.0 | — | — | — | — | — | 1.0 | ↑ | ↑ | 12.7 | 13.9 | 38.7 | 12.7 | 13.9 | 38.7 |

*Alloy formed from Nd-15%, B-8%, Fe-remainder (here % is atomic %)

TABLE 13-3

| SAMPLE | $Cr_2O_3$ POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ | TOTAL | R—B—Fe* ALLOY POWDER | RUST STATE | MAGNETIC PROPERTIES Before Corrosion Test Br (KG) | iHe (KOe) | BH max (MGOe) | After Corrosion Test Br (KG) | iHe (KOe) | BH max (MGOe) |
|---|---|---|---|---|---|---|---|---|---|---|---|---|---|---|---|---|---|---|---|---|---|---|---|
| EXAMPLES | | | | | | | | | | | | | | | | | | | | | | | |
| 254 | 1.5 | — | — | — | — | — | — | — | 0.06 | — | — | — | — | — | 0.06 | remainder | absent | 12.6 | 13.7 | 38.3 | 12.6 | 13.7 | 38.3 |
| 255 | 2.5 | — | — | — | — | — | — | — | 0.0005 | — | — | — | — | — | 0.0005 | ↑ | ↑ | 12.5 | 13.7 | 38.2 | 12.5 | 13.6 | 38.1 |
| 256 | 0.0007 | — | — | — | — | — | — | — | — | 0.01 | — | — | — | — | 0.01 | ↑ | ↑ | 12.5 | 13.5 | 38.0 | 12.5 | 13.3 | 37.8 |
| 257 | 0.01 | — | — | — | — | — | — | — | — | 1.0 | — | — | — | — | 1.0 | ↑ | ↑ | 12.5 | 13.7 | 38.2 | 12.5 | 13.6 | 38.0 |
| 258 | 0.1 | — | — | — | — | — | — | — | — | 0.0005 | — | — | — | — | 0.0005 | ↑ | ↑ | 12.5 | 13.4 | 37.9 | 12.4 | 13.3 | 37.8 |
| 259 | 1.0 | — | — | — | — | — | — | — | — | 3.0 | — | — | — | — | 3.0 | ↑ | ↑ | 12.5 | 13.8 | 38.5 | 12.5 | 13.8 | 38.5 |
| 260 | 2.2 | — | — | — | — | — | — | — | — | 2.0 | — | — | — | — | 2.0 | ↑ | ↑ | 12.4 | 13.7 | 36.4 | 12.4 | 13.7 | 36.4 |
| 261 | 0.0005 | — | — | — | — | — | — | — | — | — | 2.9 | — | — | — | 2.9 | ↑ | ↑ | 12.5 | 13.8 | 38.4 | 12.5 | 13.5 | 38.1 |
| 262 | 0.07 | — | — | — | — | — | — | — | — | — | 1.9 | — | — | — | 1.9 | ↑ | ↑ | 12.5 | 13.7 | 38.3 | 12.5 | 13.5 | 38.1 |
| 263 | 1.0 | — | — | — | — | — | — | — | — | — | 1.1 | — | — | — | 1.1 | ↑ | ↑ | 12.5 | 13.8 | 38.4 | 12.5 | 13.8 | 38.4 |
| 264 | 1.5 | — | — | — | — | — | — | — | — | — | 0.01 | — | — | — | 0.01 | ↑ | ↑ | 12.5 | 13.6 | 38.1 | 12.5 | 13.5 | 38.1 |
| 265 | 2.5 | — | — | — | — | — | — | — | — | — | 0.0005 | — | — | — | 0.0005 | ↑ | ↑ | 12.5 | 13.7 | 38.2 | 12.5 | 13.4 | 37.9 |
| 266 | 0.0005 | — | — | — | — | — | — | — | — | — | — | 2.0 | — | — | 2.0 | ↑ | ↑ | 12.5 | 14.3 | 38.5 | 12.5 | 14.2 | 38.4 |
| 267 | 0.05 | — | — | — | — | — | — | — | — | — | — | 2.9 | — | — | 2.9 | ↑ | ↑ | 12.5 | 14.5 | 38.7 | 12.5 | 14.4 | 38.6 |
| 268 | 1.0 | — | — | — | — | — | — | — | — | — | — | 1.3 | — | — | 1.3 | ↑ | ↑ | 12.5 | 14.1 | 38.3 | 12.5 | 14.1 | 38.3 |
| 269 | 1.6 | — | — | — | — | — | — | — | — | — | — | 0.1 | — | — | 0.1 | ↑ | ↑ | 12.5 | 14.0 | 38.3 | 12.5 | 14.0 | 38.3 |
| 270 | 2.5 | — | — | — | — | — | — | — | — | — | — | 0.0005 | — | — | 0.0005 | ↑ | ↑ | 12.4 | 13.9 | 36.5 | 12.4 | 13.7 | 36.3 |
| 271 | 0.0006 | — | — | — | — | — | — | — | — | — | — | — | 3.0 | — | 3.0 | ↑ | ↑ | 12.4 | 14.7 | 38.0 | 12.4 | 14.6 | 37.9 |
| 272 | 0.09 | — | — | — | — | — | — | — | — | — | — | — | 2.1 | — | 2.1 | ↑ | ↑ | 12.4 | 14.5 | 37.8 | 12.4 | 14.4 | 37.8 |

*Alloy formed from Nd-15%, B-8%, Fe-remainder (here % is atomic %)

TABLE 13-4

| SAMPLE | COMPOSITION OF THE POWDER (WEIGHT %) | | | | | | | | | | | | | | | | | MAGNETIC PROPERTIES | | | | | |
|---|---|---|---|---|---|---|---|---|---|---|---|---|---|---|---|---|---|---|---|---|---|---|---|
| | | | | | | | | | | | | | | | | | | Before Corrosion Test | | | After Corrosion Test | | |
| | $Cr_2O_3$ POWDER | NITRIDE POWDERS | | | | | | | | | | | | | | R—B—Fe* ALLOY POWDER | RUST STATE | Br (KG) | iHe (KOe) | BH max (MGOe) | Br (KG) | iHe (KOe) | BH max (MGOe) |
| | | CrN | $MnN_4$ | ZrN | HfN | TiN | NbN | $Ni_2N$ | $Si_3N_4$ | GeN | VN | GaN | AlN | $Co_3N$ | TOTAL | | | | | | | | |
| EXAMPLES | | | | | | | | | | | | | | | | | | | | | | | |
| 273 | 1.0 | — | — | — | — | — | — | — | — | — | — | — | 1.0 | — | 1.0 | remainder | absent | 12.4 | 14.3 | 37.6 | 12.4 | 14.2 | 37.5 |
| 274 | 1.8 | — | — | — | — | — | — | — | — | — | — | — | 0.08 | — | 0.08 | ↑ | ↑ | 12.4 | 14.1 | 37.4 | 12.4 | 13.9 | 37.2 |
| 275 | 2.5 | — | — | — | — | — | — | — | — | — | — | — | 0.0005 | — | 0.0005 | ↑ | ↑ | 12.4 | 13.8 | 36.5 | 12.4 | 13.6 | 36.3 |
| 276 | 0.0005 | — | — | — | — | — | — | — | — | — | — | — | — | 3.0 | 3.0 | ↑ | ↑ | 12.4 | 13.6 | 36.3 | 12.4 | 13.4 | 36.1 |
| 277 | 0.01 | — | — | — | — | — | — | — | — | — | — | — | — | 2.0 | 2.0 | ↑ | ↑ | 12.5 | 13.5 | 38.0 | 12.5 | 13.4 | 37.9 |
| 278 | 0.1 | — | — | — | — | — | — | — | — | — | — | — | — | 1.0 | 1.0 | ↑ | ↑ | 12.5 | 13.6 | 38.1 | 12.5 | 13.4 | 37.9 |
| 279 | 1.3 | — | — | — | — | — | — | — | — | — | — | — | — | 0.08 | 0.08 | ↑ | ↑ | 12.4 | 13.6 | 36.3 | 12.4 | 13.4 | 36.1 |
| 280 | 2.5 | — | — | — | — | — | — | — | — | — | — | — | — | 0.0005 | 0.0005 | ↑ | ↑ | 12.3 | 13.7 | 35.7 | 12.3 | 13.6 | 35.9 |
| 281 | 1.2 | 0.1 | 0.1 | — | — | — | — | — | — | — | — | — | — | — | 0.2 | ↑ | ↑ | 12.4 | 13.6 | 36.3 | 12.4 | 13.5 | 36.2 |
| 282 | 1.2 | 0.4 | 0.1 | 0.4 | — | — | — | — | — | — | — | — | — | — | 0.9 | ↑ | ↑ | 12.4 | 13.5 | 36.2 | 12.4 | 13.3 | 36.0 |
| 283 | 1.2 | 0.7 | 0.7 | 0.1 | 0.1 | — | — | — | — | — | — | — | — | — | 1.6 | ↑ | ↑ | 12.4 | 13.6 | 36.3 | 12.4 | 13.5 | 36.2 |
| 284 | 1.2 | 0.1 | 0.1 | 0.1 | 0.1 | 0.1 | — | — | — | — | — | — | — | — | 0.5 | ↑ | ↑ | 12.5 | 13.4 | 37.9 | 12.5 | 13.3 | 38.0 |
| 285 | 1.2 | 0.5 | — | 0.3 | — | — | 0.1 | 0.5 | — | — | — | — | 0.5 | — | 1.9 | ↑ | ↑ | 12.4 | 13.5 | 36.2 | 12.4 | 13.5 | 36.2 |
| 286 | 1.2 | 0.7 | — | — | — | — | — | 0.8 | — | — | — | — | 0.6 | 0.5 | 2.6 | ↑ | ↑ | 12.4 | 13.4 | 36.1 | 12.4 | 13.4 | 36.1 |
| 287 | 1.2 | 0.7 | — | — | — | 0.3 | — | 0.5 | 0.3 | — | — | — | 0.6 | 0.5 | 2.9 | ↑ | ↑ | 12.3 | 14.0 | 36.0 | 12.3 | 13.9 | 35.9 |
| 288 | 1.8 | — | 0.6 | 0.3 | — | — | — | — | 0.2 | — | 0.5 | 0.4 | — | — | 2.0 | ↑ | ↑ | 12.3 | 13.9 | 35.9 | 12.3 | 13.9 | 35.9 |
| 289 | 1.8 | — | — | — | — | — | 0.3 | — | — | 0.3 | — | — | — | — | 0.6 | ↑ | ↑ | 12.4 | 13.6 | 36.3 | 12.4 | 13.5 | 36.2 |
| 290 | 1.8 | — | — | — | — | 0.01 | — | 0.01 | — | 0.01 | 0.01 | — | 0.01 | — | 0.05 | ↑ | ↑ | 12.4 | 14.0 | 37.3 | 12.4 | 14.0 | 37.3 |
| 291 | 1.8 | 0.01 | — | 0.03 | — | 0.01 | — | 0.01 | — | 0.01 | — | 0.01 | — | 0.01 | 0.09 | ↑ | ↑ | 12.4 | 13.7 | 36.4 | 12.4 | 13.5 | 36.2 |

*Alloy formed from Nd-15%, B-8%, Fe-remainder (here % is atomic %)

TABLE 13-5

| SAMPLE | $Cr_2O_3$ POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ | TOTAL | R—B—Fe* ALLOY POWDER | RUST STATE | MAGNETIC PROPERTIES Before Corrosion Test Br (KG) | iHe (KOe) | BH max (MGOe) | After Corrosion Test Br (KG) | iHe (KOe) | BH max (MGOe) |
|---|---|---|---|---|---|---|---|---|---|---|---|---|---|---|---|---|---|---|---|---|---|---|---|
| EXAMPLES | | | | | | | | | | | | | | | | | | | | | | | |
| 292 | 1.8 | — | 0.01 | — | 0.01 | — | 0.01 | — | 0.01 | — | 0.01 | — | 0.01 | — | 0.06 | remainder | A | 12.5 | 13.4 | 37.9 | 12.5 | 13.3 | 37.8 |
| 293 | 0.5 | 0.001 | 0.001 | 0.001 | 0.001 | 0.001 | 0.001 | 0.001 | 0.001 | 0.001 | 0.001 | 0.001 | 0.001 | 0.001 | 0.013 | ↑ | ↑ | 12.6 | 13.6 | 38.3 | 12.6 | 13.3 | 38.0 |
| 294 | 0.5 | 0.01 | — | — | 0.01 | — | — | 0.01 | — | — | 0.01 | — | — | 0.01 | 0.05 | ↑ | ↑ | 12.5 | 13.0 | 37.5 | 12.5 | 12.9 | 37.4 |
| 295 | 0.5 | — | 0.01 | — | — | 0.01 | — | — | 0.01 | — | — | 0.01 | — | — | 0.04 | ↑ | ↑ | 12.5 | 13.5 | 38.0 | 12.5 | 13.3 | 37.8 |
| 296 | 0.5 | — | — | 0.03 | — | — | 0.03 | — | — | 0.03 | — | — | 0.03 | — | 0.12 | ↑ | ↑ | 12.4 | 13.9 | 36.5 | 12.4 | 13.9 | 36.5 |
| 297 | 0.5 | — | — | — | 0.2 | — | — | 0.2 | — | — | 0.2 | — | — | 0.2 | 0.8 | ↑ | ↑ | 12.4 | 13.6 | 36.3 | 12.4 | 13.5 | 36.2 |
| 298 | 0.5 | 1.3 | — | — | — | 0.04 | — | — | — | 0.03 | — | — | 0.02 | — | 1.39 | ↑ | ↑ | 12.4 | 13.8 | 36.5 | 12.4 | 13.8 | 36.5 |
| 299 | 0.07 | — | 0.9 | — | — | — | — | 0.9 | — | — | — | — | 0.9 | — | 2.7 | ↑ | ↑ | 12.3 | 14.0 | 36.0 | 12.3 | 13.9 | 35.9 |
| 300 | 0.07 | — | — | — | 0.1 | — | — | — | — | 1.1 | — | 0.1 | — | — | 1.3 | ↑ | ↑ | 12.5 | 13.6 | 38.1 | 12.5 | 13.4 | 37.9 |
| COMPARATIVE EXAMPLES | | | | | | | | | | | | | | | | | | | | | | | |
| 90 | 0.0002 | 0.5 | — | — | — | — | — | — | — | — | — | — | — | — | 0.5 | ↑ | P | 12.5 | 13.8 | 38.2 | 11.8 | 6.1 | 22.5 |
| 91 | 3.1 | 0.5 | — | — | — | — | — | — | — | — | — | — | — | — | 0.5 | ↑ | A | 11.1 | 7.2 | 23.5 | 11.1 | 7.2 | 23.5 |
| 92 | 1.3 | 0.0002 | — | — | — | — | — | — | — | — | — | — | — | — | 0.0002 | ↑ | P | 12.5 | 13.7 | 38.1 | 11.4 | 5.9 | 22.3 |
| 93 | 1.3 | 3.2 | — | — | — | — | — | — | — | — | — | — | — | — | 3.2 | ↑ | A | 11.5 | 7.5 | 24.1 | 11.5 | 7.5 | 24.1 |
| 94 | 1.3 | — | 0.0002 | — | — | — | — | — | — | — | — | — | — | — | 0.0002 | ↑ | P | 12.5 | 13.5 | 37.9 | 10.9 | 4.2 | 19.2 |
| 95 | 1.3 | — | 3.3 | — | — | — | — | — | — | — | — | — | — | — | 3.3 | ↑ | A | 11.0 | 7.8 | 20.2 | 11.0 | 7.7 | 20.0 |
| 96 | 1.3 | — | — | 0.0003 | — | — | — | — | — | — | — | — | — | — | 0.0003 | ↑ | P | 12.5 | 13.1 | 37.6 | 11.0 | 4.5 | 22.0 |
| 97 | 1.3 | — | — | 3.2 | — | — | — | — | — | — | — | — | — | — | 3.2 | ↑ | A | 10.3 | 5.6 | 19.1 | 10.3 | 5.6 | 10.3 |
| 98 | 1.3 | — | — | — | 0.0001 | — | — | — | — | — | — | — | — | — | 0.0001 | ↑ | P | 12.5 | 13.2 | 37.8 | 11.0 | 4.2 | 20.8 |
| 99 | 1.3 | — | — | — | 3.3 | — | — | — | — | — | — | — | — | — | 3.3 | ↑ | A | 10.3 | 6.5 | 19.9 | 10.3 | 6.5 | 19.9 |

*Alloy formed from Nd-15%, B-8%, Fe-remainder (here % is atomic %)
A is absent, P is present
indicates values outside of the range of the present invention

TABLE 13-6

| SAMPLE | $Cr_2O_3$ POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ | TOTAL | R—B—Fe* ALLOY POWDER |
|---|---|---|---|---|---|---|---|---|---|---|---|---|---|---|---|---|
| COMPARATIVE EXAMPLES | | | | | | | | | | | | | | | | |
| 100 | 1.3 | — | — | — | — | 0.0003 | — | — | — | — | — | — | — | — | 0.0003 | remainder |
| 101 | 1.3 | — | — | — | — | 3.2 | — | — | — | — | — | — | — | — | 3.2 | ↑ |
| 102 | 1.3 | — | — | — | — | — | 0.0002 | — | — | — | — | — | — | — | 0.0002 | ↑ |
| 103 | 1.3 | — | — | — | — | — | 3.3 | — | — | — | — | — | — | — | 3.3 | ↑ |
| 104 | 1.3 | — | — | — | — | — | — | 0.0003 | — | — | — | — | — | — | 0.0003 | ↑ |
| 105 | 1.3 | — | — | — | — | — | — | 3.2 | — | — | — | — | — | — | 3.2 | ↑ |
| 106 | 1.3 | — | — | — | — | — | — | — | 0.0002 | — | — | — | — | — | 0.0002 | ↑ |
| 107 | 1.3 | — | — | — | — | — | — | — | 3.3 | — | — | — | — | — | 3.3 | ↑ |
| 108 | 1.3 | — | — | — | — | — | — | — | — | 0.0003 | — | — | — | — | 0.0003 | ↑ |
| 109 | 1.3 | — | — | — | — | — | — | — | — | 3.2 | — | — | — | — | 3.2 | ↑ |
| 110 | 1.3 | — | — | — | — | — | — | — | — | — | 0.0002 | — | — | — | 0.0002 | ↑ |
| 111 | 1.3 | — | — | — | — | — | — | — | — | — | 3.3 | — | — | — | 3.3 | ↑ |
| 112 | 1.3 | — | — | — | — | — | — | — | — | — | — | 0.0001 | — | — | 0.0001 | ↑ |
| 113 | 1.3 | — | — | — | — | — | — | — | — | — | — | 3.2 | — | — | 3.2 | ↑ |
| 114 | 1.3 | — | — | — | — | — | — | — | — | — | — | — | 0.0002 | — | 0.0002 | ↑ |
| 115 | 1.3 | — | — | — | — | — | — | — | — | — | — | — | 3.3 | — | 3.3 | ↑ |
| 116 | 1.3 | — | — | — | — | — | — | — | — | — | — | — | — | 0.0003 | 0.0003 | ↑ |
| 117 | 1.3 | — | — | — | — | — | — | — | — | — | — | — | — | 3.2 | 3.2 | ↑ |
| 118 | — | 0.5 | 0.5 | — | — | 0.5 | — | — | — | — | — | — | — | — | 1.5 | ↑ |
| 119 | 1.3 | 0.5 | 0.5 | — | — | 0.5 | — | 0.5 | 0.5 | — | 0.5 | — | 0.5 | — | 3.5 | ↑ |

| SAMPLE | RUST STATE | MAGNETIC PROPERTIES Before Corrosion Test Br (KG) | iHe (KOe) | BH max (MGOe) | After Corrosion Test Br (KG) | iHe (KOe) | BH max (MGOe) |
|---|---|---|---|---|---|---|---|
| COMPARATIVE EXAMPLES | | | | | | | |
| 100 | P | 12.6 | 12.8 | 38.0 | 10.5 | 3.0 | 13.2 |
| 101 | A | 11.5 | 5.8 | 22.1 | 11.5 | 5.8 | 22.1 |
| 102 | P | 12.5 | 13.6 | 38.0 | 10.4 | 5.5 | 11.8 |
| 103 | A | 11.1 | 6.5 | 20.8 | 11.1 | 6.5 | 20.8 |
| 104 | P | 12.5 | 13.1 | 37.6 | 10.6 | 5.6 | 18.1 |
| 105 | A | 11.3 | 7.0 | 22.0 | 11.3 | 7.0 | 22.0 |
| 106 | P | 12.5 | 13.3 | 37.8 | 10.8 | 4.3 | 20.4 |
| 107 | A | 10.9 | 4.3 | 18.8 | 10.9 | 4.3 | 20.8 |
| 108 | P | 12.5 | 13.1 | 37.6 | 10.5 | 5.5 | 17.8 |
| 109 | A | 10.8 | 4.5 | 19.0 | 10.8 | 4.5 | 19.0 |
| 110 | P | 12.5 | 13.7 | 38.1 | 10.5 | 5.9 | 18.0 |
| 111 | A | 10.8 | 4.8 | 21.1 | 10.8 | 4.8 | 21.1 |
| 112 | P | 12.5 | 13.6 | 38.0 | 10.4 | 5.4 | 11.5 |
| 113 | A | 10.9 | 6.1 | 21.0 | 10.9 | 6.1 | 21.0 |
| 114 | P | 12.5 | 13.5 | 37.9 | 10.4 | 5.0 | 11.0 |
| 115 | A | 10.7 | 6.1 | 20.8 | 10.7 | 6.1 | 20.8 |
| 116 | P | 12.4 | 12.9 | 36.1 | 10.9 | 4.0 | 18.0 |
| 117 | A | 10.8 | 4.6 | 19.3 | 10.8 | 4.6 | 19.3 |
| 118 | P | 12.4 | 12.5 | 36.0 | 10.9 | 4.5 | 21.7 |
| 119 | A | 10.7 | 5.5 | 19.8 | 10.7 | 5.5 | 19.8 |

*Alloy formed from Nd-15%, B-8%, Fe-remainder (here % is atomic %)
A is absent, P is present
↑ indicates values outside of the range of the present invention

TABLE 14-1

| SAMPLE | NiO POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ | TOTAL | R—B—Fe* ALLOY POWDER | RUST STATE | MAGNETIC PROPERTIES Before Corrosion Test Br (KG) | iHe (KOe) | BH max (MGOe) | After Corrosion Test Br (KG) | iHe (KOe) | BH max (MGOe) |
|---|---|---|---|---|---|---|---|---|---|---|---|---|---|---|---|---|---|---|---|---|---|---|---|
| EXAMPLES | | | | | | | | | | | | | | | | | | | | | | | |
| 301 | 0.0006 | 2.9 | — | — | — | — | — | — | — | — | — | — | — | — | 2.9 | remainder | absent | 12.2 | 21.8 | 35.5 | 12.2 | 21.6 | 35.4 |
| 302 | 0.01 | 2.0 | — | — | — | — | — | — | — | — | — | — | — | — | 2.0 | ↑ | ↑ | 12.2 | 21.5 | 35.2 | 12.2 | 21.4 | 35.1 |
| 303 | 0.1 | 1.0 | — | — | — | — | — | — | — | — | — | — | — | — | 1.0 | ↑ | ↑ | 12.3 | 21.8 | 36.4 | 12.2 | 21.5 | 36.0 |
| 304 | 1.3 | 0.01 | — | — | — | — | — | — | — | — | — | — | — | — | 0.01 | ↑ | ↑ | 12.2 | 21.6 | 35.3 | 12.2 | 21.5 | 35.2 |
| 305 | 2.5 | 0.0005 | — | — | — | — | — | — | — | — | — | — | — | — | 0.005 | ↑ | ↑ | 12.2 | 21.4 | 35.1 | 12.2 | 21.3 | 35.0 |
| 306 | 0.0005 | — | 1.0 | — | — | — | — | — | — | — | — | — | — | — | 1.0 | ↑ | ↑ | 12.2 | 21.6 | 35.3 | 12.2 | 12.4 | 35.1 |
| 307 | 0.05 | — | 2.8 | — | — | — | — | — | — | — | — | — | — | — | 2.8 | ↑ | ↑ | 12.3 | 21.8 | 36.4 | 12.2 | 21.7 | 35.4 |
| 308 | 0.5 | — | 2.1 | — | — | — | — | — | — | — | — | — | — | — | 2.1 | ↑ | ↑ | 12.3 | 21.7 | 36.3 | 12.2 | 21.5 | 35.2 |
| 309 | 1.4 | — | 0.05 | — | — | — | — | — | — | — | — | — | — | — | 0.05 | ↑ | ↑ | 12.2 | 21.8 | 35.5 | 12.2 | 21.7 | 35.4 |
| 310 | 2.4 | — | 0.0006 | — | — | — | — | — | — | — | — | — | — | — | 0.0006 | ↑ | ↑ | 12.2 | 21.5 | 35.2 | 12.2 | 21.2 | 35.0 |
| 311 | 0.0006 | — | — | 2.1 | — | — | — | — | — | — | — | — | — | — | 2.1 | ↑ | ↑ | 12.3 | 21.4 | 36.0 | 12.2 | 21.2 | 35.0 |
| 312 | 0.009 | — | — | 3.0 | — | — | — | — | — | — | — | — | — | — | 3.0 | ↑ | ↑ | 12.3 | 21.5 | 36.1 | 12.2 | 21.3 | 35.1 |
| 313 | 0.1 | — | — | 1.0 | — | — | — | — | — | — | — | — | — | — | 1.0 | ↑ | ↑ | 12.2 | 21.3 | 35.1 | 12.2 | 21.2 | 35.0 |
| 314 | 1.6 | — | — | 0.06 | — | — | — | — | — | — | — | — | — | — | 0.06 | ↑ | ↑ | 12.2 | 21.2 | 35.0 | 12.2 | 21.0 | 34.8 |
| 315 | 2.4 | — | — | 0.0007 | — | — | — | — | — | — | — | — | — | — | 0.0007 | ↑ | ↑ | 12.2 | 21.3 | 35.1 | 12.2 | 21.1 | 34.9 |
| 316 | 0.0007 | — | — | — | 1.1 | — | — | — | — | — | — | — | — | — | 1.1 | ↑ | ↑ | 12.3 | 21.6 | 36.2 | 12.2 | 21.5 | 35.3 |
| 317 | 0.01 | — | — | — | 3.0 | — | — | — | — | — | — | — | — | — | 3.0 | ↑ | ↑ | 12.3 | 21.8 | 36.4 | 12.2 | 21.2 | 35.0 |
| 318 | 0.5 | — | — | — | 2.3 | — | — | — | — | — | — | — | — | — | 2.3 | ↑ | ↑ | 12.2 | 21.5 | 35.2 | 12.2 | 21.3 | 35.0 |
| 319 | 1.5 | — | — | — | 0.1 | — | — | — | — | — | — | — | — | — | 0.1 | ↑ | ↑ | 12.2 | 21.5 | 35.2 | 12.2 | 21.1 | 35.0 |

*Alloy formed from Nd-13.5%, Dy-1.5%, B-8%, Fe-remainder (here % is atomic %)

TABLE 14-2

| SAMPLE | NiO POWDER | CrN | $MnN_4$ | ZrN | HfN | TiN | NbN | $Ni_2N$ | $Si_3N_4$ | GeN | VN | GaN | AlN | $Co_3N$ | | R—B—Fe* ALLOY POWDER | RUST STATE | Br (KG) | iHe (KOe) | BH max (MGOe) | Br (KG) | iHe (KOe) | BH max (MGOe) |
|---|---|---|---|---|---|---|---|---|---|---|---|---|---|---|---|---|---|---|---|---|---|---|---|
| | COMPOSITION OF THE POWDER (WEIGHT %) | | | | | | | | | | | | | | | | | MAGNETIC PROPERTIES | | | | | |
| | | NITRIDE POWDERS | | | | | | | | | | | | | | | | Before Corrosion Test | | | After Corrosion Test | | |
| EXAMPLES | | | | | | | | | | | | | | | | | | | | | | | |
| 320 | 2.3 | — | — | — | 0.0006 | — | — | — | — | — | — | — | — | — | 0.0006 | remainder | absent | 12.1 | 20.8 | 35.0 | 12.1 | 20.8 | 35.0 |
| 321 | 0.0005 | — | — | — | — | 0.05 | — | — | — | — | — | — | — | — | 0.05 | ↑ | ↑ | 12.2 | 21.3 | 35.3 | 12.1 | 20.7 | 34.8 |
| 322 | 0.05 | — | — | — | — | 2.8 | — | — | — | — | — | — | — | — | 2.4 | ↑ | ↑ | 12.2 | 21.6 | 35.5 | 12.2 | 21.3 | 35.3 |
| 323 | 0.5 | — | — | — | — | 1.4 | — | — | — | — | — | — | — | — | 1.4 | ↑ | ↑ | 12.1 | 21.8 | 35.3 | 12.1 | 21.5 | 35.2 |
| 324 | 1.3 | — | — | — | — | 0.4 | — | — | — | — | — | — | — | — | 0.4 | ↑ | ↑ | 12.1 | 21.5 | 35.2 | 12.1 | 21.5 | 35.2 |
| 325 | 2.4 | — | — | — | — | 0.0005 | — | — | — | — | — | — | — | — | 0.0005 | ↑ | ↑ | 12.0 | 20.5 | 34.8 | 12.0 | 20.5 | 34.8 |
| 326 | 0.0005 | — | — | — | — | — | 3.0 | — | — | — | — | — | — | — | 3.0 | ↑ | ↑ | 12.1 | 21.8 | 35.6 | 12.1 | 21.5 | 35.2 |
| 327 | 0.05 | — | — | — | — | — | 1.5 | — | — | — | — | — | — | — | 1.5 | ↑ | ↑ | 12.1 | 21.6 | 35.3 | 12.1 | 21.5 | 35.2 |
| 328 | 0.5 | — | — | — | — | — | 0.6 | — | — | — | — | — | — | — | 0.6 | ↑ | ↑ | 12.2 | 21.6 | 35.5 | 12.2 | 21.5 | 35.5 |
| 329 | 1.5 | — | — | — | — | — | 0.005 | — | — | — | — | — | — | — | 0.005 | ↑ | ↑ | 12.2 | 21.5 | 35.5 | 12.2 | 21.3 | 35.4 |
| 330 | 2.5 | — | — | — | — | — | 0.0005 | — | — | — | — | — | — | — | 0.0005 | ↑ | ↑ | 12.2 | 21.5 | 35.5 | 12.2 | 21.2 | 35.2 |
| 331 | 0.0005 | — | — | — | — | — | — | 1.5 | — | — | — | — | — | — | 1.5 | ↑ | ↑ | 12.2 | 21.3 | 35.4 | 12.2 | 21.2 | 35.3 |
| 332 | 0.05 | — | — | — | — | — | — | 2.9 | — | — | — | — | — | — | 2.9 | ↑ | ↑ | 12.2 | 21.2 | 35.2 | 12.2 | 21.0 | 35.0 |
| 333 | 0.6 | — | — | — | — | — | — | 0.6 | — | — | — | — | — | — | 0.6 | ↑ | ↑ | 12.2 | 21.6 | 35.5 | 12.2 | 21.4 | 35.4 |
| 334 | 1.5 | — | — | — | — | — | — | 0.05 | — | — | — | — | — | — | 0.05 | ↑ | ↑ | 12.2 | 21.5 | 35.5 | 12.2 | 21.3 | 35.3 |
| 335 | 2.4 | — | — | — | — | — | — | 0.0007 | — | — | — | — | — | — | 0.0007 | ↑ | ↑ | 12.2 | 21.5 | 35.5 | 12.1 | 21.3 | 35.3 |
| 336 | 0.0005 | — | — | — | — | — | — | — | 3.0 | — | — | — | — | — | 3.0 | ↑ | ↑ | 12.1 | 21.4 | 35.2 | 12.1 | 21.3 | 35.1 |
| 337 | 0.05 | — | — | — | — | — | — | — | 1.5 | — | — | — | — | — | 1.5 | ↑ | ↑ | 12.1 | 21.3 | 35.1 | 12.1 | 21.2 | 35.0 |
| 338 | 0.5 | — | — | — | — | — | — | — | 0.5 | — | — | — | — | — | 0.5 | ↑ | ↑ | 12.1 | 21.2 | 35.0 | 12.1 | 21.1 | 35.0 |

*Alloy formed from Nd-13.5%, Dy-1.5%, B-8%, Fe-remainder (here % is atomic %)

TABLE 14-3

| SAMPLE | NiO POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ | TOTAL | R—B—Fe* ALLOY POWDER | RUST STATE | MAGNETICAL PROPERTIES Before Corrosion Test Br (KG) | iHc (KOe) | BH max (MGOe) | After Corrosion Test Br (KG) | iHc (KOe) | BH max (MGOe) |
|---|---|---|---|---|---|---|---|---|---|---|---|---|---|---|---|---|---|---|---|---|---|---|---|
| EXAMPLES | | | | | | | | | | | | | | | | | | | | | | | |
| 339 | 1.3 | — | — | — | — | — | — | — | 0.03 | — | — | — | — | — | 0.03 | remainder | absent | 12.1 | 21.3 | 35.1 | 12.1 | 21.1 | 35.0 |
| 340 | 2.5 | — | — | — | — | — | — | — | 0.00006 | — | — | — | — | — | 0.0006 | ↑ | ↑ | 12.1 | 21.3 | 35.1 | 12.1 | 21.2 | 35.0 |
| 341 | 0.0005 | — | — | — | — | — | — | — | — | 0.5 | — | — | — | — | 0.5 | ↑ | ↑ | 12.2 | 21.2 | 35.2 | 12.1 | 21.0 | 34.9 |
| 342 | 0.05 | — | — | — | — | — | — | — | — | 3.0 | — | — | — | — | 3.0 | ↑ | ↑ | 12.2 | 21.1 | 35.1 | 12.2 | 21.0 | 35.0 |
| 343 | 0.5 | — | — | — | — | — | — | — | — | 2.1 | — | — | — | — | 2.1 | ↑ | ↑ | 12.2 | 21.0 | 35.0 | 12.2 | 21.0 | 35.0 |
| 344 | 1.4 | — | — | — | — | — | — | — | — | 1.3 | — | — | — | — | 1.3 | ↑ | ↑ | 12.2 | 21.0 | 35.0 | 12.1 | 20.9 | 34.8 |
| 345 | 2.5 | — | — | — | — | — | — | — | — | 0.0006 | — | — | — | — | 0.0006 | ↑ | ↑ | 12.1 | 21.2 | 35.2 | 12.1 | 21.0 | 34.9 |
| 346 | 0.0006 | — | — | — | — | — | — | — | — | — | 3.0 | — | — | — | 3.0 | ↑ | ↑ | 12.2 | 22.0 | 36.1 | 12.2 | 21.8 | 36.0 |
| 347 | 0.04 | — | — | — | — | — | — | — | — | — | 2.0 | — | — | — | 2.0 | ↑ | ↑ | 12.2 | 21.8 | 35.7 | 12.2 | 21.6 | 35.3 |
| 348 | 0.5 | — | — | — | — | — | — | — | — | — | 1.0 | — | — | — | 1.0 | ↑ | ↑ | 12.3 | 22.0 | 36.2 | 12.3 | 21.8 | 36.0 |
| 349 | 1.3 | — | — | — | — | — | — | — | — | — | 0.05 | — | — | — | 0.05 | ↑ | ↑ | 12.2 | 22.3 | 36.1 | 12.2 | 22.2 | 36.1 |
| 350 | 2.4 | — | — | — | — | — | — | — | — | — | 0.0005 | — | — | — | 0.0005 | ↑ | ↑ | 12.1 | 20.5 | 34.7 | 12.1 | 20.5 | 34.7 |
| 351 | 0.0005 | — | — | — | — | — | — | — | — | — | — | 1.7 | — | — | 1.7 | ↑ | ↑ | 12.2 | 22.1 | 36.1 | 12.1 | 21.5 | 35.2 |
| 352 | 0.07 | — | — | — | — | — | — | — | — | — | — | 2.9 | — | — | 2.9 | ↑ | ↑ | 12.2 | 22.5 | 36.4 | 12.2 | 22.2 | 36.0 |
| 353 | 1.1 | — | — | — | — | — | — | — | — | — | — | 0.01 | — | — | 0.01 | ↑ | ↑ | 12.2 | 22.0 | 36.1 | 12.1 | 21.8 | 35.5 |
| 354 | 1.8 | — | — | — | — | — | — | — | — | — | — | 0.2 | — | — | 0.2 | ↑ | ↑ | 12.2 | 22.0 | 36.1 | 12.2 | 21.5 | 35.5 |
| 355 | 2.3 | — | — | — | — | — | — | — | — | — | — | 0.0005 | — | — | 0.0005 | ↑ | ↑ | 12.2 | 21.3 | 35.4 | 12.1 | 21.0 | 34.9 |
| 356 | 0.0005 | — | — | — | — | — | — | — | — | — | — | — | 2.8 | — | 2.8 | ↑ | ↑ | 12.2 | 21.8 | 35.5 | 12.1 | 21.0 | 34.9 |
| 357 | 0.05 | — | — | — | — | — | — | — | — | — | — | — | 1.6 | — | 1.6 | ↑ | ↑ | 12.2 | 22.0 | 35.7 | 12.1 | 22.0 | 35.2 |

*Alloy formed from Nd-13.5%, Dy-1.5%, B-8%, Fe-remainder (here % is atomic %)

TABLE 14-4

| SAMPLE | NiO POWDER | COMPOSITION OF THE POWDER (WEIGHT %) NITRIDE POWDERS CrN | MnN4 | ZrN | HfN | TiN | NbN | Ni2N | Si3N4 | GeN | VN | GaN | AlN | Co3N | TOTAL | R—B—Fe* ALLOY POWDER | RUST STATE | MAGNETICAL PROPERTIES Before Corrosion Test Br (KG) | iHc (KOe) | BH max (MGOe) | After Corrosion Test Br (KG) | iHc (KOe) | BH max (MGOe) |
|---|---|---|---|---|---|---|---|---|---|---|---|---|---|---|---|---|---|---|---|---|---|---|---|
| EXAMPLES | | | | | | | | | | | | | | | | | | | | | | | |
| 358 | 0.1 | — | — | — | — | — | — | — | — | — | — | — | 0.5 | — | 0.5 | remainder | absent | 12.1 | 22.2 | 35.2 | 12.1 | 22.1 | 35.2 |
| 359 | 1.5 | — | — | — | — | — | — | — | — | — | — | — | 0.01 | — | 0.01 | ↑ | ↑ | 12.1 | 21.7 | 35.0 | 12.1 | 21.7 | 35.0 |
| 360 | 2.4 | — | — | — | — | — | — | — | — | — | — | — | 0.0005 | — | 0.0005 | ↑ | ↑ | 12.0 | 21.5 | 34.8 | 12.0 | 21.5 | 34.8 |
| 361 | 0.0006 | — | — | — | — | — | — | — | — | — | — | — | — | 0.01 | 0.01 | ↑ | ↑ | 12.1 | 21.5 | 35.0 | 12.1 | 21.3 | 34.8 |
| 362 | 0.02 | — | — | — | — | — | — | — | — | — | — | — | — | 1.1 | 1.1 | ↑ | ↑ | 12.2 | 21.6 | 35.5 | 12.1 | 21.4 | 34.9 |
| 363 | 0.8 | — | — | — | — | — | — | — | — | — | — | — | — | 2.9 | 2.9 | ↑ | ↑ | 12.2 | 21.9 | 35.9 | 12.2 | 21.8 | 35.2 |
| 364 | 1.6 | — | — | — | — | — | — | — | — | — | — | — | — | 2.0 | 2.0 | ↑ | ↑ | 12.2 | 21.8 | 35.5 | 12.1 | 21.5 | 35.0 |
| 365 | 2.4 | — | — | — | — | — | — | — | — | — | — | — | — | 0.0005 | 0.0005 | ↑ | ↑ | 12.1 | 21.5 | 35.2 | 12.0 | 21.4 | 34.7 |
| 366 | 1.2 | 0.6 | 0.5 | — | — | — | — | — | — | — | — | — | — | — | 1.1 | ↑ | ↑ | 12.2 | 21.3 | 35.3 | 12.2 | 21.2 | 35.2 |
| 367 | 1.2 | 0.5 | — | 0.5 | — | 0.3 | — | — | — | — | — | — | — | — | 1.3 | ↑ | ↑ | 12.2 | 21.2 | 35.2 | 12.2 | 21.1 | 35.2 |
| 368 | 1.2 | 1.1 | — | 0.3 | 0.3 | — | 0.1 | — | 0.1 | — | — | — | — | — | 1.9 | ↑ | ↑ | 12.2 | 21.3 | 35.3 | 12.2 | 21.1 | 35.2 |
| 369 | 1.2 | — | 0.5 | — | — | — | — | — | — | — | 1.3 | — | — | 0.01 | 1.81 | ↑ | ↑ | 12.2 | 21.7 | 35.6 | 12.2 | 21.5 | 35.5 |
| 370 | 1.2 | — | — | 0.6 | — | — | 0.5 | — | — | 1.1 | — | — | 0.1 | — | 2.3 | ↑ | ↑ | 12.2 | 21.6 | 35.5 | 12.2 | 21.5 | 35.5 |
| 371 | 1.2 | 0.1 | — | — | 0.2 | — | — | — | 1.1 | — | — | 0.9 | — | — | 2.3 | ↑ | ↑ | 12.1 | 21.8 | 35.3 | 12.1 | 21.5 | 35.0 |
| 372 | 1.2 | — | — | — | 0.007 | 1.0 | — | 0.9 | — | — | 0.05 | — | — | 0.06 | 2.017 | ↑ | ↑ | 12.2 | 21.7 | 35.5 | 12.2 | 21.5 | 35.3 |
| 373 | 1.2 | 0.01 | — | 0.3 | — | — | 0.8 | — | — | 0.6 | — | — | 0.03 | — | 1.74 | ↑ | ↑ | 12.1 | 21.2 | 34.9 | 12.1 | 21.0 | 34.8 |
| 374 | 1.2 | — | 0.2 | — | — | 0.001 | — | 1.5 | 0.8 | — | — | 0.02 | — | 0.01 | 2.531 | ↑ | ↑ | 12.2 | 21.5 | 35.3 | 12.2 | 21.3 | 35.2 |
| 375 | 1.2 | 1.9 | — | — | 0.001 | — | — | 0.7 | 0.01 | — | 0.1 | — | 0.01 | — | 2.721 | ↑ | ↑ | 12.2 | 21.7 | 35.5 | 12.2 | 21.5 | 35.3 |
| 376 | 1.2 | — | — | 0.09 | — | — | 0.005 | — | — | 0.001 | — | 0.04 | — | — | 1.136 | ↑ | ↑ | 12.2 | 21.3 | 35.3 | 12.1 | 21.0 | 34.8 |

*Alloy formed from Nd-13.5%, Dy-1.5%, B-8%, Fe-remainder (here % is atomic %)

TABLE 14-5

| SAMPLE | NiO POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ |
|---|---|---|---|---|---|---|---|---|---|---|---|---|---|---|
| EXAMPLES | | | | | | | | | | | | | | |
| 377 | 1.2 | — | — | — | 1.6 | — | — | — | — | — | — | — | — | 1.4 |
| 378 | 1.2 | — | — | 0.7 | — | — | — | — | — | — | — | — | 1.2 | — |
| 379 | 1.2 | — | 1.8 | — | — | — | — | — | — | — | — | 0.9 | — | — |
| 380 | 1.2 | 1.3 | — | — | — | — | — | — | — | — | 0.6 | — | — | — |
| 381 | 1.2 | 0.1 | 0.1 | 0.3 | 0.1 | 0.2 | 0.1 | 0.3 | 0.3 | 0.3 | 0.1 | 0.1 | 0.1 | 0.1 |
| COMPARATIVE EXAMPLES | | | | | | | | | | | | | | |
| 120 | 0.0002 | 0.9 | — | — | — | — | — | — | — | — | — | — | — | — |
| 121 | 3.1 | — | 0.9 | — | — | — | — | — | — | — | — | — | — | — |
| 122 | 1.2 | 0.0003 | — | — | — | — | — | — | — | — | — | — | — | — |
| 123 | 1.2 | 3.3 | — | — | — | — | — | — | — | — | — | — | — | — |
| 124 | 1.2 | — | 0.0002 | — | — | — | — | — | — | — | — | — | — | — |
| 125 | 1.2 | — | 3.2 | — | — | — | — | — | — | — | — | — | — | — |
| 126 | 1.2 | — | — | 0.0003 | — | — | — | — | — | — | — | — | — | — |
| 127 | 1.2 | — | — | 3.3 | — | — | — | — | — | — | — | — | — | — |
| 128 | 1.2 | — | — | — | 0.0002 | — | — | — | — | — | — | — | — | — |
| 129 | 1.2 | — | — | — | 3.2 | — | — | — | — | — | — | — | — | — |
| 130 | 1.2 | — | — | — | — | 0.0003 | — | — | — | — | — | — | — | — |
| 131 | 1.2 | — | — | — | — | 3.3 | — | — | — | — | — | — | — | — |
| 132 | 1.2 | — | — | — | — | — | 0.0001 | — | — | — | — | — | — | — |
| 133 | 1.2 | — | — | — | — | — | 3.2 | — | — | — | — | — | — | — |

| SAMPLE | COMPOSITION OF POWDER (WEIGHT %) NITRIDE POWDERS TOTAL | R—B—Fe* ALLOY POWDER | RUST STATE | MAGNETICAL PROPERTIES Before Corrosion Test Br (KG) | iHc (KOe) | BH max (MGOe) | After Corrosion Test Br (KG) | iHc (KOe) | BH max (MGOe) |
|---|---|---|---|---|---|---|---|---|---|
| EXAMPLES | | | | | | | | | |
| 377 | 3.0 | remainder | A | 12.1 | 21.5 | 35.0 | 12.1 | 21.4 | 34.9 |
| 378 | 1.9 | ↑ | ↑ | 12.2 | 21.8 | 35.5 | 12.2 | 21.6 | 35.4 |
| 379 | 2.7 | ↑ | ↑ | 12.1 | 22.0 | 35.5 | 12.1 | 22.0 | 35.5 |
| 380 | 1.9 | ↑ | ↑ | 12.2 | 21.9 | 35.6 | 12.2 | 21.8 | 35.5 |
| 381 | 2.2 | ↑ | ↑ | 12.1 | 21.4 | 34.9 | 12.1 | 21.2 | 34.7 |
| COMPARATIVE EXAMPLES | | | | | | | | | |
| 120 | 0.9 | ↑ | P | 12.1 | 20.3 | 34.8 | 10.5 | 10.2 | 23.5 |
| 121 | 0.9 | ↑ | A | 10.4 | 8.8 | 22.4 | 10.4 | 8.8 | 22.4 |
| 122 | 0.0003 | ↑ | P | 12.1 | 20.3 | 34.8 | 10.4 | 9.8 | 22.7 |
| 123 | 3.3 | ↑ | A | 10.3 | 10.5 | 22.0 | 10.3 | 10.5 | 22.0 |
| 124 | 0.0002 | ↑ | P | 12.0 | 20.4 | 34.7 | 10.3 | 9.9 | 21.5 |
| 125 | 3.2 | ↑ | A | 10.4 | 10.1 | 21.8 | 10.4 | 10.1 | 21.8 |
| 126 | 0.0003 | ↑ | P | 12.0 | 20.3 | 34.6 | 10.3 | 10.1 | 21.7 |
| 127 | 3.3 | ↑ | A | 10.3 | 9.8 | 21.0 | 10.3 | 9.8 | 21.0 |
| 128 | 0.0002 | ↑ | P | 12.0 | 20.4 | 34.7 | 10.4 | 9.8 | 21.5 |
| 129 | 3.2 | ↑ | A | 10.4 | 10.2 | 22.0 | 10.4 | 10.2 | 22.0 |
| 130 | 0.0003 | ↑ | P | 12.0 | 20.2 | 34.8 | 10.4 | 10.5 | 22.2 |
| 131 | 3.3 | ↑ | A | 10.5 | 10.3 | 22.9 | 10.5 | 10.3 | 22.9 |
| 132 | 0.0001 | ↑ | P | 12.0 | 20.7 | 34.9 | 10.4 | 10.5 | 22.2 |
| 133 | 3.2 | ↑ | A | 10.5 | 10.8 | 23.8 | 10.5 | 10.8 | 23.8 |

*Alloy formed forn Nd-13.5%, Dy-1.5%, B-8%, Fe-remainder (here % is atomic %)
indicates values outside of the range of the present invention
A is absent, P is present
indicates values outside of the range of the present invention

TABLE 14-6

| SAMPLE | NiO POWDER | COMPOSITION OF THE POWDER (WEIGHT %) NITRIDE POWDERS CrN | $MnN_4$ | ZrN | HfN | TiN | NbN | $Ni_2N$ | $Si_3N_4$ | GeN | VN | GaN | AlN | $Co_3N$ |
|---|---|---|---|---|---|---|---|---|---|---|---|---|---|---|
| EXAMPLES | | | | | | | | | | | | | | |
| 134 | 1.2 | — | — | — | — | — | — | 0.0003 | — | — | — | — | — | — |
| 135 | 1.2 | — | — | — | — | — | — | 3.3 | — | — | — | — | — | — |
| 136 | 1.3 | — | — | — | — | — | — | — | 0.0002 | — | — | — | — | — |
| 137 | 1.2 | — | — | — | — | — | — | — | 3.3 | — | — | — | — | — |
| 138 | 1.2 | — | — | — | — | — | — | — | — | 0.0003 | — | — | — | — |
| 139 | 1.2 | — | — | — | — | — | — | — | — | 3.3 | — | — | — | — |
| 140 | 1.2 | — | — | — | — | — | — | — | — | — | 0.0002 | — | — | — |
| 141 | 1.2 | — | — | — | — | — | — | — | — | — | 3.2 | — | — | — |
| 142 | 1.2 | — | — | — | — | — | — | — | — | — | — | 0.0003 | — | — |
| 143 | 1.2 | — | — | — | — | — | — | — | — | — | — | 3.3 | — | — |
| 144 | 1.2 | — | — | — | — | — | — | — | — | — | — | — | 0.0001 | — |
| 145 | 1.2 | — | — | — | — | — | — | — | — | — | — | — | 3.2 | — |
| 146 | 1.2 | — | — | — | — | — | — | — | — | — | — | — | — | 0.0002 |

TABLE 14-6-continued

| | | | | | | | | | | | | | | |
|---|---|---|---|---|---|---|---|---|---|---|---|---|---|---|
| 147 | 1.2 | — | — | — | — | — | — | — | — | — | — | — | — | 3.3 |
| 148 | 1.2 | 0.5 | 0.5 | — | — | 0.5 | — | 0.5 | 0.5 | — | 0.5 | — | 0.5 | — |
| 149 | — | 0.5 | — | 0.5 | — | 0.5 | — | — | — | — | — | — | — | — |
| 150 | — | — | — | — | — | — | — | — | — | — | — | — | — | — |

| | COMPOSITION OF THE POWDER (WEIGHT %) | | | MAGNETICAL PROPERTIES | | | | | |
|---|---|---|---|---|---|---|---|---|---|
| | NITRIDE | R-B—Fe* | | Before Corrosion Test | | | After Corrosion Test | | |
| SAMPLE | POWDERS TOTAL | ALLOY POWDER | RUST STATE | Br (KG) | iHc (KOc) | BH max (MGOe) | Br (KG) | iHc (KOc) | BH max (MGOe) |
| EXAMPLES | | | | | | | | | |
| 134 | 0.0003 | remainder | present | 12.0 | 20.4 | 34.8 | 10.5 | 10.4 | 23.1 |
| 135 | 3.3 | ↑ | absent | 10.4 | 9.5 | 21.0 | 10.4 | 9.5 | 21.0 |
| 136 | 0.0002 | ↑ | present | 12.0 | 20.3 | 34.6 | 10.5 | 9.8 | 22.3 |
| 137 | 3.3 | ↑ | absent | 10.3 | 10.1 | 22.0 | 10.3 | 10.1 | 22.0 |
| 138 | 0.0003 | ↑ | present | 12.0 | 20.4 | 34.7 | 10.5 | 9.0 | 21.5 |
| 139 | 3.3 | ↑ | absent | 10.3 | 10.5 | 21.9 | 10.3 | 10.5 | 21.9 |
| 140 | 0.0002 | ↑ | present | 12.0 | 20.5 | 34.8 | 10.4 | 10.1 | 21.8 |
| 141 | 3.2 | ↑ | absent | 10.4 | 10.9 | 23.0 | 10.4 | 10.9 | 23.0 |
| 412 | 0.0003 | ↑ | present | 12.0 | 20.6 | 34.8 | 10.4 | 9.8 | 21.5 |
| 143 | 3.3 | ↑ | absent | 10.3 | 10.7 | 22.1 | 10.3 | 10.7 | 22.1 |
| 144 | 0.0001 | ↑ | present | 12.0 | 20.6 | 34.8 | 10.3 | 9.8 | 21.3 |
| 145 | 3.2 | ↑ | absent | 10.4 | 10.5 | 22.2 | 10.4 | 10.5 | 22.2 |
| 146 | 0.0002 | ↑ | present | 12.0 | 20.3 | 34.7 | 10.2 | 9.0 | 19.8 |
| 147 | 3.3 | ↑ | absent | 10.3 | 9.5 | 20.8 | 10.3 | 9.5 | 20.8 |
| 148 | 3.5 | ↑ | absent | 10.4 | 10.3 | 22.1 | 10.4 | 10.3 | 22.1 |
| 149 | 1.5 | ↑ | present | 12.0 | 20.9 | 35.0 | 10.4 | 10.5 | 22.2 |
| 150 | — | ↑ | heavy | 12.0 | 20.2 | 34.5 | 10.5 | 8.1 | 22.1 |

*Alloy formed from Nd-13.5%, Dy-1.5%, B-8%, Fe-remainder (here % is atomic %)
indicates values outside of the range of the present invention

TABLE 15

| SAMPLE | COMPOSITION OF THE POWDER (WEIGHT %) OXIDE POWDERS $Cr_2O_3$ | NiO | | NITRIDE POWDERS CrN | $MnN_4$ | ZrN | HfN | TiN | NbN | $Ni_2N$ | $Si_3N_4$ | GeN | V N | GaN | AlN | $Co_3N$ | TOTAL | R—B—Fe* ALLOY POWDER |
|---|---|---|---|---|---|---|---|---|---|---|---|---|---|---|---|---|---|---|
| EXAMPLES | | | | | | | | | | | | | | | | | | |
| 382 | 0.0003 | 0.0003 | 0.0006 | 0.0001 | — | 0.0001 | 0.0001 | 0.0001 | — | — | — | — | 0.0001 | 0.0001 | 0.0001 | — | 0.0007 | remainder |
| 383 | 0.0008 | 0.0002 | 0.001 | 2.0 | — | — | — | — | 0.1 | — | 0.1 | 0.1 | — | 0.4 | 0.1 | 0.1 | 2.9 | ↑ |
| 384 | 0.008 | 0.002 | 0.001 | 0.6 | — | — | — | 0.9 | — | — | — | — | — | 1.0 | — | — | 2.5 | ↑ |
| 385 | 0.01 | 0.03 | 0.04 | — | — | — | 0.7 | — | 1.0 | — | — | — | — | — | — | — | 1.7 | ↑ |
| 386 | 0.05 | 0.05 | 0.1 | — | 0.1 | — | — | — | — | — | 0.1 | 0.1 | — | — | — | — | 0.3 | ↑ |
| 387 | 0.4 | 0.6 | 1.0 | 1.0 | 0.1 | 0.1 | 0.1 | 0.1 | 0.1 | 0.1 | 0.1 | 0.1 | 0.1 | 0.1 | 0.1 | 0.1 | 2.2 | ↑ |
| 388 | 0.5 | 1.0 | 1.5 | 0.1 | — | — | 0.3 | — | 0.3 | — | — | — | — | — | — | — | 0.7 | ↑ |
| 389 | 0.3 | 0.1 | 0.4 | 0.3 | — | 0.7 | — | — | — | — | — | — | — | — | — | — | 1.0 | ↑ |
| 390 | 0.5 | 0.4 | 0.9 | — | — | 1.0 | — | 1.0 | — | — | — | — | 0.2 | — | — | — | 2.2 | ↑ |
| 391 | 0.5 | 1.4 | 1.9 | 1.0 | — | — | 0.8 | — | — | — | 0.05 | — | 0.05 | — | — | — | 1.9 | ↑ |
| 392 | 2.0 | 0.3 | 2.3 | — | — | — | — | — | — | — | — | — | — | 1.2 | 0.4 | — | 1.6 | ↑ |
| 393 | 2.0 | 1.5 | 2.5 | 1.7 | 0.1 | 0.1 | 0.1 | 0.1 | 0.1 | 0.1 | 0.1 | 0.1 | 0.1 | 0.1 | 0.1 | 0.1 | 2.9 | ↑ |
| 394 | 0.3 | 0.4 | 0.7 | 0.03 | — | — | — | 0.03 | — | — | — | — | — | — | 0.02 | — | 0.08 | ↑ |
| COMPARATIVE EXAMPLES | | | | | | | | | | | | | | | | | | |
| 151 | 0.3 | 0.1 | 0.4 | 0.0001 | 0.0001 | — | — | — | — | — | — | — | — | — | — | — | 0.0002 | ↑ |
| 152 | 2.0 | 1.1 | 31. | 1.0 | — | — | 1.0 | — | — | — | — | — | — | — | — | 1.0 | 3.0 | ↑ |
| 153 | 0.08 | 0.02 | 0.1 | 2.0 | 0.1 | 0.1 | 0.1 | 0.1 | 0.1 | 0.1 | 0.1 | 0.1 | 0.1 | 0.1 | 0.1 | 0.1 | 3.2 | ↑ |
| 154 | 0.0002 | 0.0002 | 0.0004 | 2.0 | — | — | — | — | — | 0.3 | — | — | — | — | 0.2 | — | 2.5 | ↑ |
| 155 | 0.0001 | 0.0001 | 0.0002 | 0.0001 | — | — | — | 0.0001 | — | — | — | — | — | — | — | — | 0.0002 | ↑ |
| 154 | 1.4 | 1.9 | 3.3 | 2.0 | — | 0.3 | — | 0.3 | — | 0.3 | — | 0.3 | — | — | 0.3 | — | 3.5 | ↑ |

*Alloy formed from Nd-13.5%, Dy-1.5%, B-8%, Fe-remainder (here % is atomic %)
indicates values outside of the range of the present invention

TABLE 16

| SAMPLE | RUST STATE | MAGNETICAL PROPERTIES PRIOR TO ANTI-CORROSION TEST Br (KG) | iHc (KOe) | BH max (MGOe) | AFTER ANTI-CORROSION TEST Br (KG) | iHc (KOe) | BH max (MGOe) |
|---|---|---|---|---|---|---|---|
| EXAMPLES | | | | | | | |
| 382 | absent | 12.2 | 21.5 | 35.5 | 12.2 | 21.3 | 35.3 |
| 383 | ↑ | 12.1 | 19.6 | 34.9 | 12.1 | 19.6 | 34.9 |
| 384 | ↑ | 12.2 | 22.0 | 35.8 | 12.2 | 21.8 | 35.6 |
| 385 | ↑ | 12.2 | 21.3 | 35.3 | 12.2 | 21.2 | 35.2 |
| 386 | ↑ | 12.2 | 21.3 | 35.3 | 12.2 | 21.2 | 35.2 |
| 387 | ↑ | 12.2 | 21.3 | 35.3 | 12.1 | 19.8 | 34.5 |
| 388 | ↑ | 12.2 | 21.4 | 35.4 | 12.2 | 21.4 | 35.4 |
| 389 | ↑ | 12.2 | 21.6 | 35.6 | 12.1 | 21.3 | 35.0 |
| 390 | ↑ | 12.2 | 21.1 | 35.2 | 12.2 | 20.8 | 35.2 |
| 391 | ↑ | 12.2 | 21.3 | 35.3 | 12.1 | 19.8 | 34.5 |
| 392 | ↑ | 12.3 | 20.8 | 36.3 | 12.3 | 20.5 | 36.0 |
| 393 | ↑ | 12.3 | 20.8 | 36.3 | 12.3 | 20.8 | 36.3 |
| 394 | ↑ | 12.2 | 21.6 | 35.5 | 12.1 | 21.3 | 35.3 |
| COMPARATIVE EXAMPLES | | | | | | | |
| 151 | ↑ | 12.1 | 20.1 | 35.0 | 11.1 | 12.2 | 22.0 |
| 152 | ↑ | 10.1 | 12.0 | 20.1 | 10.1 | 11.8 | 20.0 |
| 153 | ↑ | 10.5 | 12.1 | 23.2 | 10.5 | 12.0 | 23.1 |
| 154 | present | 12.3 | 21.1 | 36.5 | 10.6 | 12.3 | 22.1 |
| 155 | absent | 12.1 | 22.2 | 35.2 | 12.1 | 21.5 | 35.0 |
| 156 | ↑ | 10.8 | 8.9 | 20.2 | 10.8 | 8.9 | 20.0 |

TABLE 17

| SAMPLE | Boundary Phase Composition (weight %) Matellic Element | Oxide | Nd-Rich Phase | RUST STATE | MAGNETICAL PROPERTIES PRIOR TO ANTI-CORROSION TEST Br (KG) | iHc (KOe) | BH max (MGOe) | AFTER ANTI-CORROSION TEST Br (KG) | iHc (KOe) | BH max (MGOe) |
|---|---|---|---|---|---|---|---|---|---|---|
| EXAMPLES | | | | | | | | | | |
| 395 | Ni: 25 | 60 | remainder | absent | 12.6 | 13.5 | 37.9 | 12.4 | 13.3 | 37.0 |
| 396 | Co: 22 | 58 | ↑ | ↑ | 12.6 | 13.7 | 38.0 | 12.4 | 13.5 | 37.1 |
| 397 | Mn: 40 | 43 | ↑ | ↑ | 12.5 | 14.0 | 38.1 | 12.5 | 13.8 | 38.0 |
| 398 | Cr: 50 | 38 | ↑ | ↑ | 12.3 | 14.7 | 37.0 | 12.3 | 14.6 | 37.0 |
| 399 | Ti: 22 | 68 | ↑ | ↑ | 12.4 | 14.6 | 37.8 | 12.4 | 14.4 | 37.7 |
| 400 | V: 43 | 31 | ↑ | ↑ | 12.4 | 14.2 | 37.7 | 12.4 | 14.1 | 37.6 |
| 401 | Al: 31 | 46 | ↑ | ↑ | 12.3 | 14.5 | 36.9 | 12.3 | 14.3 | 36.8 |
| 402 | Ga: 36 | 40 | ↑ | ↑ | 12.5 | 13.8 | 38.0 | 12.5 | 13.6 | 37.9 |
| 403 | In: 21 | 36 | ↑ | ↑ | 12.5 | 13.5 | 37.8 | 12.5 | 13.2 | 37.6 |
| 404 | Zr: 25 | 48 | ↑ | ↑ | 12.6 | 13.4 | 37.9 | 12.5 | 13.0 | 37.2 |
| 405 | Hf: 55 | 40 | ↑ | ↑ | 12.5 | 14.1 | 38.1 | 12.5 | 14.0 | 38.1 |
| 406 | Nb: 47 | 34 | ↑ | ↑ | 12.5 | 14.2 | 38.2 | 12.5 | 14.0 | 38.1 |
| 407 | Dy: 55 | 31 | ↑ | ↑ | 12.3 | 15.0 | 37.0 | 12.3 | 14.8 | 37.0 |
| 408 | Y: 52 | 45 | ↑ | ↑ | 12.5 | 13.9 | 38.0 | 12.5 | 13.8 | 38.0 |
| 409 | Ni: 5 Dy: 38 | 32 | ↑ | ↑ | 12.3 | 14.8 | 36.9 | 12.3 | 14.7 | 36.9 |
| 410 | Mn: 5 Cr: 25 | 60 | ↑ | ↑ | 12.5 | 14.0 | 38.1 | 12.5 | 13.9 | 38.0 |
| 411 | Cr: 5 Y: 36 | 51 | ↑ | ↑ | 12.5 | 14.1 | 38.1 | 12.5 | 14.0 | 38.1 |
| 157 | — | — | 100 | heavy | 12.5 | 12.5 | 36.8 | 11.2 | 7.5 | 22.0 |

TABLE 18

| SAMPLE | Boundary Phase Composition (weight %) Metallic Element | Nd-Rich Phase | RUST STATE | MAGNETICAL PROPERTIES PRIOR TO ANTI-CORROSION TEST Br (KG) | iHc (KOe) | BH max (MGOe) | AFTER ANTI-CORROSION TEST Br (KG) | iHc (KOe) | BH max (MGOe) |
|---|---|---|---|---|---|---|---|---|---|
| EXAMPLES | | | | | | | | | |
| 412 | Zr: 25 | remainder | absent | 12.6 | 13.6 | 38.0 | 12.4 | 13.2 | 37.0 |
| 413 | Ta: 45 | ↑ | ↑ | 12.5 | 13.5 | 37.8 | 12.3 | 13.2 | 36.2 |
| 414 | Ti: 85 | ↑ | ↑ | 12.5 | 14.5 | 38.3 | 12.4 | 14.1 | 37.6 |
| 415 | Nb: 59 | ↑ | ↑ | 12.5 | 14.3 | 38.2 | 12.4 | 13.9 | 37.5 |
| 416 | V: 88 | ↑ | ↑ | 12.4 | 14.5 | 37.8 | 12.4 | 14.1 | 37.6 |
| 417 | Hf: 52 | ↑ | ↑ | 12.5 | 13.9 | 38.0 | 12.4 | 13.6 | 37.4 |
| 418 | Y: 63 | ↑ | ↑ | 12.6 | 13.8 | 38.2 | 12.5 | 13.6 | 37.8 |
| 419 | Ni: 5 Ti: 41 | ↑ | ↑ | 12.6 | 13.8 | 38.2 | 12.5 | 13.5 | 37.7 |
| 420 | V: 33 Y: 36 | ↑ | ↑ | 12.5 | 14.0 | 38.1 | 12.4 | 13.8 | 37.5 |
| 421 | Nb: 21 Hf: 23 | ↑ | ↑ | 12.5 | 13.6 | 37.8 | 12.3 | 13.3 | 36.3 |
| 422 | Zr: 12 | ↑ | ↑ | 12.5 | 13.9 | 38.0 | 12.4 | 13.7 | 37.4 |

TABLE 18-continued

| SAMPLE | Boundary Phase Composition (weight %) Metallic Element | Nd-Rich Phase | RUST STATE | MAGNETICAL PROPERTIES PRIOR TO ANTI-CORROSION TEST Br (KG) | iHc (KOe) | BH max (MGOe) | AFTER ANTI-CORROSION TEST Br (KG) | iHc (KOe) | BH max (MGOe) |
|---|---|---|---|---|---|---|---|---|---|
| | Y: 62 | | | | | | | | |

Potential for Industrial Applications

The sintered rare earth metal-boron-iron alloy magnets of the present invention may be used for any industrial device which requires magnets with superior magnetic and anti-corrosion properties.

What is claimed is:

1. A manufacturing method for sintered rare earth metal-B-Fe alloy magnets comprising the steps of
   a) preparing a powder obtained by adding at least one additive agent of an oxide powder of Al, Ga, Ni, Co, Mn, Cr, Ti, V, Nb, Y, Ho, Er, Tm, Lu, Zr or Eu, or a hydride powder of Zr, Ta, Ti, Nb, V, Hf, or Y, to R-B-Fe alloy powder wherein R is a rare earth element or Y, the amount of said additive agent totaling from 0.0005 to 3.0 weight %,
   b) molding the alloy powder and additive agent; and,
   c) sintering the molded alloy powder and additive agent.

2. A manufacturing method for sintered rare earth metal-B-Fe alloy magnets in accordance with claim 1 wherein the additive agent is Al an Zr oxide powders.

3. A manufacturing method for sintered rare earth metal-B-Fe alloy magnets in accordance with claim 1 wherein the additive agent is Al and Cr oxide powders.

4. A manufacturing method for sintered rare earth metal-B-Fe alloy magnets in accordance with claim 1 wherein the additive agent is Al and Ti oxide powders.

5. A manufacturing method for sintered rare earth metal-B-Fe alloy magnets in accordance with claim 1 wherein the additive agent is Al, Zr, and Cr oxide powders.

6. A manufacturing method for sintered rare earth metal-B-Fe alloy magnets in accordance with claim 1 wherein the additive agent is Al, Zr, and Ti oxide powders.

7. A manufacturing method for sintered rare earth metal-B-Fe alloy magnets in accordance with claim 1 wherein the additive agent is Al, Cr, and Ti oxide powders.

8. A manufacturing method for sintered rare earth metal-B-Fe alloy magnets in accordance with claim 1 wherein the additive agent is Al, Zr, Cr, and Ti oxide powders.

9. A manufacturing method for sintered rare earth metal-B-Fe alloy magnets in accordance with claim 1 wherein the additive agent is Ga and Al oxide powders.

10. A manufacturing method for sintered rare earth metal-B-Fe alloy magnets in accordance with claim 1 wherein the additive agent is Ga and Cr oxide powders.

11. A manufacturing method for sintered rare earth metal-B-Fe alloy magnets in accordance with claim 1 wherein the additive agent is Ga and V oxide powders.

12. A manufacturing method for sintered rare earth metal-B-Fe alloy magnets in accordance with claim 1 wherein the additive agent is Ga, Al, and Cr oxide powders.

13. A manufacturing method for sintered rare earth metal-B-Fe alloy magnets in accordance with claim 1 wherein the additive agent is Ga, Cr, and V oxide powders.

14. A manufacturing method for sintered rare earth metal-B-Fe alloy magnets in accordance with claim 1 wherein the additive agent is Ga, Al, and V oxide powders.

15. A manufacturing method for sintered rare earth metal-B-Fe alloy magnets in accordance with claim 1 wherein the additive agent is Ga, Al, Cr, and V oxide powders.

16. A manufacturing method for sintered rare earth metal-B-Fe alloy magnets in accordance with claim 1 wherein the additive agent is a hydride powder and R is a rare earth element.

17. A manufacturing method for sintered rare earth metal-B-Fe alloy magnets in accordance with claim 1 wherein the additive agent is an oxide powder of Y, Ho, Er, Tm, Lu, or Eu and R is a rare earth element of Nd, Pr, La, Ce, Dy, Sm, Tb, Gd, or Yb.

18. A manufacturing method for sintered rare earth metal-B-Fe alloy magnets in accordance with claim 1 wherein the additive agent is a Cr oxide powder and additionally comprising at least one nitride powder of Cr, Mn, Zr, Hf, Ti, Nb, Si, Ge, V, Ga, Al, or Co in an amount totaling from 0.0005 to 3.0 weight %.

19. A manufacturing method for sintered rare earth metal-B-Fe alloy magnets in accordance with claim 1 wherein the additive is a Ni oxide powder and additionally comprising at least one nitride powder of Cr, Mn, Zr, Hf, Ti, Nb, Si, Ge, V, Ga, Al, or Co in an amount totaling from 0.0005 to 3.0 weight %.

20. A manufacturing method for sintered rare earth metal-B-Fe alloy magnets in accordance with claim 1 wherein the additive agent is Cr and Ni oxide powders, and at least one nitride powder of Cr, Mn, Zr, Hf, Ti, Nb, Si, Ge, V, Ga, Al, or Co in an amount totaling from 0.0005 to 3.0 weight %.

21. A manufacturing method for sintered rare earth metal-B-Fe alloy magnets in accordance with any one of claims 1 through 20 including heat treating the sintered compact.

22. A sintered rare earth metal-B-Fe alloy magnet comprising a $R_2Fe_{14}B$ phase and an inter-granular boundary phase around said $R_2Fe_{14}B$ phase, wherein R is a rare earth element or Y and said inter-granular boundary phase comprises at least one of Ni, Co, Mn, Cr, Ti, V, Al, Ga, In, Zr, Hf, Ta, Nb, Mo, Si, Re, or W in an amount of 20 to 90 atomic %.

23. A sintered rare earth metal-B-Fe alloy magnet in accordance with claim 22 additionally comprising oxygen in an amount of 30 to 70 atomic % in said inter-granular boundary phase.

24. A sintered rare earth metal-B-Fe alloy magnet comprising a $R_2Fe_{14}B$ phase and an inter-granular boundary phase around said $R_2Fe_{14}B$ phase, wherein R is a rare earth element or Y and said inter-granular boundary phase comprises R in an amount of 20 to 90 atomic % and oxygen in an amount of 30 to 70 atomic %.

25. A sintered rare earth metal-B-Fe alloy magnet in accordance with claim 24 additionally comprising at least one of Ni, Co, Mn, Cr, T, V, Al, Ga, In, Zr, Hf, Ta, Nb, Mo, Sn, Re, or W in an amount of 20 to 90 atomic % in said inter-granular boundary phase.

* * * * *

UNITED STATES PATENT AND TRADEMARK OFFICE

CERTIFICATE OF CORRECTION

PATENT NO. : 5,147,447
DATED : September 15, 1992
INVENTOR(S) : Takuo Takeshita, et al.

It is certified that error appears in the above-indentified patent and that said Letters Patent is hereby corrected as shown below:

Column 10, line 2: "min" should read as --min.--

Column 21, line 62: "$CO_2O_3$" should read as --$Co_2O_3$--

Column 24, lines 56 & 57: "22.5" should read as --22.3--

Column 34, Examples 56-64:

"

| | | | | | | | | |
|---|---|---|---|---|---|---|---|---|
| 56 | — | — | — | — | — | — | — | 0 |
| 57 | 0.0003 | — | — | — | — | — | — | 0.0003 |
| 58 | 3.5 | — | — | — | — | — | — | 3.5 |
| 59 | — | 0.0002 | — | — | — | — | — | 0.0002 |
| 60 | — | 3.3 | — | — | — | — | — | 3.3 |
| 61 | — | — | 0.0003 | — | — | — | — | 0.0003 |
| 62 | — | — | 3.6 | — | — | — | — | 3.6 |
| 63 | — | — | — | 0.0003 | — | — | — | 0.0003 |
| 64 | — | — | — | 3.4 | — | — | — | 3.4 |

"

should read as

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

| | | | | | | | | |
|---|---|---|---|---|---|---|---|---|
| 56 | – | – | – | – | – | – | – | 0 |
| 57 | 0.0003※ | – | – | – | – | – | – | 0.0003※ |
| 58 | 3.5 ※ | – | – | – | – | – | – | 3.5 ※ |
| 59 | – | 0.0002※ | – | – | – | – | – | 0.0002※ |
| 60 | – | 3.3 ※ | – | – | – | – | – | 3.3 ※ |
| 61 | – | – | 0.0003※ | – | – | – | – | 0.0003※ |
| 62 | – | – | 3.6 ※ | – | – | – | – | 3.6 ※ |
| 63 | – | – | – | 0.0003※ | – | – | – | 0.0003※ |
| 64 | – | – | – | 3.4 ※ | – | – | – | 3.4 ※ |

Column 34, line 68: before "indicates"

insert -- ※ --

Columns 35 & 36, Examples 65-73:

"

| | | | | | | | | |
|---|---|---|---|---|---|---|---|---|
| 65 | – | – | – | – | 0.0003 | – | – | 0.0003 |
| 66 | – | – | – | – | 3.5 | – | – | 3.5 |
| 67 | – | – | – | – | – | 0.0003 | – | 0.0003 |
| 68 | – | – | – | – | – | 3.4 | – | 3.4 |
| 69 | – | – | – | – | – | – | 0.0003 | 0.0003 |
| 70 | – | – | – | – | – | – | 3.5 | 3.5 |
| 71 | 0.0001 | 0.0001 | 0.0001 | – | – | – | – | 0.0003 |
| 72 | 0.5 | 0.5 | 0.5 | 0.5 | 0.5 | 0.5 | 0.5 | 3.5 |
| 73 | 1.8 | – | 1.8 | – | – | – | – | 3.6 |

"

should read as

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

| | | | | | | | | |
|---|---|---|---|---|---|---|---|---|
| 65 | – | – | – | – | 0.0003※ | – | – | 0.0003※ |
| 66 | – | – | – | – | 3.5 ※ | – | – | 3.5 ※ |
| 67 | – | – | – | – | – | 0.0003※ | – | 0.0003※ |
| 68 | – | – | – | – | – | 3.4 ※ | – | 3.4 ※ |
| 69 | – | – | – | – | – | – | 0.0003※ | 0.0003※ |
| 70 | – | – | – | – | – | – | 3.5 ※ | 3.5 ※ |
| 71 | 0.0001※ | 0.0001※ | 0.0001※ | – | – | – | – | 0.0003※ |
| 72 | 0.5 | 0.5 | 0.5 | 0.5 | 0.5 | 0.5 | 0.5 | 3.5 ※ |
| 73 | 1.8 | – | 1.8 | – | – | – | – | 3.6 ※ |

Column 35, line 32: before "indicates" insert --※ --

Column 37, Example 187: "0.8" should read as --0.08--

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Columns 41 & 42, Examples 75-89:

"

| | | | | | | | |
|---|---|---|---|---|---|---|---|
| 75 | 0.0003 | — | — | — | — | — | 0.0003 |
| 76 | 3.1 | — | — | — | — | — | 3.1 |
| 77 | — | 0.0002 | — | — | — | — | 0.0002 |
| 78 | — | 3.2 | — | — | — | — | 3.2 |
| 79 | — | — | 0.0003 | — | — | — | 0.0003 |
| 80 | — | — | 3.1 | — | — | — | 3.1 |
| 81 | — | — | — | 0.0003 | — | — | 0.0003 |
| 82 | — | — | — | 3.1 | — | — | 3.1 |
| 83 | — | — | — | — | 0.0003 | — | 0.0003 |
| 84 | — | — | — | — | 3.2 | — | 3.2 |
| 85 | — | — | — | — | — | 0.0003 | 0.0003 |
| 86 | — | — | — | — | — | 3.1 | 3.1 |
| 87 | 0.0001 | 0.0001 | 0.0001 | — | — | — | 0.0003 |
| 88 | 0.5 | 0.5 | 0.5 | 0.5 | 0.5 | 0.6 | 3.1 |
| 89 | — | 1.5 | — | 1.7 | — | — | 3.2 |

"

should read as

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

| | | | | | | | |
|---|---|---|---|---|---|---|---|
| 75 | 0.0003 | – | – | – | – | – | 0.0003※ |
| 76 | 3.1 ※ | – | – | – | – | – | 3.1 ※ |
| 77 | – | 0.0002 | – | – | – | – | 0.0002※ |
| 78 | – | 3.2 ※ | – | – | – | – | 3.2 ※ |
| 79 | – | – | 0.0003 | – | – | – | 0.0003※ |
| 80 | – | – | 3.1 ※ | – | – | – | 3.1 ※ |
| 81 | – | – | – | 0.0003 | – | – | 0.0003※ |
| 82 | – | – | – | 3.1 ※ | – | – | 3.1 ※ |
| 83 | – | – | – | – | 0.0003 | – | 0.0003※ |
| 84 | – | – | – | – | 3.2 ※ | – | 3.2 ※ |
| 85 | – | – | – | – | – | 0.0003 | 0.0003※ |
| 86 | – | – | – | – | – | 3.1 ※ | 3.1 ※ |
| 87 | 0.0001 | 0.0001 | 0.0001 | – | – | – | 0.0003※ |
| 88 | 0.5 | 0.5 | 0.5 | 0.5 | 0.5 | 0.6 | 3.1 ※ |
| 89 | – | 1.5 | – | 1.7 | – | – | 3.2 ※ |

Column 51, line 20: "A" should read as --A*--

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Column 52, line 16: "13.2" should read as --13.3--

Columns 51 & 52, Examples 90-99:

| | | | | | | | | | | | | | | | | | |
|---|---|---|---|---|---|---|---|---|---|---|---|---|---|---|---|---|---|
| " | 90 | 0.0002 | 0.5 | — | — | — | — | — | — | — | — | — | — | — | — | 0.5 | " |
| | 91 | 3.1 | 0.5 | — | — | — | — | — | — | — | — | — | — | — | — | 0.5 | |
| | 92 | 1.3 | 0.0002 | — | — | — | — | — | — | — | — | — | — | — | — | 0.0002 | |
| | 93 | 1.3 | 3.2 | — | — | — | — | — | — | — | — | — | — | — | — | 3.2 | |
| | 94 | 1.3 | — | 0.0002 | — | — | — | — | — | — | — | — | — | — | — | 0.0002 | |
| | 95 | 1.3 | — | 3.3 | — | — | — | — | — | — | — | — | — | — | — | 3.3 | |
| | 96 | 1.3 | — | — | 0.0003 | — | — | — | — | — | — | — | — | — | — | 0.0003 | |
| | 97 | 1.3 | — | — | 3.2 | — | — | — | — | — | — | — | — | — | — | 3.2 | |
| | 98 | 1.3 | — | — | — | 0.0001 | — | — | — | — | — | — | — | — | — | 0.0001 | |
| | 99 | 1.3 | — | — | — | 3.3 | — | — | — | — | — | — | — | — | — | 3.3 | |

should read as

| | | | | | | | | | | | | | | | |
|---|---|---|---|---|---|---|---|---|---|---|---|---|---|---|---|
| 90 | 0.0002 | 0.5 | — | — | — | — | — | — | — | — | — | — | — | — | 0.5 |
| 91 | 3.1 | 0.5 | — | — | — | — | — | — | — | — | — | — | — | — | 0.5 |
| 92 | 1.3 | 0.0002 | — | — | — | — | — | — | — | — | — | — | — | — | 0.0002 |
| 93 | 1.3 | 3.2 | — | — | — | — | — | — | — | — | — | — | — | — | 3.2 |
| 94 | 1.3 | — | 0.0002 | — | — | — | — | — | — | — | — | — | — | — | 0.0002 |
| 95 | 1.3 | — | 3.3 | — | — | — | — | — | — | — | — | — | — | — | 3.3 |
| 96 | 1.3 | — | — | 0.0003 | — | — | — | — | — | — | — | — | — | — | 0.0003 |
| 97 | 1.3 | — | — | 3.2 | — | — | — | — | — | — | — | — | — | — | 3.2 |
| 98 | 1.3 | — | — | — | 0.0001 | — | — | — | — | — | — | — | — | — | 0.0001 |
| 99 | 1.3 | — | — | — | 3.3 | — | — | — | — | — | — | — | — | — | 3.3 |

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al

It is certified that error appears in the above-indentified patent and that said Letters Patent is hereby corrected as shown below:

Column 53, Examples 100-119:

| | | | | | | | | | | | | | | |
|---|---|---|---|---|---|---|---|---|---|---|---|---|---|---|
| 100 | 1.3 | — | — | — | — | 0.0003 | — | — | — | — | — | — | — | — | 0.0003 |
| 101 | 1.3 | — | — | — | — | 3.2 | — | — | — | — | — | — | — | — | 3.2 |
| 102 | 1.3 | — | — | — | — | — | 0.0002 | — | — | — | — | — | — | — | 0.0002 |
| 103 | 1.3 | — | — | — | — | — | 3.3 | — | — | — | — | — | — | — | 3.3 |
| 104 | 1.3 | — | — | — | — | — | — | 0.0003 | — | — | — | — | — | — | 0.0003 |
| 105 | 1.3 | — | — | — | — | — | — | 3.2 | — | — | — | — | — | — | 3.2 |
| 106 | 1.3 | — | — | — | — | — | — | — | 0.0002 | — | — | — | — | — | 0.0002 |
| 107 | 1.3 | — | — | — | — | — | — | — | 3.3 | — | — | — | — | — | 3.3 |
| 108 | 1.3 | — | — | — | — | — | — | — | — | 0.0003 | — | — | — | — | 0.0003 |
| 109 | 1.3 | — | — | — | — | — | — | — | — | 3.2 | — | — | — | — | 3.2 |
| 110 | 1.3 | — | — | — | — | — | — | — | — | — | 0.0002 | — | — | — | 0.0002 |
| 111 | 1.3 | — | — | — | — | — | — | — | — | — | 3.3 | — | — | — | 3.3 |
| 112 | 1.3 | — | — | — | — | — | — | — | — | — | — | 0.0001 | — | — | 0.0001 |
| 113 | 1.3 | — | — | — | — | — | — | — | — | — | — | 3.2 | — | — | 3.2 |
| 114 | 1.3 | — | — | — | — | — | — | — | — | — | — | — | 0.0002 | — | 0.0002 |
| 115 | 1.3 | — | — | — | — | — | — | — | — | — | — | — | 3.3 | — | 3.3 |
| 116 | 1.3 | — | — | — | — | — | — | — | — | — | — | — | — | 0.0003 | 0.0003 |
| 117 | 1.3 | — | — | — | — | — | — | — | — | — | — | — | — | 3.2 | 3.2 |
| 118 | — | 0.5 | 0.5 | — | — | 0.5 | — | — | — | — | — | — | — | — | 1.5 |
| 119 | 1.3 | 0.5 | 0.5 | — | — | 0.5 | — | 0.5 | 0.5 | — | 0.5 | — | 0.5 | — | 3.5 |

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

| | | | | | | | | | | | | | | | |
|---|---|---|---|---|---|---|---|---|---|---|---|---|---|---|---|
| 100 | 1.3 | – | – | – | – | 0.0003 | – | – | – | – | – | – | – | – | 0.0003 |
| 101 | 1.3 | – | – | – | – | 3.2 | – | – | – | – | – | – | – | – | 3.2 |
| 102 | 1.3 | – | – | – | – | – | 0.0002 | – | – | – | – | – | – | – | 0.0002 |
| 103 | 1.3 | – | – | – | – | – | 3.3 | – | – | – | – | – | – | – | 3.3 |
| 104 | 1.3 | – | – | – | – | – | – | 0.0003 | – | – | – | – | – | – | 0.0003 |
| 105 | 1.3 | – | – | – | – | – | – | 3.2 | – | – | – | – | – | – | 3.2 |
| 106 | 1.3 | – | – | – | – | – | – | – | 0.0002 | – | – | – | – | – | 0.0002 |
| 107 | 1.3 | – | – | – | – | – | – | – | 3.3 | – | – | – | – | – | 3.3 |
| 108 | 1.3 | – | – | – | – | – | – | – | – | 0.0003 | – | – | – | – | 0.0003 |
| 109 | 1.3 | – | – | – | – | – | – | – | – | 3.2 | – | – | – | – | 3.2 |
| 110 | 1.3 | – | – | – | – | – | – | – | – | – | 0.0002 | – | – | – | 0.0002 |
| 111 | 1.3 | – | – | – | – | – | – | – | – | – | 3.3 | – | – | – | 3.3 |
| 112 | 1.3 | – | – | – | – | – | – | – | – | – | – | 0.0001 | – | – | 0.0001 |
| 113 | 1.3 | – | – | – | – | – | – | – | – | – | – | 3.2 | – | – | 3.2 |
| 114 | 1.3 | – | – | – | – | – | – | – | – | – | – | – | 0.0002 | – | 0.0002 |
| 115 | 1.3 | – | – | – | – | – | – | – | – | – | – | – | 3.3 | – | 3.3 |
| 116 | 1.3 | – | – | – | – | – | – | – | – | – | – | – | – | 0.0003 | 0.0003 |
| 117 | 1.3 | – | – | – | – | – | – | – | – | – | – | – | – | 3.2 | 3.2 |
| 118 | – | 0.5 | 0.5 | – | – | 0.5 | – | – | – | – | – | – | – | – | 1.5 |
| 119 | 1.3 | 0.5 | 0.5 | – | – | 0.5 | – | 0.5 | 0.5 | – | 0.5 | – | 0.5 | – | 3.5 |

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Column 54, line 43: "RUST STATE" should read as --RUST STATE ☆ --

Column 54, line 67: before "A is" insert -- ☆ --

Column 54, line 68: before "indicates" insert -- ☆ --

Column 56, line 66: "0.1" should read as --0.7--

Column 59, line 46: "0.00006" should read as --0.0006--

Column 59, line 64: "0.5" should read as --0.6--

Column 62, line 30: "1.136" should read as --0.136--

Column 63, Examples 120-133:

"

| | | | | | | | |
|---|---|---|---|---|---|---|---|
| 120 | 0.0002 | 0.9 | — | — | — | — | — |
| 121 | 3.1 | — | 0.9 | — | — | — | — |
| 122 | 1.2 | 0.0003 | — | — | — | — | — |
| 123 | 1.2 | 3.3 | — | — | — | — | — |
| 124 | 1.2 | — | 0.0002 | — | — | — | — |
| 125 | 1.2 | — | 3.2 | — | — | — | — |
| 126 | 1.2 | — | — | 0.0003 | — | — | — |
| 127 | 1.2 | — | — | 3.3 | — | — | — |
| 128 | 1.2 | — | — | — | 0.0002 | — | — |
| 129 | 1.2 | — | — | — | 3.2 | — | — |
| 130 | 1.2 | — | — | — | — | 0.0003 | — |
| 131 | 1.2 | — | — | — | — | 3.3 | — |
| 132 | 1.2 | — | — | — | — | — | 0.0001 |
| 133 | 1.2 | — | — | — | — | — | 3.2 |

"

should read as

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

| | | | | | | | | | | | | | | | |
|---|---|---|---|---|---|---|---|---|---|---|---|---|---|---|---|
| 120 | 0.0002☆ | 0.9 | – | – | – | – | – | – | – | – | – | – | – | – | 0.9 |
| 121 | 3.1 ☆ | – | 0.9 | – | – | – | – | – | – | – | – | – | – | – | 0.9 |
| 122 | 1.2 | 0.0003☆ | – | – | – | – | – | – | – | – | – | – | – | – | 0.0003☆ |
| 123 | 1.2 | 3.3 ☆ | – | – | – | – | – | – | – | – | – | – | – | – | 3.3 ☆ |
| 124 | 1.2 | – | 0.0002☆ | – | – | – | – | – | – | – | – | – | – | – | 0.0002☆ |
| 125 | 1.2 | – | 3.2 ☆ | – | – | – | – | – | – | – | – | – | – | – | 3.2 ☆ |
| 126 | 1.2 | – | – | 0.0003☆ | – | – | – | – | – | – | – | – | – | – | 0.0003☆ |
| 127 | 1.2 | – | – | 3.3 ☆ | – | – | – | – | – | – | – | – | – | – | 3.3 ☆ |
| 128 | 1.2 | – | – | – | 0.0002☆ | – | – | – | – | – | – | – | – | – | 0.0002☆ |
| 129 | 1.2 | – | – | – | 3.2 ☆ | – | – | – | – | – | – | – | – | – | 3.2 ☆ |
| 130 | 1.2 | – | – | – | – | 0.0003☆ | – | – | – | – | – | – | – | – | 0.0003☆ |
| 131 | 1.2 | – | – | – | – | 3.3 ☆ | – | – | – | – | – | – | – | – | 3.3 ☆ |
| 132 | 1.2 | – | – | – | – | – | 0.0001☆ | – | – | – | – | – | – | – | 0.0001☆ |
| 133 | 1.2 | – | – | – | – | – | 3.2 ☆ | – | – | – | – | – | – | – | 3.2 ☆ |

Column 63, line 49: before "A is" insert -- ☆ --

Column 63, line 50: before "indicates values" insert -- ☆ --

Column 63, line 27: "RUST STATE" should read as --RUST STATE ☆ --

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Column 63, lines 37-47: " 0.0003 3.3 0.0002 3.2 0.0003 3.3 0.0002 3.2 0.0003 3.3 0.0001 3.2 " should read as

| |
|---|
| 0.0003 |
| 3.3 |
| 0.0002 |
| 3.2 |
| 0.0003 |
| 3.3 |
| 0.0002 |
| 3.2 |
| 0.0003 |
| 3.3 |
| 0.0001 |
| 3.2 |

Column 63, line 60: "1.3" should read as

--1.2--

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Columns 63 & 64, lines 58-69:

"

| | | | | | | | | | | | | | | |
|---|---|---|---|---|---|---|---|---|---|---|---|---|---|---|
| 134 | 1.2 | — | — | — | — | — | — | 0.0003 | — | — | — | — | — | — |
| 135 | 1.2 | — | — | — | — | — | — | 3.3 | — | — | — | — | — | — |
| 136 | 1.3 | — | — | — | — | — | — | — | 0.0002 | — | — | — | — | — |
| 137 | 1.2 | — | — | — | — | — | — | — | 3.3 | — | — | — | — | — |
| 138 | 1.2 | — | — | — | — | — | — | — | — | 0.0003 | — | — | — | — |
| 139 | 1.2 | — | — | — | — | — | — | — | — | 3.3 | — | — | — | — |
| 140 | 1.2 | — | — | — | — | — | — | — | — | — | 0.0002 | — | — | — |
| 141 | 1.2 | — | — | — | — | — | — | — | — | — | 3.2 | — | — | — |
| 142 | 1.2 | — | — | — | — | — | — | — | — | — | — | 0.0003 | — | — |
| 143 | 1.2 | — | — | — | — | — | — | — | — | — | — | 3.3 | — | — |
| 144 | 1.2 | — | — | — | — | — | — | — | — | — | — | — | 0.0001 | — |
| 145 | 1.2 | — | — | — | — | — | — | — | — | — | — | — | 3.2 | — |
| 146 | 1.2 | — | — | — | — | — | — | — | — | — | — | — | — | 0.0002 |

"

should read as

| | | | | | | | | | | | | | | |
|---|---|---|---|---|---|---|---|---|---|---|---|---|---|---|
| 134 | 1.2 | — | — | — | — | — | — | 0.0003 | — | — | — | — | — | — |
| 135 | 1.2 | — | — | — | — | — | — | 3.3 | — | — | — | — | — | — |
| 136 | 1.3 | — | — | — | — | — | — | — | 0.0002 | — | — | — | — | — |
| 137 | 1.2 | — | — | — | — | — | — | — | 3.3 | — | — | — | — | — |
| 138 | 1.2 | — | — | — | — | — | — | — | — | 0.0003 | — | — | — | — |
| 139 | 1.2 | — | — | — | — | — | — | — | — | 3.3 | — | — | — | — |
| 140 | 1.2 | — | — | — | — | — | — | — | — | — | 0.0002 | — | — | — |
| 141 | 1.2 | — | — | — | — | — | — | — | — | — | 3.2 | — | — | — |
| 142 | 1.2 | — | — | — | — | — | — | — | — | — | — | 0.0003 | — | — |
| 143 | 1.2 | — | — | — | — | — | — | — | — | — | — | 3.3 | — | — |
| 144 | 1.2 | — | — | — | — | — | — | — | — | — | — | — | 0.0001 | — |
| 145 | 1.2 | — | — | — | — | — | — | — | — | — | — | — | 3.2 | — |
| 146 | 1.2 | — | — | — | — | — | — | — | — | — | — | — | — | 0.0002 |

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Column 65, lines 4 & 5: "- " should read as -- - -- ※

Column 65, lines 12-25: " should read as

| | |
|---|---|
| 134 | 0.0003 |
| 135 | 3.3 |
| 136 | 0.0002 |
| 137 | 3.3 |
| 138 | 0.0003 |
| 139 | 3.3 |
| 140 | 0.0002 |
| 141 | 3.2 |
| 412 | 0.0003 |
| 143 | 3.3 |
| 144 | 0.0001 |
| 145 | 3.2 |
| 146 | 0.0002 |
| 147 | 3.3 |
| 148 | 3.5 |
| 149 | 1.5 |
| 150 | — |

| |
|---|
| 0.0003 |
| 3.3 |
| 0.0002 |
| 3.3 |
| 0.0003 |
| 3.3 |
| 0.0002 |
| 3.2 |
| 0.0003 |
| 3.3 |
| 0.0001 |
| 3.2 |
| 0.0002 |
| 3.3 |
| 3.5 |
| 1.5 |
| — |

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al.

It is certified that error appears in the above-indentified patent and that said Letters Patent is hereby corrected as shown below:

Column 65, line 27: before "indicates" insert

--※ --

Column 66, line 3: "3.3" should read as

--3.3 ※ --

Column 65, line 55: "0.001" should read as

--0.01--

Column 68, line 56: "31." should read as

--3.1--

Column 68, lines 16-68:

| | | | | | | | | | | | | | | | | | |
|---|---|---|---|---|---|---|---|---|---|---|---|---|---|---|---|---|---|
| 151 | 0.3 | 0.1 | 0.4 | 0.0001 | 0.0001 | — | — | — | — | — | — | — | — | — | — | — | 0.0002 |
| 152 | 2.0 | 1.1 | 31. | 1.0 | — | — | 1.0 | — | — | — | — | — | — | — | — | 1.0 | 3.0 |
| 153 | 0.08 | 0.02 | 0.1 | 2.0 | 0.1 | 0.1 | 0.1 | 0.1 | 0.1 | 0.1 | 0.1 | 0.1 | 0.1 | 0.1 | 0.1 | 0.1 | 3.2 |
| 154 | 0.0002 | 0.0002 | 0.0004 | 2.0 | — | — | — | — | — | 0.3 | — | — | — | — | 0.2 | — | 2.5 |
| 155 | 0.0001 | 0.0001 | 0.0002 | 0.0001 | — | — | — | 0.0001 | — | — | — | — | — | — | — | — | 0.0002 |
| 154 | 1.4 | 1.9 | 3.3 | 2.0 | — | 0.3 | — | 0.3 | — | 0.3 | — | 0.3 | — | — | 0.3 | — | 3.5 |

should read as

UNITED STATES PATENT AND TRADEMARK OFFICE

CERTIFICATE OF CORRECTION

PATENT NO. : 5,147,447

DATED : September 15, 1992

INVENTOR(S) : Takuo Takeshita, et al

It is certified that error appears in the above-indentified patent and that said Letters Patent is hereby corrected as shown below:

| | | | | | | | | | | | | | | | | | | |
|---|---|---|---|---|---|---|---|---|---|---|---|---|---|---|---|---|---|---|
| 151 | 0.3 | 0.1 | 0.4 | 0.0001 | 0.0001 | – | – | – | – | – | – | – | – | – | – | – | | 0.0007 |
| 152 | 2.0 | 1.1 | 3.1 | 1.0 | – | – | 1.0 | – | – | – | – | – | – | – | – | 1.0 | | 3.0 |
| 153 | 0.08 | 0.02 | 0.1 | 2.0 | 0.1 | 0.1 | 0.1 | 0.1 | 0.1 | 0.1 | 0.1 | 0.1 | 0.1 | 0.1 | 0.1 | 0.1 | | 3.2 |
| 154 | 0.0002 | 0.0002 | 0.0004 | 2.0 | – | – | – | – | – | 0.3 | – | – | – | – | 0.2 | – | | 2.5 |
| 155 | 0.0001 | 0.0001 | 0.0002 | 0.0001 | – | – | – | 0.0001 | – | – | – | – | – | – | – | – | | 0.0002 |
| 156 | 1.4 | 1.9 | 3.3 | 2.0 | – | 0.3 | – | 0.3 | – | 0.3 | – | 0.3 | – | – | 0.3 | – | | 3.5 |

Column 69, line 45: "Y:52" should read as --Y:42--

Column 69, line 68: "Zr:12" should read as --Zr:12 Y:62--

Column 71, line 6: delete "Y:62"

Signed and Sealed this

Eighth Day of February, 1994

Bruce Lehman

*Attest:*

BRUCE LEHMAN

*Attesting Officer*

*Commissioner of Patents and Trademarks*